US005462845A

United States Patent [19]

Yoshioka

[11] Patent Number: 5,462,845

[45] Date of Patent: Oct. 31, 1995

[54] SILVER HALIDE COLOR PHOTOGRAPHIC LIGHT-SENSITIVE MATERIAL

[75] Inventor: Yasuhiro Yoshioka, Kanagawa, Japan

[73] Assignee: Fuji Photo Film Co., Ltd., Kanagawa, Japan

[21] Appl. No:: 275,333

[22] Filed: Jul. 14, 1994

Related U.S. Application Data

[63] Continuation of Ser. No. 159,459, Nov. 30, 1993, abandoned.

[30] Foreign Application Priority Data

Nov. 30, 1992 [JP] Japan ..... 4-341012

[51] Int. Cl.[6] ..... G03C 1/46

[52] U.S. Cl. ..... 430/505; 430/503; 430/557; 430/551; 430/546; 430/523; 430/531; 430/533; 430/538

[58] Field of Search ..... 430/503, 505, 430/557, 551, 546, 523, 531, 533, 538

[56] References Cited

U.S. PATENT DOCUMENTS

| | | | |
|---|---|---|---|
| 5,183,731 | 2/1993 | Takahashi et al. | 430/551 |
| 5,213,958 | 5/1993 | Motoki et al. | 430/557 |
| 5,238,803 | 8/1993 | Ichijima et al. | 430/557 |
| 5,250,406 | 10/1993 | Yamamoto et al. | 430/557 |

FOREIGN PATENT DOCUMENTS 0507489 10/1992 European Pat. Off. .

*Primary Examiner*—Charles L. Bowers, Jr.
*Assistant Examiner*—Geraldine Letscher
*Attorney, Agent, or Firm*—Sughrue, Mion, Zinn, Macpeak & Seas

[57] ABSTRACT

A silver halide color photographic light-sensitive material capable of providing a dye image having excellent color reproduction performance, sharpness and image fastness is disclosed. The light-sensitive material includes a reflective support having provided thereon (a) at least three light-sensitive hydrophilic colloid layers on one side of the reflective support, with at least one light-sensitive layer containing a yellow color-developing coupler and silver halide grains, at least one light,sensitive layer containing a magenta color-developing coupler and silver halide grains, and at least one light-sensitive layer containing a cyan color-developing coupler and silver halide emulsion grains, with each light-sensitive layer having a different color sensitivity from the other light-sensitive layers, and (b) a light-insensitive hydrophilic colloid layer; wherein on at least the side of the support on which the light-sensitive layers are coated, the surface of the support is coated with a composition prepared by mixing and dispersing a white pigment in a resin comprising mainly polyester synthesized by the polycondensation of a dicarboxylic acid and a diol, and a yellow coupler-containing layer contains at least one of the dye-forming couplers represented by formula (I), (II) or (III) as described in the specification.

17 Claims, No Drawings

SILVER HALIDE COLOR PHOTOGRAPHIC LIGHT-SENSITIVE MATERIAL

This is a continuation of application Ser. No. 08/159,459 filed Nov. 30, 1993, now abandoned.

FIELD OF THE INVENTION

The present invention relates to a silver halide color photographic light-sensitive material, specifically to a silver halide color photographic light-sensitive material capable of providing a dye image having excellent color reproduction performance, sharpness and image fastness.

BACKGROUND OF THE INVENTION

A silver halide color photographic light-sensitive material should have high image quality and excellent cost performance, and it is most popularly used as the means for reproducing a color image. In order to further improve the characteristics of the silver halide color photographic light-sensitive material, extensive investigations into increasing the image quality have been carried out. In order to increase image quality, it is important to obtain excellent color reproduction, a sharp image having no blur (a high sharpness), and excellent graininess in the color print after development processing.

It is very important that the dye image thus obtained is fast to light, heat and humidity and is not faded over a long time. In recent years, the fastness of the dye image has been strikingly improved, and it has been possible to store a color print for a long time.

Meanwhile, in order to increase the image quality in a color photographing material, extensive efforts have been made for improving sharpness and graininess, and a color negative film capable of providing a highly sensitive and sharp negative image is now available. Under such circumstances, it is anticipated that the improvement in the sharpness of a color paper will become more and more important in the future from the viewpoint of the improvement in the quality of a color print finally obtained.

In order to obtain an image having high sharpness, it is important that light for exposure is not spread over a wide range on a print face which generates fading. Known methods for preventing this spreading include the method in which a water soluble dye is used in order to prevent irradiation generated on an emulsion layer provided on a reflection type support, the method in which a coloring layer (AH) is provided in order to prevent halation, and the method in which reflection rate is raised in the vicinity of the surface of a reflection type support in order to prevent a blur in the support.

Of these methods, there is described in JP-A-3-156439 (the term "JP-A" as used herein means an unexamined published Japanese patent application) which corresponds to U.S. Pat. No. 5,151,345 as the method for preventing a blur, the method in which a white pigment is incorporated into a waterproof resin layer covering a reflection type support in the proportion of 14% by weight or more. Further, there is described in JP-A- 57-64235 and JP-A-62-187846, the method in which a hydrophilic colloid layer containing a white pigment is provided between a support and a silver halide emulsion layer.

However, there is still a problem in these methods in which a white pigment is used, in that the background is yellowed during storage over a long period of time after a processing and also that the discoloring or fading of a dye image is accelerated. Further, in the methods in which there is provided a coloring layer in which a water soluble dye and colloidal silver are present, the increase in the amount thereof used in order to obtain a higher sharpness causes a residual color on the background after processing and generates discoloring and fading on the background of a dye image due to aging, and thus further improvement is necessary.

The color image-forming method most generally used in a silver halide color photographic light-sensitive material is the method in which an aromatic primary amine series color developing agent oxidized with exposed silver halide used as an oxidizing agent is reacted with a coupler to form indophenol, indoaniline, indamine, azomethine, phenoxazine, phenazine, and equivalent dyes. In such a system, the method in which a color image is reproduced by a subtractive color process is used, and generally the three color dyes formed of yellow, magenta and cyan are changed to form the color image.

Of them, a pivaloyl type yellow coupler and a benzoyl type yellow coupler have most generally been used as a yellow coupler. The former has the defect that color developing performance is low while the fastness of a dye image formed is excellent, and it is limited for meeting the acceleration and low replenishing needs in processing, which has been strongly demanded in recent years. Further, it has not yet reached a sufficiently satisfactory level in terms of the hue of the dye formed. On the other hand, the latter has the serious problem that while it has a high color developing performance, the dye formed has poor hue, and the dye image has very low fastness.

In the coupler for a color print, serious consideration is placed on the hue and fastness of the dye formed, and therefore the pivaloyl type yellow coupler is generally used. However, the pivaloyl type yellow coupler also has not yet reached a sufficiently satisfactory level in terms of the hue, and thus further improvement is desired.

In order to improve the color reproduction performance of the color print, attention is paid to the pivaloylacetanilide type coupler having an alkoxy group at the ortho position of an anilide ring. While this coupler is certainly improved to some extent in terms of the color reproduction performance, a problem still remains in terms of the fastness of the dye image.

The problem common to the pivaloyl type coupler is insufficient image fastness under the condition of a high humidity. Further, it has a problem as well in terms of light fastness after it is left under a high humidity. As the color print is stored in the environment in which light, heat and humidity are changed, the evaluation of actual fastness becomes difficult, and it is necessary to check film quality under various conditions.

Further, in recent years, there have been proposed for the improvement in color reproduction performance and color development performance, the acylacetoamide type yellow coupler having a 3- to 5-membered cyclic structure, described in European Patent EP 0,447,969A1, the malondianilide type yellow coupler having a cyclic structure, described in European Patent EP 0,482,552A1 (corresponding to U.S. Pat. No. 5,213,958), and the acylacetoanilide type yellow coupler having a dioxane structure, described in U.S. Pat. No. 5,118,599.

SUMMARY OF THE INVENTION

Accordingly, a first object of the present invention is to provide a silver halide color photographic light-sensitive material capable of providing a sharp dye image having excellent sharpness. A second object of the present invention is to provide a silver halide color photographic light-sensitive material in which a dye image, formed by development processing has good hue and color reproduction performance, is excellent. A third object of the present invention is to provide a silver halide color photographic light-sensitive material in which a dye image formed is fast and less susceptible to discoloring or fading even under various storing conditions.

The above and other objects and advantages of the present invention have been achieved by (1) a silver halide color photographic light-sensitive material comprising on a reflective support (a) at least three light-sensitive hydrophilic colloid layers each containing any of a yellow, magenta and cyan color-developing coupler and silver halide emulsion grains each having a different color sensitivity and (b) a light-insensitive hydrophilic colloid layer, wherein said reflective support is coated at least on the surface of a support side on which the light-sensitive hydrophilic colloid layers are coated with a composition prepared by mixing and dispersing a white pigment in a resin comprising mainly polyester synthesized by the polycondensation of dicarboxylic acid and diol, and the yellow coupler-containing layer contains at least one of the dye-forming couplers represented by the following formulae (I), (II) or (III):

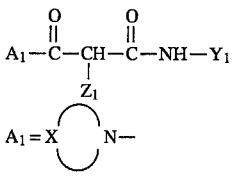

(I)

wherein X represents an organic group necessary to form a nitrogen-containing heterocyclic group together with a nitrogen atom; $Y_1$ represents an aromatic group or a heterocyclic group; and $Z_1$ represents a group that splits off when the coupler represented by formula (I) reacts with the oxidation product of a developing agent;

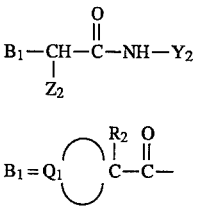

(II)

wherein $R_2$ represents a monovalent group excluding a hydrogen atom; $Q_1$ represents a group of non-metal atoms necessary to form a 3- to 5-membered hydrocarbon ring or a 3- to 6-membered heterocyclic group having at least one hetero atom selected from the group consisting of N, O, S and P in the ring together with a carbon atom; provided that $R_2$ may be combined with $Q_1$ to form a polycyclic ring having two or more rings; $Z_2$ represents a hydrogen atom or a group capable of splitting off upon a coupling reaction with the oxidation product of an aromatic primary amine developing agent; and $Y_2$ represents an aromatic group or a heterocyclic group;

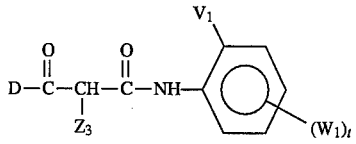

(III)

wherein D represents a tertiary alkyl group; $V_1$ represents a fluorine atom, an alkoxy group, an aryloxy group, a dialkylamino group, an alkylthio group, an arylthio group, or an alkyl group; $Z_3$ is synonymouns with that defined for $Z_1$ in formula (I); $W_1$ represents a group capable of being substituted on a benzene ring; and t represents an integer of 0 to 4.

Other embodiments of the present invention are described below.

(2) The silver halide color photographic light-sensitive material described in the above item (1), wherein the polyester coated on the reflective support comprises mainly polyethylene terephthalate.

(3) The silver halide color photographic light-sensitive material described in the above item (1), wherein the polyester coated on the reflective support is polyester synthesized by the polycondensation of dicarboxylic acid and diol; the reflective support is coated on the surface of the support side on which the light-sensitive hydrophilic colloid layers are coated with a composition prepared by mixing and dispersing a white pigment in a polyester in which a dicarboxylic acid component is a mixture of terephthalic acid and isophthalic acid in the mole ratio of 9:1 to 2:8 and on an another side of the support the support is coated with a resin or a composition comprising mainly a resin.

(4) The silver halide color photographic light-sensitive material described in the above item (1), wherein the polyester coated on the reflective support is synthesized by the polycondensation of a dicarboxylic acid and a diol; the reflective support is coated on the surface of the support side on which the light-sensitive hydrophilic colloid layers are coated with a composition prepared by mixing and dispersing a white pigment in polyester in which a dicarboxylic acid component is a mixture of terephthalic acid and naphthalenedicarboxylic acid in the mole ratio of 9:1 to 2:8 and on an another side of the support the support is coated with a resin or a composition comprising mainly a resin.

(5) The silver halide color photographic light-sensitive material described in the above item (3) or (4), wherein the diol is ethylene glycol.

(6) The silver halide color photographic light-sensitive material described in any of the above items (1) to (5), wherein the white pigment contained in the reflective support is titanium oxide; and the weight ratio of titanium oxide to a resin comprising mainly polyester is 5/95 to 50/50.

(7) The silver halide color photographic light-sensitive material described in any of the above items (1) to (5), wherein the yellow coupler-containing layer contains at least one of the compounds represented by the following formula (IV), (V), (VI), (VII), or (VIII):

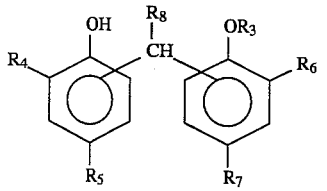

(IV)

wherein $R_3$ represents a hydrogen atom, an alkyl group, an acyl group, an aryl group, or an alkenyl group; $R_4$, $R_5$, $R_6$ and $R_7$ independently represents an alkyl group; $R_8$ represents a hydrogen atom or an alkyl group; the methine group connecting the two benzene rings is bonded at an ortho position, a meta position or a para position to an oxygen atom on each ring; and in the case where it is bonded at the para position, $R_5$ or $R_7$ represents the methine group itself and in this case, the benzene ring may further have an alkyl group;

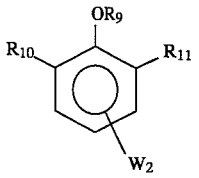

(V)

wherein $R_9$ represents a hydrogen atom, an alkyl group, an aryl group, or an acyl group; $R_{10}$ and $R_{11}$ independently represents a substituted or unsubstituted alkyl group or an alkoxy group; and $W_2$ represents a monovalent group capable of being substituted on a benzene ring;

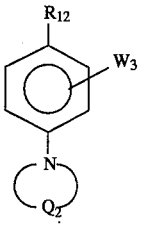

(VI)

wherein $Q_2$ represents a divalent group forming a 5- to 7-membered heterocyclic ring together with a nitrogen atom and an alkylene group; $R_{12}$ represents an alkyl group, an alkoxy group, an aryloxy group, or an acyloxy group; and $W_3$ represents a monovalent group capable of being substituted on a benzene ring;

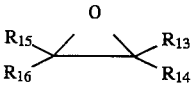

(VII)

wherein $R_{13}$, $R_{14}$, $R_{15}$ and $R_{16}$ each represents a hydrogen atom, an aliphatic group, an aromatic group, an aliphatic oxycarbonyl group, an aromatic oxycarbonyl group, or a carbamoyl group, provided that all of $R_{13}$, $R_{14}$, $R_{15}$ and $R_{16}$ are not hydrogen atoms at the same time; and a plurality of the epoxy groups represented by formula (VII) can be contained in one molecule in a number from 1 to 60 groups;

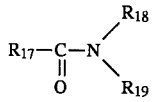

(VIII)

wherein $R_{17}$, $R_{18}$ and $R_{19}$ independently represents an alkyl group or an aryl group; in the case where both of $R_{18}$ and $R_{19}$ are alkyl groups, they may be combined with each other to form a 5- to 7-membered ring; and further, either one of $R_{18}$ and $R_{19}$ may be a hydrogen atom.

(8) The silver halide color photographic light-sensitive material described in any of the above items (1) to (5), wherein the yellow coupler-containing layer contains the compound represented by the above formula (IV) and the compound represented by the above formula (VII).

(9) The silver halide color photographic light-sensitive material described in any of the above items (1) to (5), wherein the yellow coupler-containing layer contains at least one of the compounds represented by the above formula (IV) or (V) and at least one of the compounds represented by the above formula (VI) or (VII).

(10) A method for forming a color image, comprising subjecting the silver halide color photographic light-sensitive material described in any of the above items (1) to (5) to an exposure by a scanning exposure system in which an exposing time per picture element is shorter than $10^{-4}$ second.

DETAILED DESCRIPTION OF THE INVENTION

In the present application, the term "X comprising mainly Y" signifies that the proportion of Y in X is at least 50% by weight.

The present inventors extensively studied the dye-forming coupler, various additives, and the constitution of a support. However, they discovered that changing only one of the above items could not satisfy image sharpness, color reproduction performance, and image stability requirements at the same time, which is achieved with the present invention. Further detailed investigations made by the present inventors have resulted in a silver halide color photographic light-sensitive material capable of satisfying the requirements of image sharpness, color reproduction performance, and image stability at the same time, and a method for forming an image therewith, by applying the above support and using in combination a dye-forming coupler and an image stabilizer.

The yellow coupler represented by formula (I) will be described below in detail.

The nitrogen-containing heterocycle represented by $A_1$ is a saturated or unsaturated, monocyclic or condensed ring having the carbon number of about 1 or more, preferably about 1 to 20, and particularly preferably about 2 to 12, which may be either substituted or unsubstituted. In addition to the nitrogen atom, an oxygen atom, a sulfur atom, or a phosphorous atom may be present in the ring. Each one or more of these hetero atoms may be present. The ring is a 3-membered or more ring, preferably a 3- to 12-membered ring, particularly preferably a 5- to 6-membered ring.

Concrete examples of the nitrogen-containing heterocyclic group represented by $A_1$ include pyrrolidino, piperizino, morpholino, 1-imidazolidinyl, 1-pyrazolyl, 1-piperazinyl, 1-indolinyl, 1,2,3,4-tetrahydroquinoxaline-1-yl, 1-pyrrolinyl, pyrazolidine-1-yl, 2,3-dihydro-1-indazolyl, isoindoline- 2-yl, 1-indolyl, 1-pyrrolyl, benzothiazine-4-yl, 4-thiazinyl, benzodiazine-1-yl, aziridine-1-yl, benzoxadine- 4-yl, 2,3,4, 5-tetrahydroquinolyl, and phenoxadine-10-yl.

When $Y_1$ represents an aromatic group in formula (I), it is a substituted or unsubstituted aromatic group having the carbon number of about 6 or more, preferably about 6 to 10. It is particularly preferably phenyl or naphthyl.

When $Y_1$ represents a heterocyclic group in formula (I), it is a saturated or unsaturated, substituted or unsubstituted heterocyclic group having the carbon number of about 1 or more, preferably about 1 to 10, and particularly preferably about 2 to 5. A nitrogen atom, a sulfur atom, or an oxygen atom is an example of a preferred hetero atom. The number of the ring is preferably a 5- to 6-membered ring but may be different. The heterocyclic group may be either a monocyclic ring or condensed ring. When $Y_1$ represents a heterocyclic group, examples thereof include 2-pyridyl, 4-pyrimidinyl, 5-pyrazolyl, 8-quinolyl, 2-furyl, and 2-pyrrolyl.

When the group represented by $A_1$ and the group represented by $Y_1$ each have a substituent, examples of the substituent include a halogen atom (for example, a fluorine atom and a chlorine atom), an alkoxycarbonyl group (the carbon number of about 2 to 30, preferably about 2 to 20, for example, methoxycarbonyl, dodecyloxycarbonyl and hexadecyloxycarbonyl), an acylamino group (the carbon number of about 2 to 30, preferably about 2 to 20, for example, acetoamide, tetradecaneamide, 2-(2,4-di-t-amylphenoxy)butaneamide, and benzamide), a sulfonamide group (the carbon number of about 1 to 30, preferably about 1 to 20, for example, methanesulfonamide, dodecanesulfonamide, hexadecanesulfonamide, and benzenesulfonamide), a carbamoyl group (the carbon number of about 2 to 30, preferably about 2 to 20, for example, N-butylcarbamoyl and N,N-diethylcarbamoyl), a sulfamoyl group (the carbon number of about 1 to 30, preferably about 1 to 20, for example, N-butylsulfamoyl, N,N-diethylsufamoyl, N-dodecylsulfamoyl, N-hexadecylsulfamoyl, and N-3-(2,4-di-t-amylphenoxy) butylsulfamoyl), an alkoxy group (the carbon number of about 1 to 30, preferably about 1 to 20, for example, methoxy and dodecyloxy), an N-acylsulfamoyl group (the carbon number of about 2 to 30, preferably about 2 to 20, for example, N-propanoylsulfamoyl and N-tetradecanoylsulfamoyl), a sulfonyl group (the carbon number of about 1 to 30, preferably about 1 to 20, for example, methanesulfonyl, octanesulfonyl, and dodecanesulfonyl), an alkoxycarbonylamino group (the carbon number of about 1 to 30, preferably about 1 to 20, for example, methoxycarbonylamino and tetradecyloxycarbonylamino), a cyano group, a nitro group, a carboxyl group, an aryloxy group (the carbon number of about 6 to 20, preferably about 6 to 10, for example, phenoxy and 4-chlorophenoxy), an alkylthio group (the carbon number of about 1 to 30, preferably about 1 to 20, for example, methylthio and dodecylthio), a ureido group (the carbon number of about 1 to 30, preferably about 1 to 20, for example, phenylureido), an aryl group (synonymous with those defined for the aromatic group represented by $Y_1$), a heterocyclic group (synonymous with those defined for the hetrocyclic group represented by $Y_1$), a sulfo group, an alkyl group (a linear, branched or cyclic, saturated or unsaturated and substituted or unsubstituted alkyl group having the carbon number of about 1 to 30, preferably about 1 to 20, for example, methyl, ethyl, isopropyl, cyclopropyl, trifluoromethyl, cyclopentyl, dodecyl, and 2-hexyloctyl), an acyl group (the carbon number of about 1 to 30, preferably about 2 to 20, for example, acetyl and benzoyl), an arylthio group (the carbon number of about 6 to 20, preferably about 6 to 10, for example, phenylthio), a sulfamoylamino group (the carbon number of about 0 to 30, preferably about 0 to 20, for example, N-butylsulfamoylamino and N-dodecylsulfamoylamino), an N-acylcarbamoyl group (the carbon number of about 2 to 30, preferably about 2 to 20, for example, N-dodecanoylcarbamoyl), an N-sulfonylcarbamoyl group (the carbon number of about 1 to 30, preferably about 2 to 20, for example, N-hexadecanesulfonylcarbamoyl, N-benzenesulfonylcarbamoyl, and N-(2-octyloxy-5-t-octylbenzenesulfonyl)carbamoyl), an N-sulfamoylcarbamoyl group (the carbon number of about 1 to 30, preferably about 1 to 20, for example, N-(ethylsulfamoyl) carbamoyl, and N-[3-(2,4-di-t-amylphenoxy)propylsulfamoyl]carbamoyl), an N-sulfonylsulfamoyl group (the carbon number of about 0 to 30, preferably about 1 to 20, for example, N-dodecanesulfonylsulfamoyl and N-benzene-sulfonylsulfamoyl), an N-carbamoylsulfamoyl group (the carbon number of about 1 to 30, preferably about 1 to 20, for example, N-(ethylcarbamoyl)sulfamoyl, and N-[3-(2,4-di-tamylphenoxy)propylcarbamoyl] sulfamoyl), an N-(N-sulfonylcarbamoyl)sulfamoyl group (the carbon number of about 1 to 30, preferably about 1 to 20, for example, N-(dodecanesulfoylcarbamoyl)sulfamoyl, and N-(2-octyloxy-5-t-octylbenezenesulfonylcarbamoyl)sulfamoyl), a 3-sulfonylureido group (the carbon number of about 1 to 30, preferably about 1 to 20, for example, 3-hexadecanesulfonylureido, and 3-benzenesulfonylureido), a 3-acylureido group (the carbon number of 2 to 30, preferably 2 to 20, for example, 3-acetylureido, and 3-benzoylureido), a 3-acylsulfamide group (the carbon number of about 1 to 30, preferably about 1 to 20, for example, 3-propionylsulfamide, and 3-(2,4-dichlorobenzoyl)sulfamide), a 3-sulfonyl-sulfamide group (the carbon number of about 0 to 30, preferably about 1 to 20, for example, 3-methanesulfonyl-sulfamide, and 3-(2-methoxyethoxy-5-t-octylbenzene-sulfonyl)sulfamide), a hydroxyl group, an acyloxy group (the carbon number of about 1 to 30, preferably about 1 to 20, for example, propanoyloxy, and tetradecanoyloxy), a sulfonyloxy group (the carbon number of about 0 to 30, preferably about 0 to 20, for example, dodecanesulfonyloxy, and 2-octyloxy-5-t-octylbenzenesulfonyloxy), and an aryloxycarbonyl group (the carbon number of about 7 to 20, preferably about 7 to 10, for example, phenoxycarbonyl).

When the group represented by $A_1$ has a substituent, preferred examples of the substituent include a halogen atom, an alkoxy group, an acylamino group, a carbamoyl group, an alkyl group, a sulfonamide group, and a nitro group. The unsubstituted group is a preferred example as well.

When the group represented by $Y_1$ has a substituent, preferred examples of the substituent include a halogen atom, an alkoxycarbonyl group, a sulfamoyl group, a carbamoyl group, a sulfonyl group, a sulfonamide group, an acylamino group, an alkoxy group, an aryloxy group, an N-acylcarbamoyl group, an N-sulfonylcarbamoyl group, an N-sulfamoylcarbamoyl group, an N-sulfonylsulfamoyl group, an N-acylsulfamoyl group, an N-carbamoylsulfamoyl group, and an N-(N-sulfonylcarbamoyl)sulfamoyl group.

The group represented by $Z_1$ in formula (I) may be any known coupling splitting groups. Preferred examples of $Z_1$ include, a nitrogen-containing heterocyclic group bonded to a coupling site via a nitrogen atom, an aromatic oxy group, an aromatic thio group, a heterocyclic oxy group, a heterocyclic thio group, an acyloxy group, a carbamoyloxy group, an alkylthio group, and a halogen atom. These splitting groups may be any photographically useful group or precursor thereof (for example, a development inhibitor such as a heterocyclic thio group, a development accelerator, a desilvering accelerator, a fogging agent, a dye, a hardener, a coupler, a developing agent oxidation product scavenger, a fluorescent dye, a developing agent, or an electron transfer agent), and a non-photographically useful group (for example, those described for the preferred examples of $Z_1$ and typically a halogen atom).

When $Z_1$ represents a nitrogen-containing heterocyclic group, it is a monocyclic or condensed, substituted or unsubstituted heterocyclic group. Examples thereof include succinimide, maleinimide, phthalimide, diglycolimide, pyrrolino, pyrazolyl, imidazolyl, 1,2,4-triazole-1-yl (or 4-yl), 1-tetrazolyl, indolyl, benzopyrazolyl, benzimidazolyl, benzotriazolyl, imidazolidine-2,4-dione-3-yl (or 1-yl), oxazolidine-2,4-dione-3-yl, thiazolidine-2,4-dione-3-yl, imidazoline-2-one-1-yl, oxazoline-2-one-3-yl, thiazoline-2-one-3-yl, benzo-oxazoline-2-one-3-yl, 1,2,4-triazolidine-3,5-dione- 4-yl, 2-pyridone-1-yl, morpholine-3,5-dione-4-yl, 1,2,3-triazole-1-yl, and 2-imidazoline-5-one.

When these heterocyclic groups have substituents, the substituents include those enumerated as the substituents for the above group represented by $A_1$.

When $Z_1$ represents a nitrogen-containing heterocyclic group, it is preferably 1-pyrazolyl, imidazolyl, 1,2,3-triazole-1-yl, benzotriazolyl, 1,2,4-triazole-1-yl, oxazolidine-2,4-dione-3-yl, 1,2,4-triazolidine-3,5-dione-4-yl, or imidazolidine-2,4-dione-3-yl. These groups may have substituents as well.

When $Z_1$ represents an aromatic oxy group, it is preferably a substituted or unsubstituted phenoxy group. When it has a substituent, the substituents include those enumerated as the substituents for the above group represented by $Y_1$. The preferred substituent for the phenoxy group is where at least one substituent is an electron attractive substituent. Examples thereof include a sulfonyl group, an alkoxycarbonyl group, a sulfamoyl group, a halogen atom, a carboxyl group, a carbamoyl group, an acyl group, or a nitro group.

When $Z_1$ represents an aromatic thio group, it is preferably a substituted or unsubstituted phenylthio group. When it has a substituent, the substituents include those enumerated as the substituents for the above group represented by $Y_1$. The preferred substituent for the phenylthio group is where at least one of the substituents is an alkyl group, an alkoxy group, a sulfonyl group, an alkoxycarbonyl group, a sulfamoyl group, a halogen atom, a carbamoyl group, or a nitro group.

When $Z_1$ represents a heterocyclic oxy group, the heterocyclic group is synonymous with that defined for the above heterocyclic group represented by $Y_1$.

When $Z_1$ represents a heterocyclic thio group, a 5- to 6-membered unsaturated heterocyclic thio group is preferred. Examples thereof include tetrazolylthio, 1,3,4-thiadiazolylthio, 1,3,4-oxadiazolylthio, 1,3,4-triazolylthio, benzimidazolylthio, benzothiazolylthio, or 2-pyridylthio. When they have substituents, the substituents thereof include those enumerated as the substituents for the above heterocyclic group represented by $Y_1$. Of them, the particularly preferred substituent is an aromatic group, an alkyl group, an alkylthio group, an acylamino group, an alkoxycarbonyl group, or an aryloxycarbonyl group.

When $Z_1$ represents an acyloxy group, it is an aromatic acyloxy group (the carbon number of about 7 to 11, preferably benzoyloxy), or an aliphatic acyloxy group (the carbon number of about 2 to 20, preferably about 2 to 10). It may further have a substituent. Substituents include those enumerated as the substituents for the above aromatic group represented by $Y_1$. The preferred substituent is where at least one substituent is a halogen atom, a nitro group, an aryl group, an alkyl group, or an alkoxy group.

When $Z_1$ represents a carbamoyloxy group, it is an aliphatic, aromatic, heterocyclic, or unsubstituted carbamoyloxy group having-the carbon number of about 1 to 30, preferably about 1 to 20. Examples thereof include N,N-diethylcarbamoyloxy, N-phenylcarbamoyl-morpholinocarbonyloxy, 1-imidazolyl-carbonyloxy, and N,N-dimethylcarbamoyloxy. In the above case, concrete examples of the alkyl group, aromatic group and heterocyclic group are synonymous with those defined for $Y_1$ above.

When $Z_1$ represents an alkylthio group, it is an alkylthio group having the carbon number of about 1 to 30, preferably about 1 to 20. The concrete examples of the alkyl group are synonymous with those defined for $Y_1$ above.

Preferred groups represented by $Z_1$ in formula (I) include, a 5- to 6-membered nitrogen-containing heterocyclic group (bonded to a coupling site via a nitrogen atom), an aromatic oxy group, a 5- to 6-membered heterocyclic oxy group, or a 5- to 6-membered heterocyclic thio group.

The preferred group represented by $Y_1$ in formula (I) is an aromatic group. Particularly preferred is a phenyl group having at least one substituent at an ortho position. The substituents include those enumerated as the substituents for the above aromatic group represented by $Y_1$.

When the group represented by $Y_1$ in formula (I) is a phenyl group having at least one substituent at an ortho position, particularly preferred as the substituent present at the ortho position is a halogen atom, an alkoxy group, an alkyl group, or an aryloxy group.

Of the yellow couplers represented by formula (I), the particularly preferred yellow coupler is represented by the following formula (I-A):

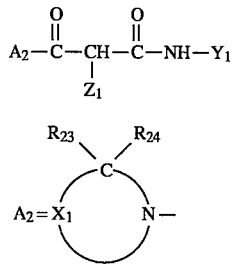

(I-A)

wherein (I-A), $Y_1$ and $Z_1$ are synonymous with those explained in formula (I); and $X_1$ represents an organic group necessary to form a nitrogen-containing heterocycle together with $>C(R_{23}R_{24})$ and >N—, in which $R_{23}$ and $R_{24}$ each represents a hydrogen atom or a substituent.

In formula (I-A), the preferred ranges and concrete examples of $Y_1$ and $Z_1$ are synonymous with those explained in formula (I).

Those described in the explanation of $A_1$ in formula (I) can be enumerated as concrete examples of the heterocyclic group represented by $A_2$ in formula (I-A) and substituent therefor. Further, the preferred range thereof is the same as that described for $A_1$. Particularly preferred is the case in which the nitrogen-containing heterocyclic group is a benzene condensed ring.

Of the couplers represented by formula (I-A), a more preferred coupler is represented by the following formula (I-B):

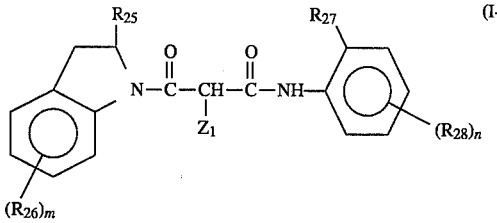

wherein $R_{25}$ represents a hydrogen atom or a substituent; $R_{26}$, $R_{27}$ and $R_{28}$ each represents a substituent; $Z_1$ is synonymous with that explained in formula (I); m and n each are the integers of 0 to 4; and when m and n each represents the integers of two or more, plural $R_{26}$'s and $R_{28}$'s each may be the same or different and may be combined with each other to form a ring.

When $R_{25}$ and $R_{26}$ represents the substituents in formula (I-B), the examples of the substituents are the same as the examples of the substituents enumerated when the group represented by $A_1$ in formula (I) has a substituent. Preferred examples of $R_{25}$ are a hydrogen atom, an alkyl group, and an aryl group, and preferred examples of $R_{26}$ are a halogen atom, an alkoxy group, an acylamino group, a carbamoyl group, an alkyl group, a sulfonamide group, a cyano group, and a nitro group. m is preferably the integer of 0 to 2, particularly preferably 0 or 1.

The same substituents as those enumerated when the group represented by $Y_1$ in formula (I) has a substituent can be enumerated as examples of the substituents represented by $R_{27}$ and $R_{28}$ in formula (I-B). $R_{27}$ is preferably a halogen atom, an alkoxy group, an alkyl group, or an aryloxy group. Preferred examples of $R_{28}$ are the same ones as those enumerated as the preferred examples of the substituent when the group represented by $Y_1$ in formula (I) has a substituent. n is preferably an integer of 0 to 2, more preferably 1 or 2.

The couplers represented by formulas (I), (I-A) and (I-B) may be combined with each other at $X_1$, $Y_1$ and $Z_1$ via a divalent or more group to form a dimer or a higher polymer. In this case, the carbon number may fall out of the range shown for the above respective substituents.

Concrete examples of the coupler represented by formula (I) are shown below but are not limited thereto.

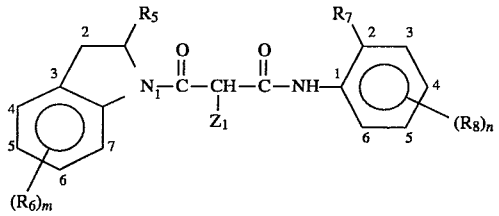

| No. | $R_5$ | m | $R_6$ | $R_7$ | n | $R_8$ | $Z_1$ |
|---|---|---|---|---|---|---|---|
| 1 | H | 0 | — | $-OCH_3$ | 1 | $-5-SO_2NHCO\underset{\vert}{C}HC_9H_{19}$ (with $C_7H_{15}$) | 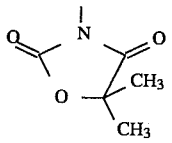 |
| 2 | " | " | — | $-OC_{18}H_{37}(n)$ | 1 | $-5-SO_2NHCO\underset{\vert}{C}HC_4H_9$ (with $C_2H_5$) | " |
| 3 | " | " | — | $-OC_{12}H_{25}(n)$ | 1 | $-5-SO_2NHCON(C_3H_7)_2$ | " |
| 4 | " | " | — | $-O-CH_2\underset{\vert}{C}H-C_8H_{17}(n)$ (with $C_6H_{13}(n)$) | 1 | $-5-SO_2NHCO\underset{\vert}{C}HC_4H_9$ (with $C_2H_5$) | " |
| 5 | H | 0 | — | $-O-\underset{\vert}{C}HCOOC_{12}H_{25}(n)$ (with $CH_3$) | 1 | $-5-SO_2NHCOC_2H_5$ | 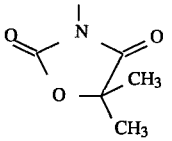 |
| 6 | " | " | — | $-OCH_2\underset{\vert}{C}H$ (with $CH(CH_3)CH_2C(CH_3)_3$ and $(CH_2)_2CH(CH_3)CH_2C(CH_3)_3$) | 1 | $-5-SO_2NHCOC_2H_5$ | " |
| 7 | " | " | — | $-OCH_2COOCH_2\underset{\vert}{C}HC_8H_{17}$ (with $C_{10}H_{21}$) | 1 | $-5-SO_2NHCOCH_3$ | " |
| 8 | " | " | — | 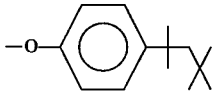 | 1 | $-5-SO_2NHCO\underset{\vert}{C}HC_4H_9$ (with $C_2H_5$) | " |

-continued
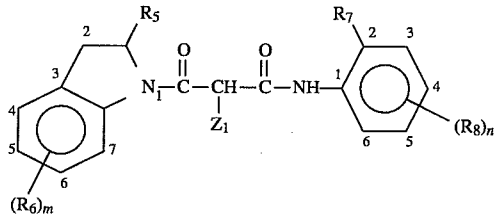
| No. | $R_5$ | m | $R_6$ | $R_7$ | n | $R_8$ | $Z_1$ |
|---|---|---|---|---|---|---|---|
| 9 | " | " | — | 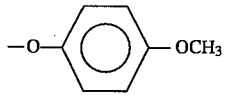 | 1 | 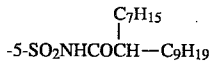 | " |
| 10 | H | 0 | — | 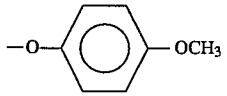 | 1 | $-5-CONHSO_2C_{12}H_{25}$ | 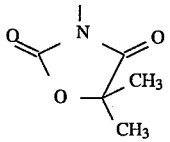 |
| 11 | " | " | — | 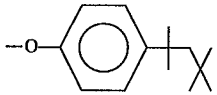 | 1 | $-4-SO_2NHCOC_9H_{19}$ | " |
| 12 | " | " | — | " | 2 | $-4-Cl-5-CONHSO_2C_{16}H_{33}(n)$ | " |
| 13 | " | " | — | " | 2 | $-3-Cl-5-CONHCOC_{11}H_{23}$ | " |
| 14 | " | " | — | $-OCH_3$ | 2 | $-3-Cl-5-CONHSO_2C_{12}H_{25}(n)$ | " |
| 15 | H | 0 | — | $-OC_{16}H_{33}(n)$ | 1 | 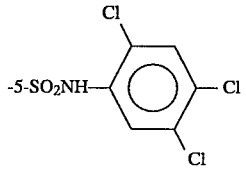 | 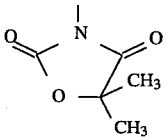 |

-continued
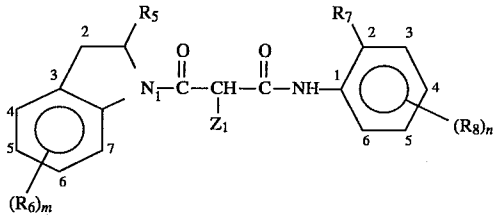
| No. | $R_5$ | m | $R_6$ | $R_7$ | n | $R_8$ | $Z_1$ |
|---|---|---|---|---|---|---|---|
| 16 | " | " | — | $-OCH_2CH(C_6H_{33})C_8H_{17}$ | 1 | 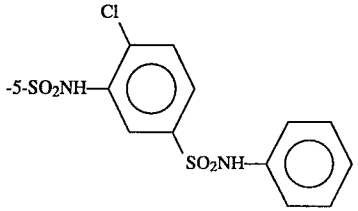 | " |
| 17 | " | " | — | $-OCH(CH_3)_2$ | 1 | 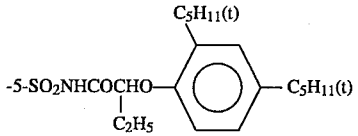 | " |
| 18 | " | " | — | $-OC_{18}H_{37}(n)$ | 1 | 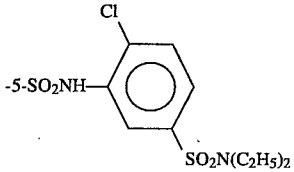 | " |
| 19 | H | 0 | — | 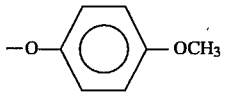 | 1 | 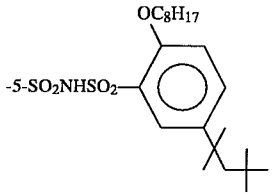 | 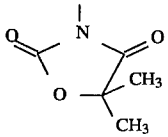 |

-continued
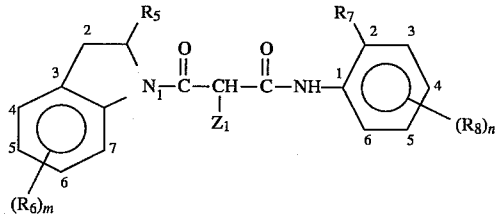
| No. | $R_5$ | m | $R_6$ | $R_7$ | n | $R_8$ | $Z_1$ |
|---|---|---|---|---|---|---|---|
| 20 | " | " | — | $-OC_2H_5$ | 1 | " | 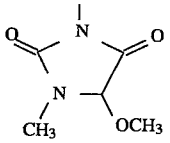 |
| 21 | " | " | — | $-OC_{18}H_{37}$(n) | 2 | -4-Cl-5-$CONHSO_2C_{12}H_{25}$ | 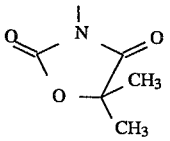 |
| 22 | " | " | — | " | 1 | 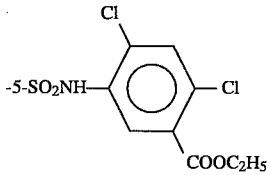 | " |
| 23 | H | 0 | — | 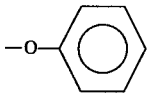 | 1 | 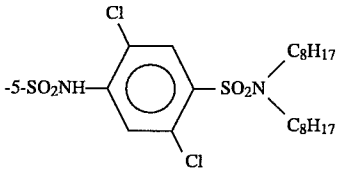 | 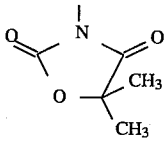 |

-continued
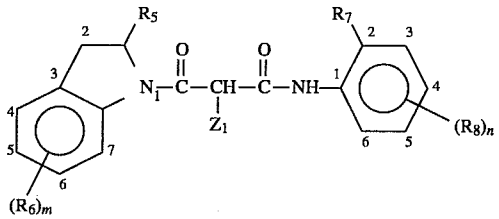
| No. | $R_5$ | m | $R_6$ | $R_7$ | n | $R_8$ | $Z_1$ |
|---|---|---|---|---|---|---|---|
| 24 | " | " | — | $-OCH(CH_3)_2$ | 1 | 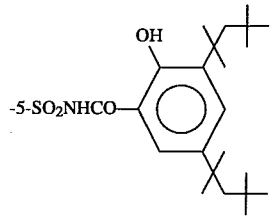 | " |
| 25 | $CH_3$ | " | — | $-OC_2H_5$ | 1 | $-5-SO_2NHCO\overset{C_7H_{15}}{\overset{\vert}{C}}HC_9H_{19}$ | " |
| 26 | H | " | — | $-OC_{18}H_{37}(n)$ | 1 | 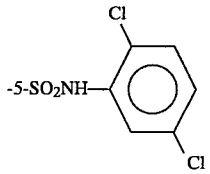 | 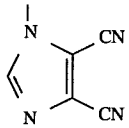 |
| 27 | H | 0 | — | 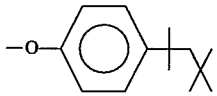 | 1 | 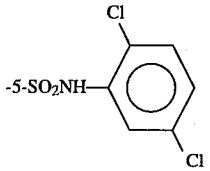 | 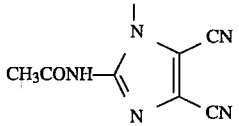 |
| 28 | " | 0 | — | $-OC_{16}H_{33}(n)$ | 1 | $-5-SO_2NHCOC_2H_5$ | 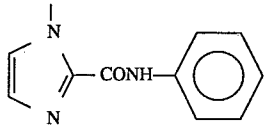 |

-continued
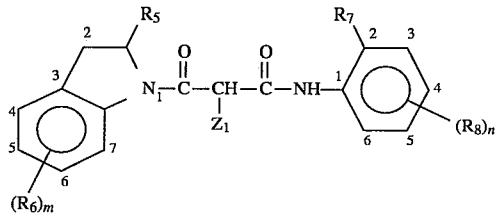
| No. | $R_5$ | m | $R_6$ | $R_7$ | n | $R_8$ | $Z_1$ |
|---|---|---|---|---|---|---|---|
| 29 | " | 0 | — | —Cl | 1 | -5-CONHSO$_2$—C$_{16}$H$_{33}$(n) | 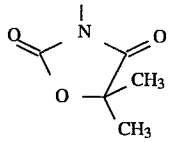 |
| 30 | " | 0 | — | " | 1 | -5-NHCO(CH$_3$)CH$_2$SO$_2$C$_{12}$H$_{25}$ | 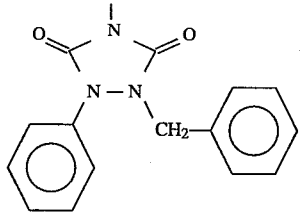 |
| 31 | H | 0 | — | —Cl | 1 | 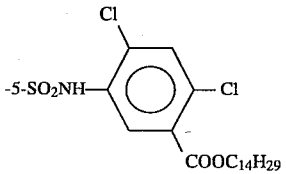 | 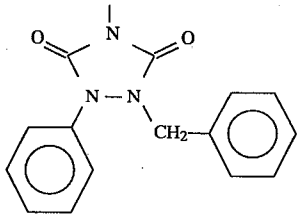 |
| 32 | " | 0 | — | " | 2 | -4-Cl-5-COOC$_{12}$H$_{25}$ | 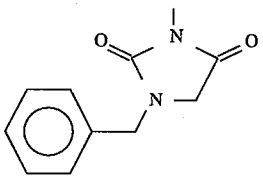 |

-continued
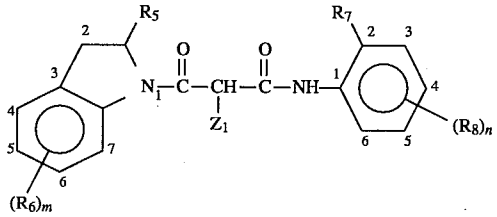
| No. | $R_5$ | m | $R_6$ | $R_7$ | n | $R_8$ | $Z_1$ |
|---|---|---|---|---|---|---|---|
| 33 | " | 0 | — | " | 2 | 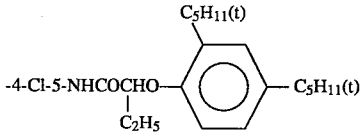 | 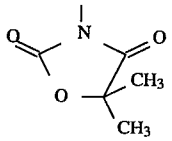 |
| 34 | " | 0 | — | " | 1 | $-5-SO_2NHC_{12}H_{25}$ | " |
| 35 | " | 0 | — | " | 1 | $-5-SO_2NHSO_2C_{16}H_{33}(n)$ | 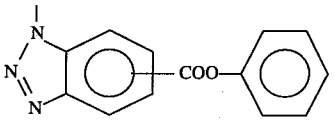 |
| 36 | H | 1 | 5-$NO_2$ | —Cl | 1 | 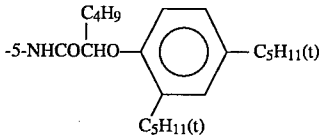 | 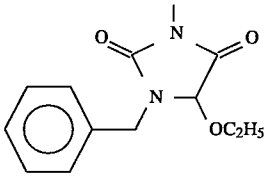 |
| 37 | " | 2 | 5,7-Br | " | 1 | $-5-NHSO_2C_{16}H_{33}(n)$ | " |
| 38 | " | 0 | — | $-C_{18}H_{37}(n)$ | 1 | 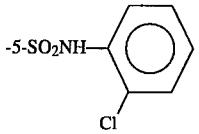 | 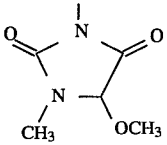 |

-continued
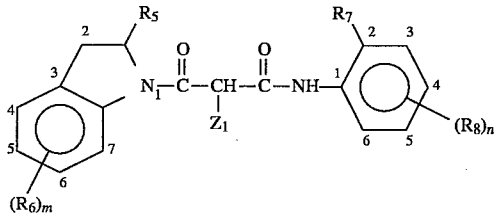
| No. | $R_5$ | m | $R_6$ | $R_7$ | n | $R_8$ | $Z_1$ |
|---|---|---|---|---|---|---|---|
| 39 | " | 0 | — | " | 1 | " | 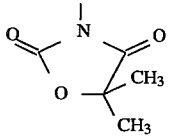 |
| 40 | " | 0 | — | $-OCH_2CH(C_8H_{17})-C_{10}H_{21}$ | 1 | 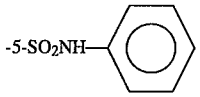 | " |
| 41 | H | 1 | 5-Cl | —Cl | 1 | $-5-NHSO_2C_{16}H_{33}$ | 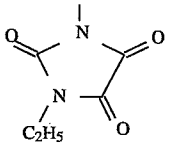 |
| 42 | 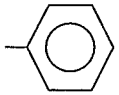 | 1 | 5-$NO_2$ | $-C_{14}H_{29}$ | 1 | 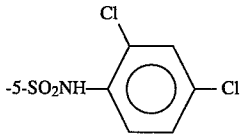 | 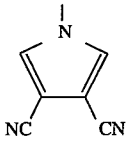 |
| 43 | H | 1 | 5-Br | —Cl | 1 | $-5-COOCH(CH_3)-COOC_{12}H_{25}$ | 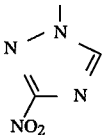 |

-continued
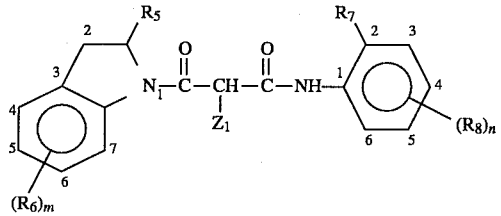
| No. | $R_5$ | m | $R_6$ | $R_7$ | n | $R_8$ | $Z_1$ |
|---|---|---|---|---|---|---|---|
| 44 | " | 1 | " | " | 1 | " | 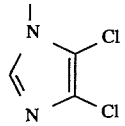 |
| 45 | " | 1 | 5-Cl | " | 1 | -5-$NHSO_2C_{12}H_{25}$ | 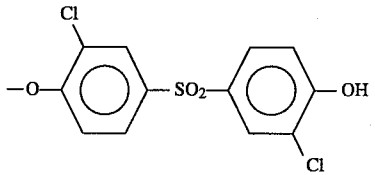 |
| 46 | H | 1 | 5-$NO_2$ | —Cl | 1 | -5-$NHSO_2C_{12}H_{25}$ | 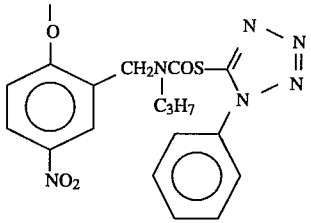 |
| 47 | " | 0 | — | " | 1 | 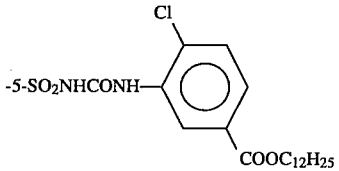 | 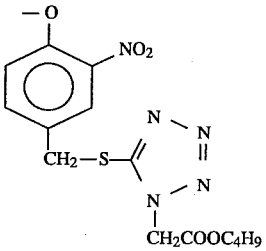 |

-continued
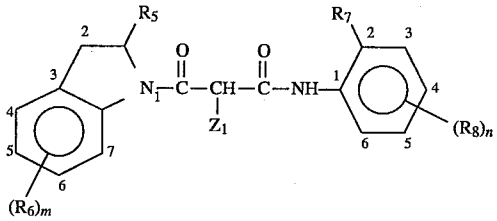
| No. | $R_5$ | m | $R_6$ | $R_7$ | n | $R_8$ | $Z_1$ |
|---|---|---|---|---|---|---|---|
| 48 | " | 1 | 5-$OCH_3$ | " | 2 | -4-Cl-5-$COOC_{12}H_{25}$ | 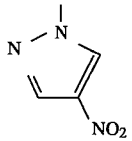 |
| 49 | " | 1 | 5-$NO_2$ | $-CF_3$ | 1 | 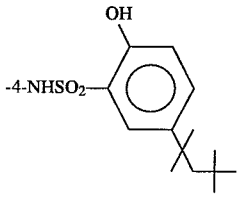 | 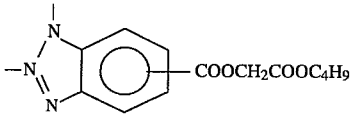 |
| 50 | H | 0 | — | $-OC_2H_5$ | 1 | -5-$SO_2C_{12}H_{25}$ | 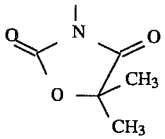 |
| 51 | " | 0 | — | $-Cl$ | 1 | 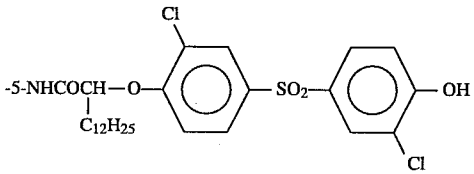 | " |

-continued
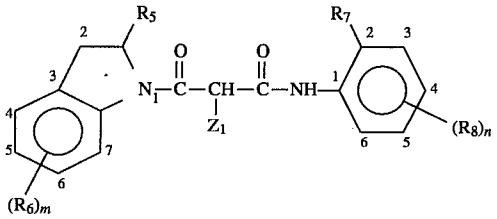
| No. | $R_5$ | m | $R_6$ | $R_7$ | n | $R_8$ | $Z_1$ |
|---|---|---|---|---|---|---|---|
| 52 | $C_2H_5$ | 0 | — | " | 1 | 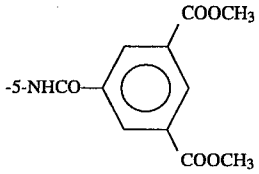 | 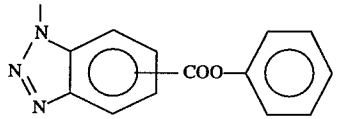 |
| 53 | H | 0 | — | " | 1 | 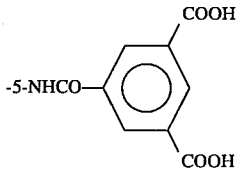 | 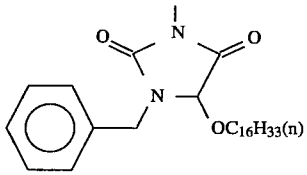 |
| 54 | H | 0 | — | —Cl | 1 | $-5-SO_2NHCOC_{11}H_{23}$ | 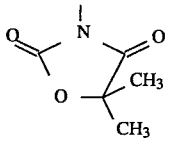 |
| 55 | H | 0 | — | 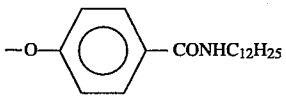 | 1 | 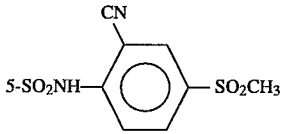 | 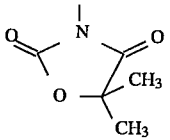 |

-continued
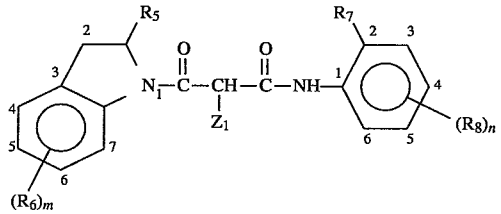
| No. | $R_5$ | m | $R_6$ | $R_7$ | n | $R_8$ | $Z_1$ |
|---|---|---|---|---|---|---|---|
| 56 | H | 1 | Br | 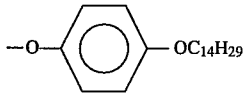 | 1 | 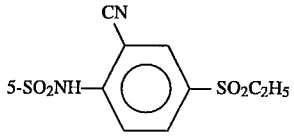 | " |
| 57 | H | 0 | — | 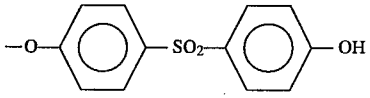 | 1 | 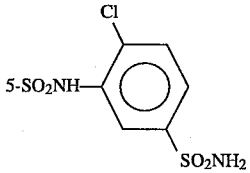 | " |
| 58 | H | 0 | — | 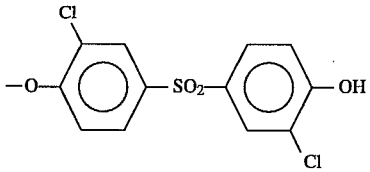 | 1 | $5\text{-}SO_2NHC_{14}H_{29}$ | 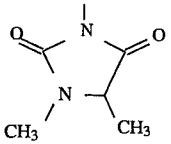 |
| 59 | " | 0 | — | 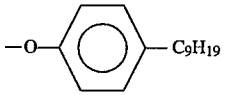 | 1 | $5\text{-}SO_2NHCONHC_{12}H_{25}$ | 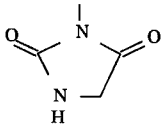 |
| 60 | " | 0 | — | 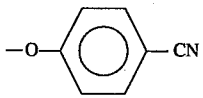 | 1 | $5\text{-}NHSO_2C_{16}H_{33}(n)$ | 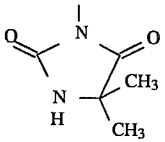 |

-continued
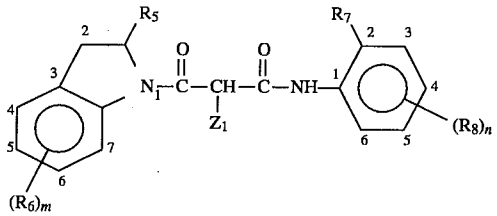
| No. | $R_5$ | m | $R_6$ | $R_7$ | n | $R_8$ | $Z_1$ |
|---|---|---|---|---|---|---|---|
| 61 | " | 0 | — | 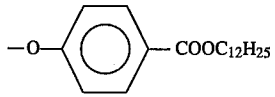 | 1 | 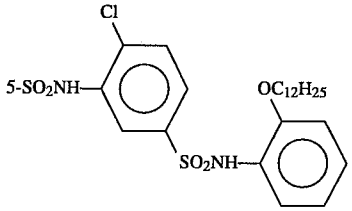 | 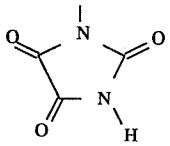 |
| 62 | H | 0 | — | 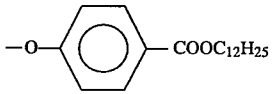 | 1 | 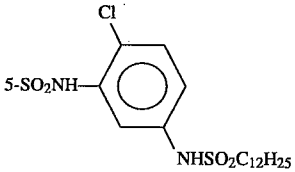 | 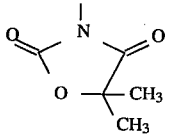 |
| 63 | " | 1 | 5-$NO_2$ | " | 1 | " | 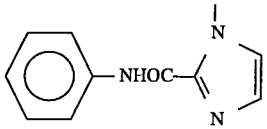 |
| 64 | " | 1 | 5-$NHSO_2CH_3$ | 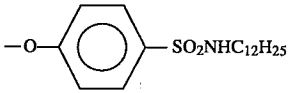 | 1 | 5-$SO_2NH_2$ | 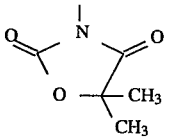 |

-continued
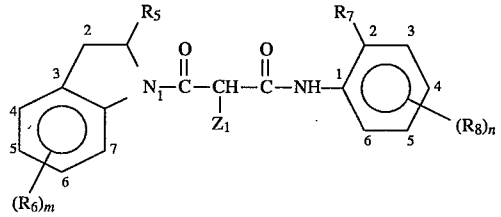
| No. | $R_5$ | m | $R_6$ | $R_7$ | n | $R_8$ | $Z_1$ |
|---|---|---|---|---|---|---|---|
| 65 | " | 0 | — | 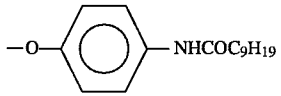 | 2 | 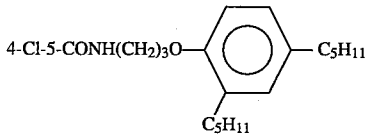 | " |
| 66 | $-CH_3$ | 1 | 5-Br | 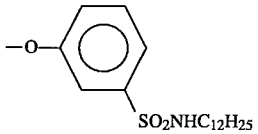 | 1 | 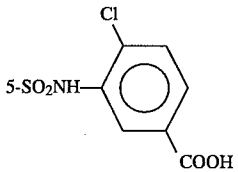 | 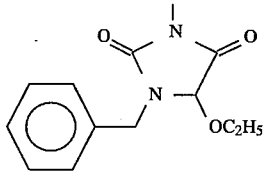 |
| 67 | H | 0 | — | 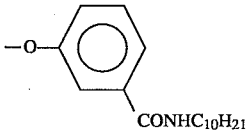 | 1 | 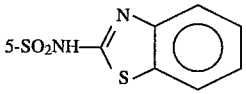 | 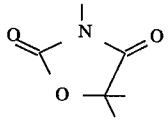 |
| 68 | " | 1 | 5-Br | $-OC_{12}H_{25}$ | 1 | 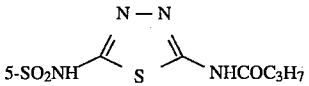 | " |
| 69 | " | 0 | — | 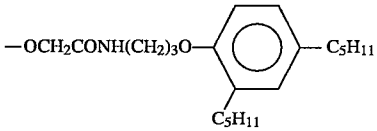 | 1 | 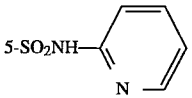 | " |

-continued
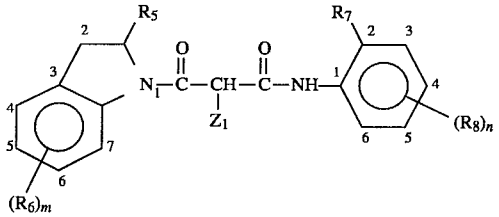
| No. | $R_5$ | m | $R_6$ | $R_7$ | n | $R_8$ | $Z_1$ |
|---|---|---|---|---|---|---|---|
| 70 | " | 0 | — | 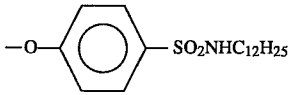 | 1 | 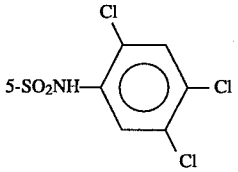 | 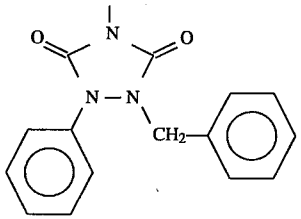 |

| No. | 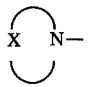 | 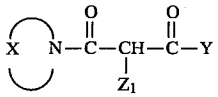 $Y_1$ | $Z_1$ |
|---|---|---|---|
| 71 | 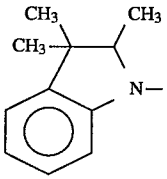 | 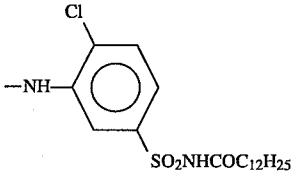 | 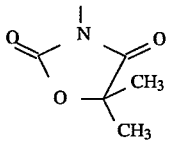 |
| 72 | 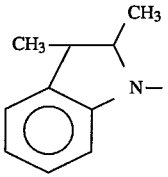 | 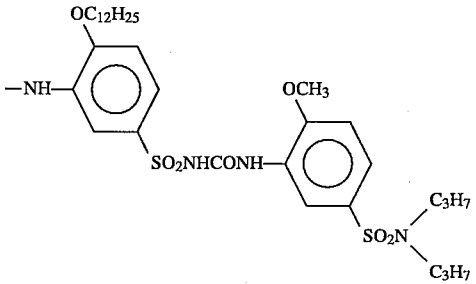 | " |
| 73 | 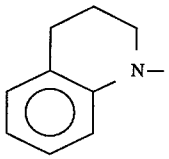 | 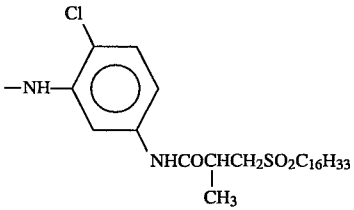 | 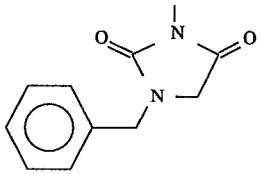 |

-continued
| No. | 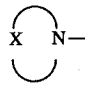 | 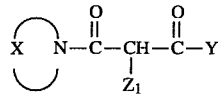 $Y_1$ | $Z_1$ |
|---|---|---|---|
| 74 | 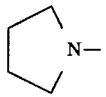 | 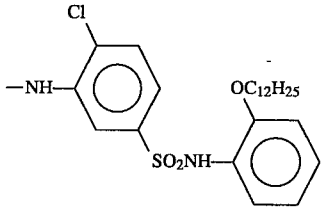 | 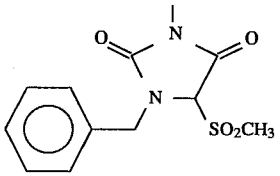 |
| 75 | 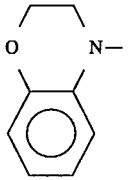 | 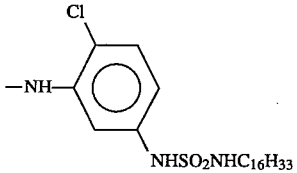 | 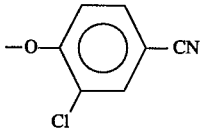 |
| 76 | 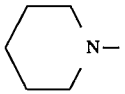 | 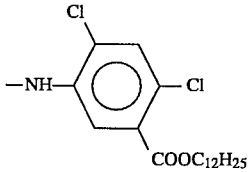 | 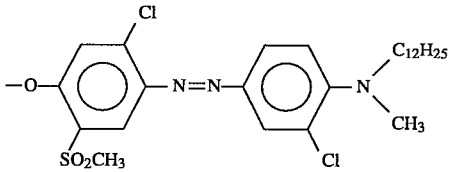 |
| 77 | 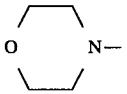 | 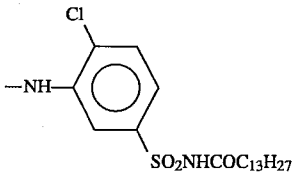 | 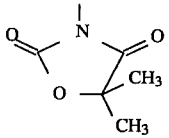 |

-continued
| No. | 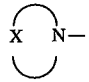 | 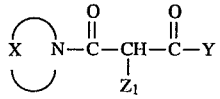 $Y_1$ | $Z_1$ |
|---|---|---|---|
| 78 | 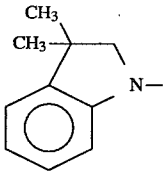 | 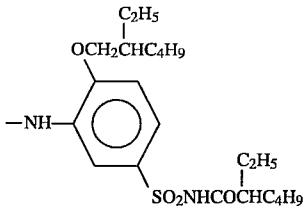 | $SCH_2COOH$ |
| 79 | 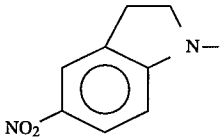 | " | 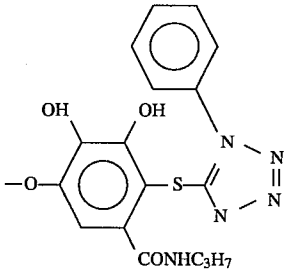 |
| 80 | 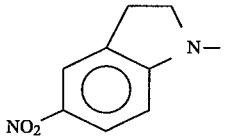 | 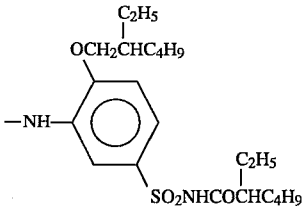 | 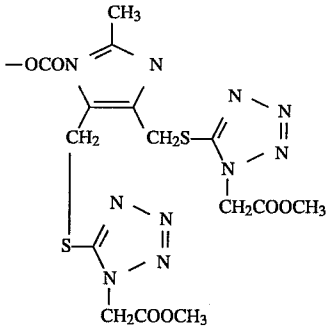 |

-continued
| No. | 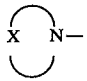 | 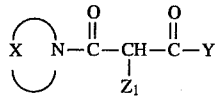 $Y_1$ | $Z_1$ |
|---|---|---|---|
| (81) | | 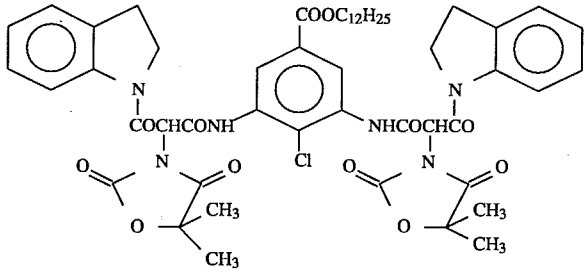 | |
| (82) | | 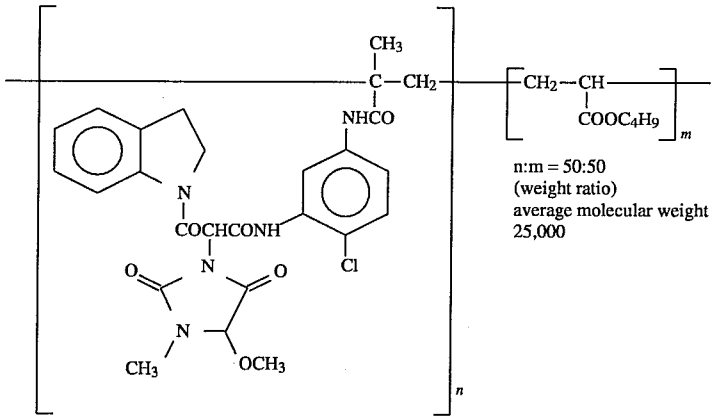 n:m = 50:50 (weight ratio) average molecular weight 25,000 | |

The compounds of the present invention can be synthesized by the publicly known methods such as the method described in European Patent $482552A_1$ or methods similar thereto.

Next, the yellow coupler represented by formula (II) will be described in detail.

In formula (II), $Z_2$ represents a hydrogen atom or a group capable of splitting off upon a coupling reaction with the oxidation product of an aromatic primary amine developing agent. $Y_2$ is synonymous with the group defined for $Y_1$ in formula (I).

Of the yellow couplers represented by formula (II), the preferred coupler is represented by the following formula (II-A):

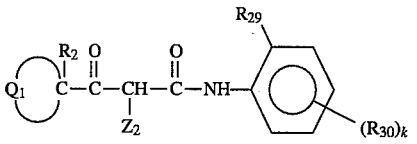

(II-A)

wherein $R_2$ represents a monovalent substituent excluding a hydrogen atom; $Q_1$ represents a group of non-metal atoms neccesary to form a 3- to 5-membered hydrocarbon ring or a 3- to 6-membered heterocyclic group containing at least one hetero atom selected from N, S, O and P in the ring together with carbon; $R_{29}$ represents a hydrogen atom, a halogen atom (a fluorine atom, a chlorine atom, a bromine atom, and an iodine atom; hereinafter, the same will be applied to the explanation in formula (II-A)), an alkoxy group, an aryloxy group, an alkylthio group, an arylthio group, an alkyl group, or an amino group; $R_{30}$ represents a group substitutable on a benzene ring; $Z_2$ represents a hydrogen atom or a group capable of splitting off upon a coupling reaction with the oxidation product of an aromatic primary amine developing agent (hereinafter referred to as a splitting group); k represents the integer of 0 to 4, provided that when k is plural, a plurality of $R_{30}$'s may be the same or different; and $R_2$ may be combined with $Q_1$ to form a polycyclic ring higher than a bicyclic ring.

Examples of $R_{10}$ include a halogen atom, an alkyl group, an aryl group, an alkoxy group, an aryloxy group, an alkoxycarbonyl group, an aryloxycarbonyl group, a carbonamide group, a sulfonamide group, a carbamoyl group, a sulfamoyl group, an alkylsulfonyl group, a ureido group, a sulfamoylamino group, an alkoxycarbonylamino group, an aryloxysulfonyl group, an acyloxy group, a nitro group, a heterocyclic group, a cyano group, an acyl group, an acyloxy group, an alkyl-sulfonyloxy group, and an arylsulfonyloxy group. Examples of the splitting off group represented by $Z_2$ includes a heterocyclic group bonded to a coupling active site via a nitrogen atom, an aryloxy group, an arylthio group, an acyloxy group, an alkylsulfonyloxy group, an arylsulfonyloxy group, a hetrocyclic oxy group, a heterocyclic thio group, and a halogen atom.

The substituent preferably used in formula (II-A) will be explained below.

In formula (II-A), $R_2$ is preferably a halogen atom, a cyano group, or a monovalent group having the carbon number of about 1 to 30 (for example, an alkyl group, an alkoxy group, and an alkylthio group), or a mono-valent group having the carbon number of about 6 to 30 (for example, an aryl group, an aryloxy group, and an arylthio group), and each may be substituted. The substituent therefor includes, for example, a halogen atom, an alkyl group, an alkoxy group, a nitro group, an amino group, a carbonamide group, a sulfonamide, and an acyl group.

In formula (II-A), $Q_1$ preferably represents a group of non-metal atoms neccesary to form a 3- to 5-membered hydrocarbon ring having the carbon number of about 3 to 30, or a 3- to 6-membered heterocyclic group containing at least one hetero atom selected from N, S, O and P in the ring together with carbon, and each may be substituted. The ring formed by Q together with carbon may contain an unsaturated bond in the ring. Examples of the ring formed by Q together with carbon include a cyclopropane ring, a cyclobutane ring, a cyclopentane ring, a cyclopropene ring, a cyclobutene ring, a cyclopentene ring, an oxetane ring, an oxolane ring, a 1,3-dioxolane ring, a thietane ring, a thiolane ring, a pyrrolidine ring, a tetrahydropyran ring, a 1,3-dioxane ring, a 1,4-dioxane ring, a tetrahydrothiopyran ring, an oxathiane ring, and a morpholine ring. Examples of the substituent include a halogen atom, a hydroxyl group, an alkyl group, an aryl group, an acyl group, an alkoxy group, an aryloxy group, a cyano group, an alkoxycarbonyl group, an alkylthio group, and an arylthio group.

$Q_1$ may be combined with $R_2$ to form a polycyclo-alkyl group higher than a bicycloalkyl group together with carbon to which Q is bonded. Examples of such a group includes bicyclo(2,1,0)pentane-1-yl, bicyclo-(2.2.0)hexane-1-yl, bicyclo(3.1.0)hexane-1-yl, bicyclo-(3.2.0)heptane-1-yl, bicyclo(3.3.0)octane-1-yl, bicyclo-(4.1.0)heptane-1-yl, bicyclo(4.2.0)octane-1-yl, bicyclo-(4.3.0)nonane-1-yl, bicyclo(5.1.0)octane-1-yl, bicyclo-(5.2.0)nonane-1-yl, bicyclo(1.1.1)pentane-1-carbonyl, bicyclo(2.1.1)hexane-1-carbonyl, bicyclo-(2.2.1)heptane-1-carbonyl, bicyclo(2.2.2)octane-1-carbonyl, tricyclo-(3.1.1.$0^{3,6}$)heptane- 6-carbonyl, tricyclo(3.3.0.$0^{3,7}$)-octane-1-carbonyl, and tricyclo-(3.3.1.$0^{3,7}$)nonane-3-carbonyl. These groups may be substituted. The substituents enumerated in the explanation of above $Q_1$ are examples of the substituent therefor. The substituting position is preferably a position other than a β-position to a carbonyl group.

Of the acyl groups represented by B in formula (II), more preferred in the present invention are 1-alkylcyclopropane-1-carbonyl, bicyclo(2,1,0)-pentane-1-carbonyl, bicyclo(3,1,0)hexane-1-carbonyl, bicyclo( 4,1,0)heptane-1-carbonyl, bicyclo(2,2,0)hexane-1-carbonyl, bicyclo(1,1,1)pentane-1-carbonyl, bicyclo-(2,1,1)hexane-1-carbonyl, tricyclo(3,1,1,$0^{3,6}$)-heptane-6-carbonyl.

Among them, 1-alkylcyclopropane-1-carbonyl is most preferred. A substituted or unsubstituted alkyl group having the carbon number of about 2 to 18 is preferred as the alkyl group present at the 1-position in 1-alkylcyclopropane-1-carbonyl and more preferred is the substituted or unsubstituted alkyl group which is not branched at an α-position and has the carbon number of about 2 to 12. Particularly preferred are ethyl, propyl, butyl, benzyl, and phenethyl.

In formula (II-A), $R_{29}$ preferably represents a halogen atom, or an alkoxy group having the carbon number of about 1 to 30, an aryloxy group having the carbon number of about 6 to 30, an alkyl group having the carbon number of about 1 to 30, or an amino group having the carbon number of about 0 to 30, and each may be substituted. The substituent therefor includes, for example, a halogen atom, an alkyl group, an alkoxy group, and an aryloxy group.

In formula (II-A), $R_{30}$ preferably represents a halogen atom, or an alkyl group having the carbon number of about 1 to 30, an aryl group having the carbon number of about 6 to 30, an alkoxy group having the carbon number of about 1 to 30, an alkoxycarbonyl group having the carbon number of about 2 to 30, an aryloxycarbonyl group having the carbon number of about 7 to 30, a carbonamide group having the carbon number of about 1 to 30, a sulfonamide group having the carbon number of about 1 to 30, a carbamoyl group having the carbon number of about 1 to 30, a sulfamoyl group having the carbon number of about 0 to 30, an alkylsulfonyl group having the carbon number of about 1 to 30, an arylsulfonyl group having the carbon number of about 6 to 30, a ureido group having the carbon number of about 1 to 30, a sulfamoylamino group having the carbon number of about 0 to 30, an alkoxycarbonylamino group having the carbon number of about 2 to 30, a heterocyclic group having the carbon number of about 1 to 30, an acyl group having the carbon number of about 1 to 30, an alkylsulfonyloxy group having the carbon number of about 1 to 30, or an arylsulfonyloxy group having the carbon number of about 6 to 30, and each may be substituted. The substituent therefor includes, for example, a halogen atom, an alkyl group, an aryl group, a heterocyclic group, an alkoxy group, an aryloxy group, a heterocyclic oxy group, an alkylthio group, an arylthio group, a heterocyclic thio group, an alkylsulfonyl group, an arylsulfonyl group, an acyl group, a carbonamide group, a sulfonamide group, a carbamoyl group, a sulfamoyl group, an alkoxycarbonylamino group, a sulfamoylamino group, a ureido group, a cyano group, a nitro group, an acyloxy group, an alkoxycarbonyl group, an aryloxycarbonyl group, an alkylsulfonyloxy group, and an arylsulfonyloxy group.

In formula (II-A), k is preferably the integer of 1 or 2 and the substituting position of $R_{30}$ is preferably a meta position or para position to an acylacetoamide group.

In formula (II-A), $Z_2$ preferably represents a heterocyclic group bonded to a coupling active site via a nitrogen atom, or an aryloxy group.

When $Z_2$ represents a heterocyclic group, $Z_2$ is preferably the group selected from imidazolidine-2,4-dione-3-yl, oxazolidine-2,4-dione-3-yl, 1,2,4-triazolidine-3,5-dione-4-yl, succinimide, 1-pyrazolyl, and 1-imidazolyl, and each may be substituted.

When $Z_2$ represents an aryloxy group, $Z_2$ is preferably an aryloxy group substituted with at least one electron attractive group (for example, a halogen atom, a cyano group, a nitro group, a trifluoromethyl group, an acyl group, an alkylsulfonyl group, an arylsulfonyl group, an alkoxycarbonyl group, a carbamoyl group, and a sulfamoyl group).

$Z_2$ is particularly preferably the above 5-membered heterocyclic group.

The couplers represented by formula (II-A) may form a polymer of a dimer or higher, in which they are combined with each other at the substituents $R_2$, $R_{29}$, $R_{30}$, $Q_1$, or $Z_2$ via a bond or divalent or more group. In this case, the carbon numbers shown for the above respective substituents may fall out of the described ranges.

Concrete examples of the yellow coupler represented by formula (II-A) are shown below.

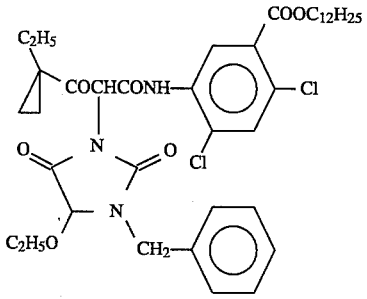

Y-1

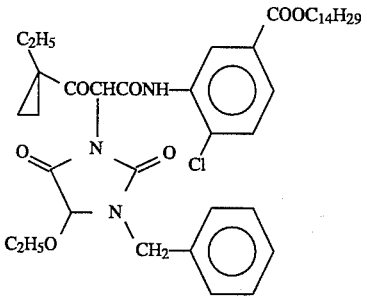

Y-2

-continued
Y-3
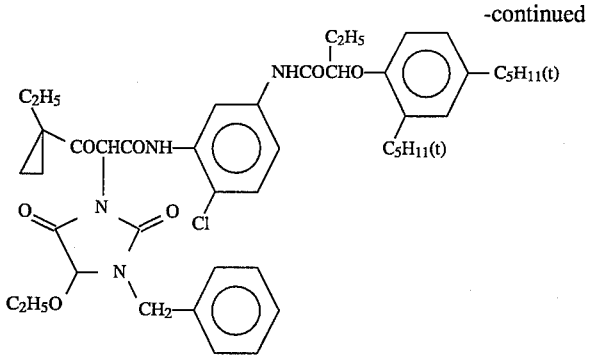
Y-4
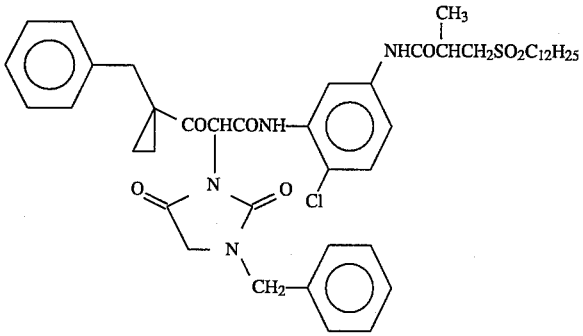
Y-5
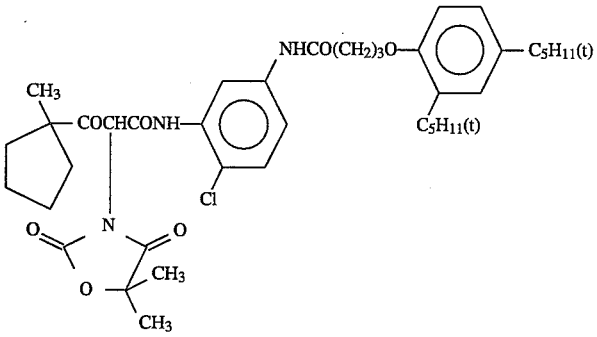
Y-6
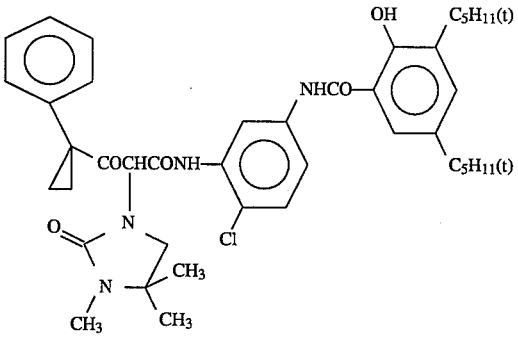
Y-7
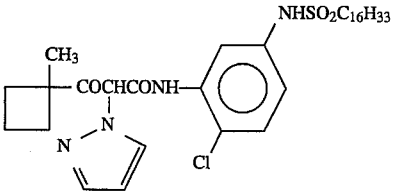

-continued
Y-8
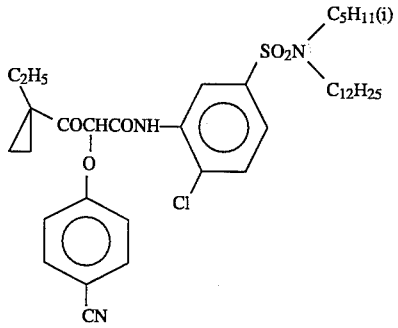
Y-9
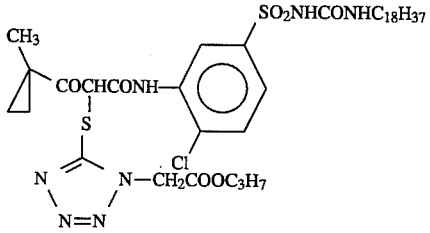
Y-10
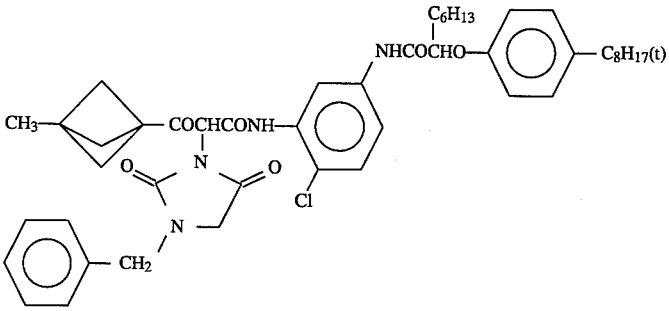
Y-11
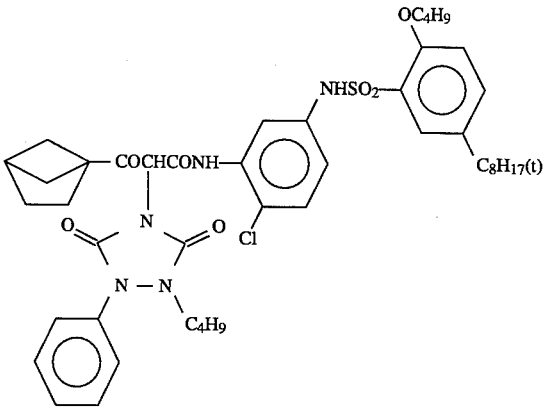
Y-12
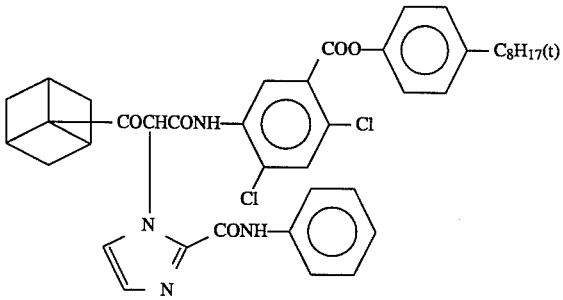

-continued
Y-13
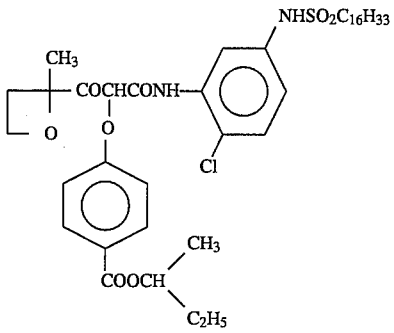
Y-14
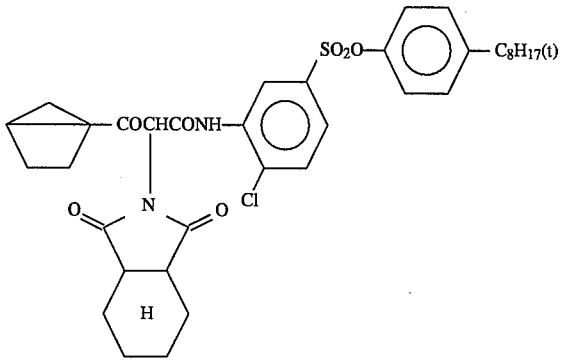
Y-15
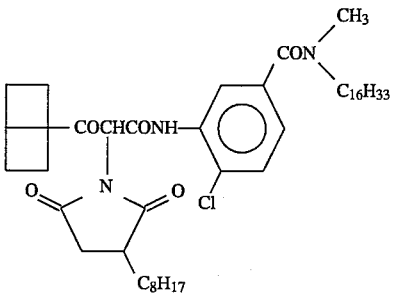
Y-16
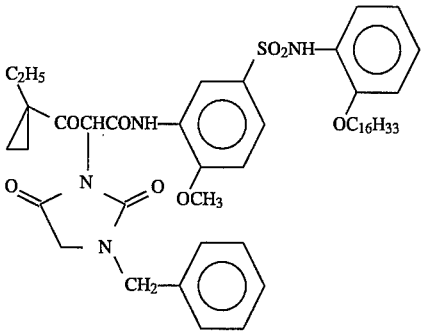
+R2

-continued
Y-17
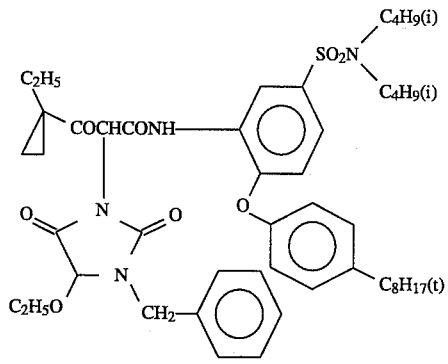
Y-18
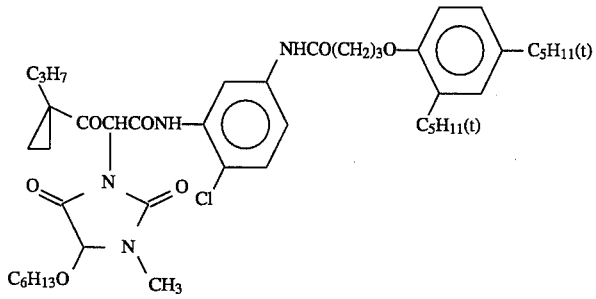
Y-19
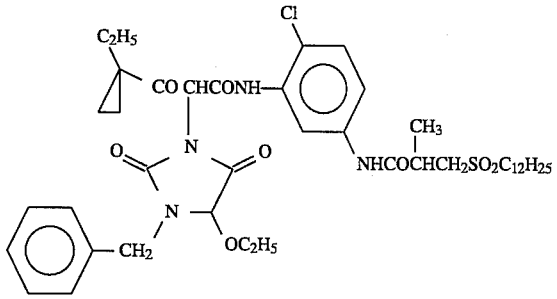
Y-20
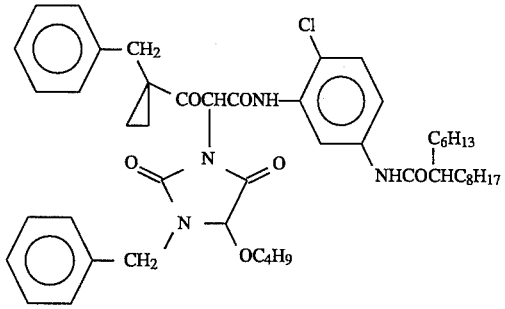
Y-21
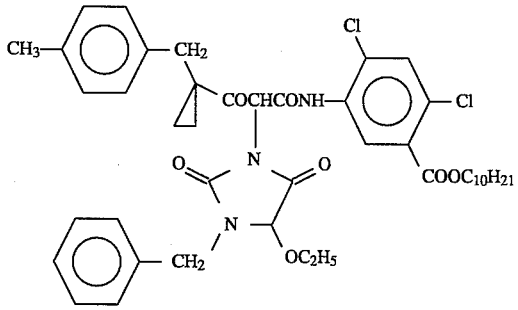

-continued
Y-22
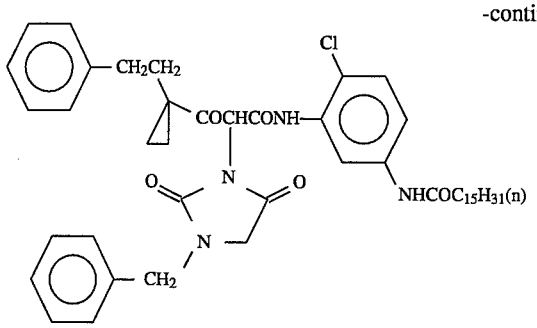
Y-23
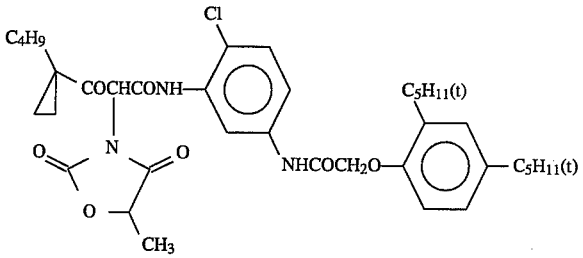
Y-24
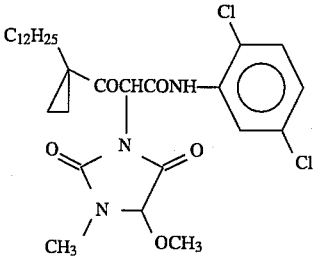
Y-25
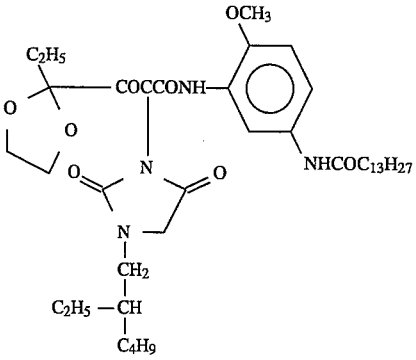
Y-26
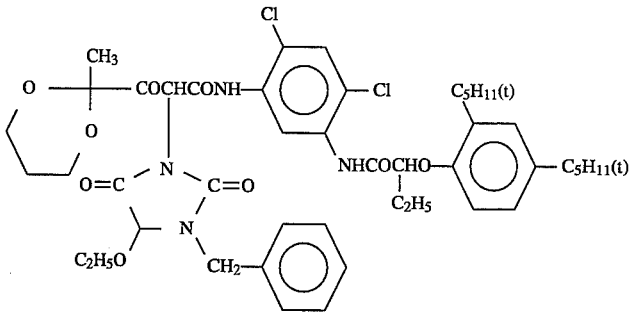

-continued
Y-27
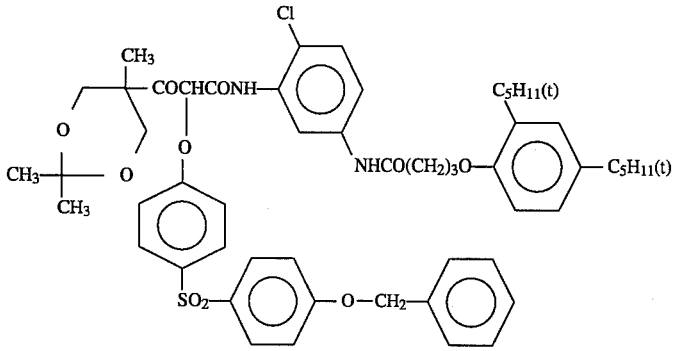
Y-28
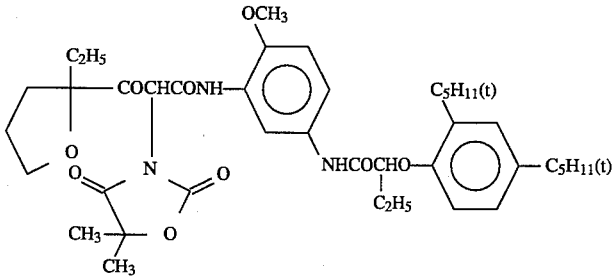
Y-29
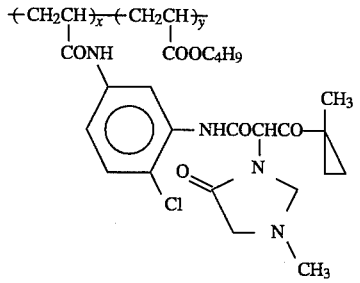
x:y = 60:40
(weight ratio)
number-average molecular weight 55,000
Y-30
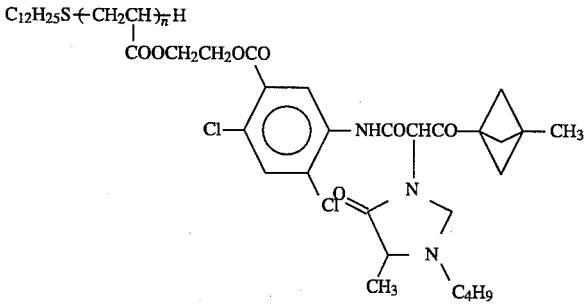
n = 3(average value)
Y-31
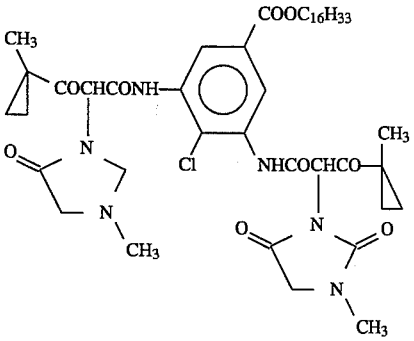

-continued

Y-32

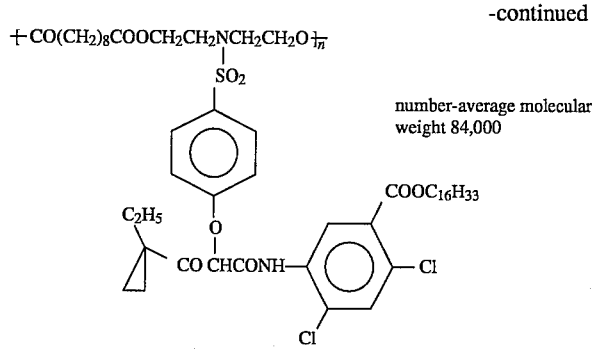

Examples of the acylacetoamide type yellow coupler of the present invention other than the above ones and the synthetic method of these yellow couplers are described in Published European Patent Application (EP) 0447969A$_1$, and JP-A- 4-344640 and JP-A-5-80469.

Next, the yellow coupler represented by formula (III) will be described in detail.

In formula (III), D represents a tertiary alkyl group; $Z_3$ is the same group as that defined for $Z_1$ in formula (I); and $V_1$ represents a fluorine atom, an alkoxy group, an aryloxy group, a dialkylamino group, an alkylthio group, an arylthio group, or an alkyl group.

In formula (III), $W_1$ represents a group capable of being substituted on a benzene ring. In particular, $W_1$ is the same group as that defined for $R_{30}$ in formula (II-A). t represents the integer of 1 to 4 and when t is 2 or more, a plurality of $W_1$'s may be the same or different.

The preferred substituents for the coupler represented by formula (III) will be described below.

In formula (III), D is preferably a tertiary alkyl group having the carbon number of about 4 to 8 and is particularly preferably tert-butyl.

In formula (III), $V_1$ is an alkoxy group having the carbon number of about 1 to 24 or an aryloxy group having the carbon number of about 1 to 30. The above alkoxy group and aryloxy group may be substituted with appropriate groups. The preferred substituent for the above alkoxy group and aryloxy group includes a halogen atom, an alkyl group, an alkoxy group, an aryloxy group, an alkoxycarbonyl group, an acyloxy group, an alkylsulfonyl group, an acylamino group, a carbamoyl group, a sulfonylamino group, and a sulfamoyl group. Particularly preferred $V_1$ is an alkoxy group or alyloxy group substituted with a branched or linear alkyl group, an alkoxy group, an alkoxycarbonyl group, or an alkylsulfonyl group.

In the coupler represented by formula (III), preferred as $Z_3$ is the same group as the substituent preferred for $Z_2$ in the coupler represented by formula (II-A).

The coupler represented by formula (III) also may form a dimer or a polymer as in the coupler represented by formula (II).

Concrete examples of the coupler represented by formula (III) are shown below but are not limited thereto.

YO-1

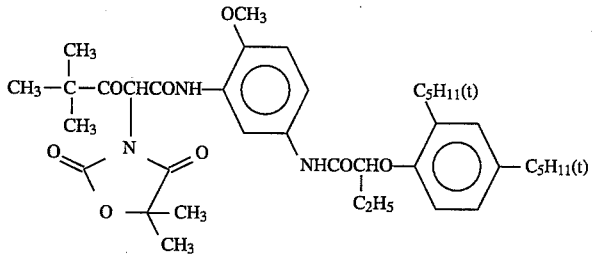

YO-2

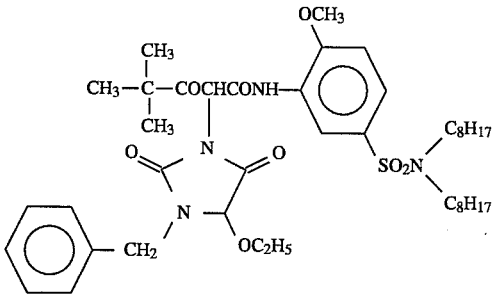

-continued
YO-3
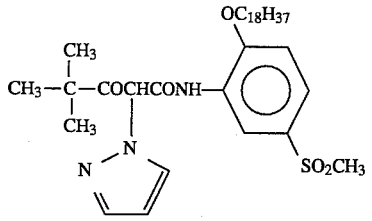
YO-4
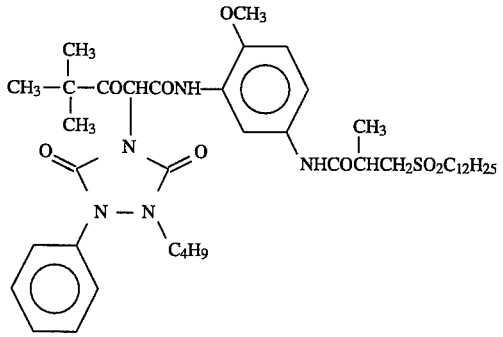
YO-5
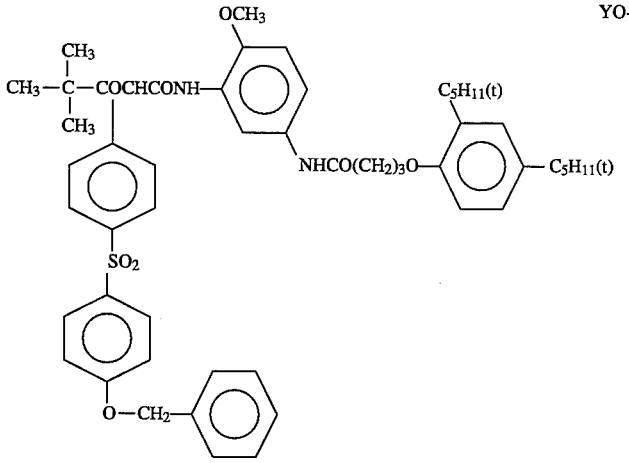
YO-6
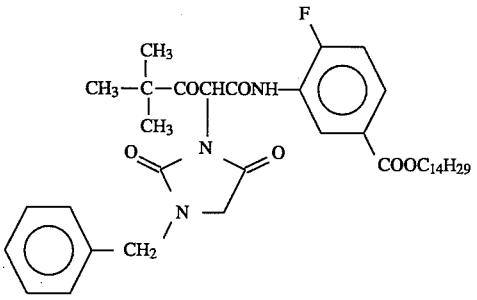
YO-7
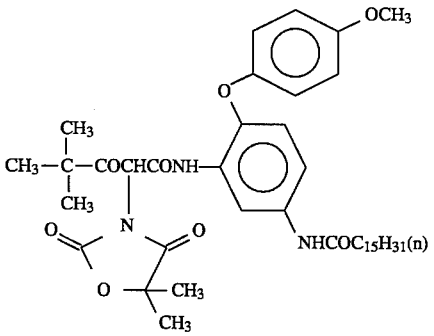

-continued
YO-8
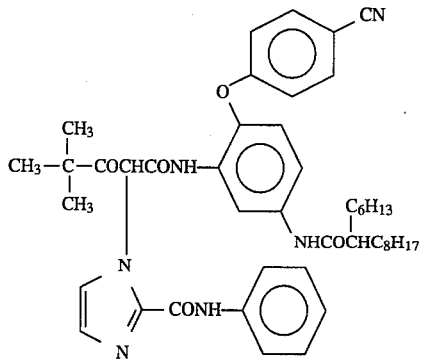
YO-9
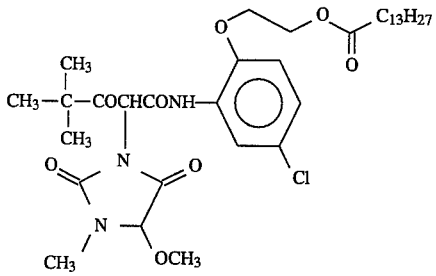
YO-10
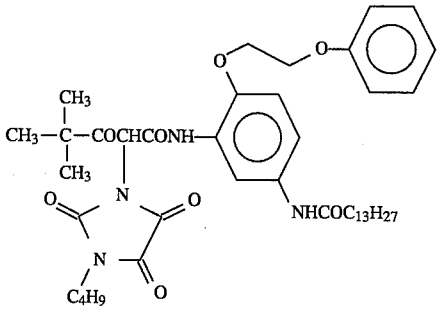
YO-11
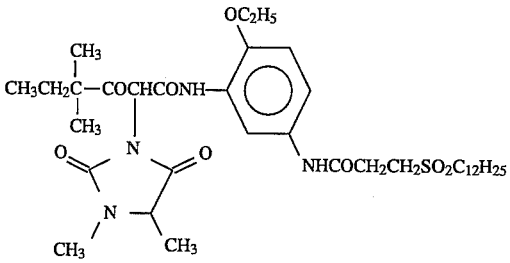
YO-12
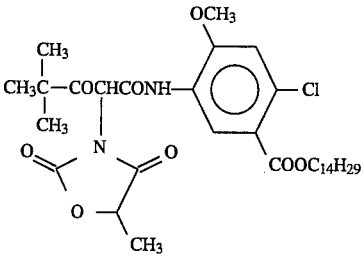

-continued

YO-13

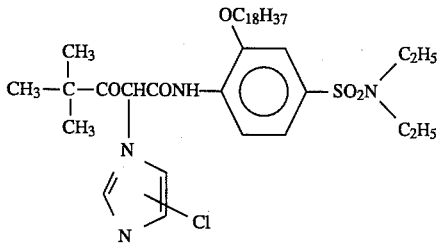

The coupler represented by formula (III) can be synthesized by a method described in JP-A-63-231451, JP-A-63-123047, JP-A-63-241547, JP-A-1-173499 and JP-A-1-250944.

When the yellow coupler of the present invention is applied to a silver halide color photographic light-sensitive material, at least one layer containing the coupler of the present invention may be provided on a support. The layer containing the coupler of the present invention may be any layer as long as it is a hydrophilic colloid layer provided on the support. It is preferably incorporated into a blue-sensitive silver halide emulsion layer.

The preferred amount of the yellow coupler represented by formula (I), (II) or (III) in a silver halide color photographic light-sensitive material is about 0.01 to 10 mmol/$m^2$, more preferably about 0.05 to 5 mmol/$m^2$, and most preferably about 0.1 to 2 mmol/$m^2$. The coupler represented by formula (I), (II) or (III) may be used in combination of two or more kinds. In this case, there either the couplers represented by the same formula or couplers represented by a different formula may be combined. It is also possible to use these couplers in combination with couplers other than the couplers represented by formula (I), (II) or (III). In this case, the ratio of the coupler of the present invention is preferably about 30 mol % or more. In any cases, the preferred amount of the coupler of the present invention represented by formula (I), (II) or (III) is as described above.

The preferred amount of silver halide emulsion contained in the silver halide emulsion layer in which the coupler of the present invention is used is about 0.5 to 50 times, more preferably about 1 to 20 times, and most preferably about 2 to 10 times the amount of the coupler in terms of mole.

In the present invention, various publicly known methods can be utilized as the method for adding the above coupler to a hydrophilic colloid layer. Usually, it can be added according to an oil-in-water dispersion method publicly known as the oil protect method. That is, it is the method in which the coupler is dissolved in a high boiling organic solvent such as phosphoric acid ester and phthalic acid ester and a low boiling auxiliary solvent, and then is dispersed in a gelatin aqueous solution containing a surface active agent. Or, water or a gelatin aqueous solution may be added to a coupler solution containing a surface active agent to prepare an oil-in-water dispersion accompanied with a phase conversion. In an alkali soluble coupler, the dispersion method known as the Fisher dispersion method can be used as well. In order to remove a low boiling organic solvent from the dispersion thus prepared, the method such as distillation, noodle washing, or ultrafiltration can be preferably used as well.

A preferred dispersing medium for such a coupler is a high boiling organic solvent having the dielectric constant (25° C.) of about 2 to 20 and the refraction index of about 1.4 to 1.7 and/or the water insoluble high molecular compounds described in the seventh to fifteenth columns of U.S. Pat. No. 4,857,449 and at the twelfth to thirtieth pages of International Patent Publication WO88/00723. In the present invention, the weight ratio of the dispersing medium to the coupler is preferably about 0.1 to 10, more preferably about 0.3 to 3.

Next, the compound represented by formula (IV) will be described in detail.

In formula (IV), $R_3$ represents a hydrogen atom, an alkyl group, an acyl group, an aryl group, or an alkenyl group; $R_4$, $R_5$, $R_6$ and $R_7$ independently represents an alkyl group having the carbon number of about 1 to 12; $R_8$ represents a hydrogen atom or an alkyl group having the carbon number of about 1 to 20; the methine group connecting two benzene rings is bonded at an ortho position, a meta position or a para position to an oxygen atom on each ring; and in the case where it is bonded at the para position, $R_5$ or $R_7$ represents the methine group itself and in this case, the benzene ring may further have an alkyl group.

The preferred substituents for the compound represented by formula (IV) will be explained below.

The methine group connecting two benzene rings is bonded at the ortho position or para position to an oxygen atom.

Preferred as $R_3$ is a hydrogen atom, an alkyl group (for example, methyl, butyl and benzyl), or an acyl group (for example, acetyl and acryloyl).

When $R_8$ is not a hydrogen atom, $R_4$ and $R_6$ each are preferably a primary or secondary alkyl group (for example, methyl, ethyl, isopropyl, cyclohexyl, and benzyl), and $R_5$ and $R_7$ each are preferably a primary alkyl group (for example, methyl, ethyl and decyl). When $R_8$ is a hydrogen atom, $R_4$ and $R_6$ each are preferably a secondary or tertiary alkyl group, and $R_5$ and $R_7$ each are preferably a tertiary alkyl group.

When $R_8$ is not a hydrogen atom, $R_8$ is preferably a branched alkyl group having the carbon atom of about 3 to 12.

Concrete examples of the compound represented by formula (IV) are shown below but are not limited thereto.

B-1

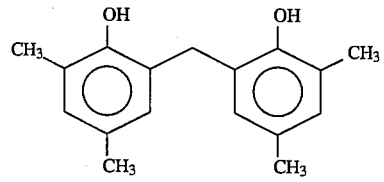

-continued
B-2
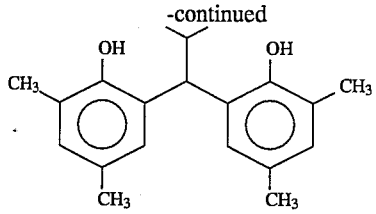
B-3
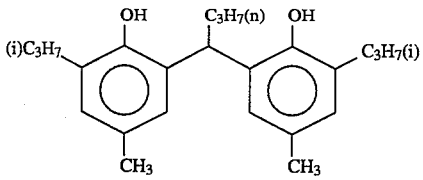
B-4
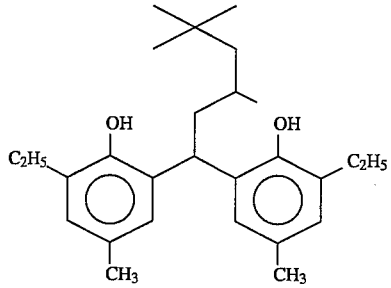
B-5
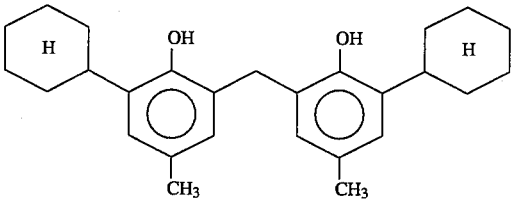
B-6
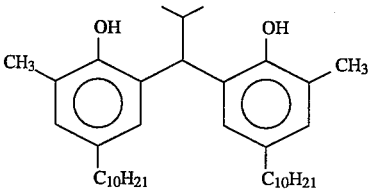
B-7
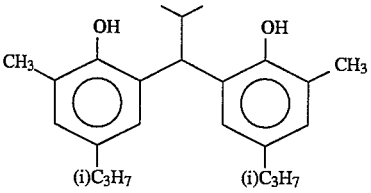
B-8
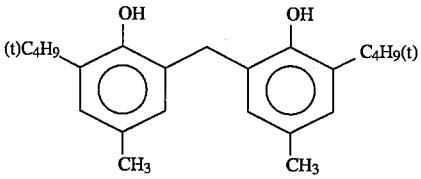
B-9
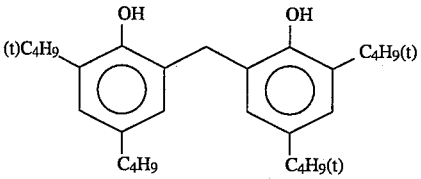
-continued
B-10
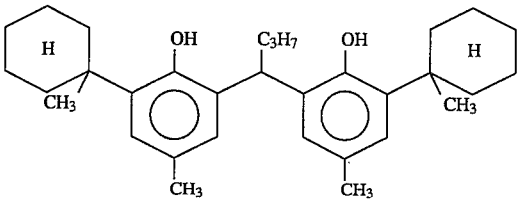
B-11
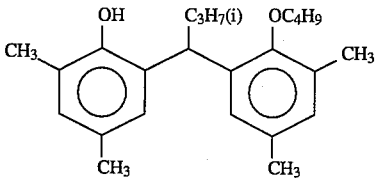
B-12
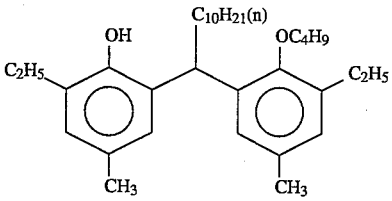
B-13
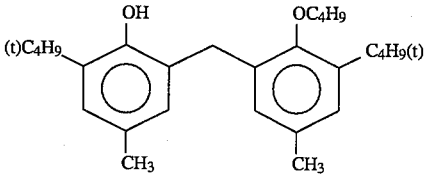
B-14
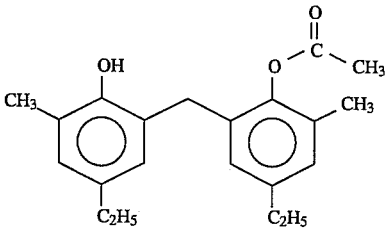
B-15
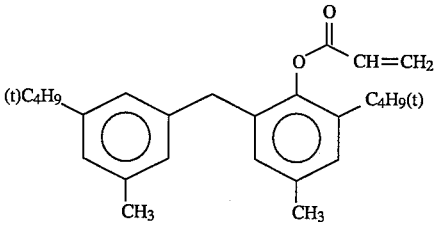
B-16
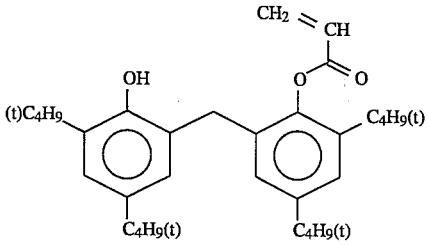

-continued

B-17

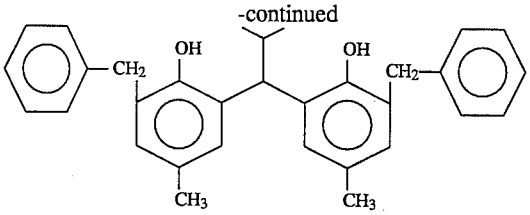

B-18

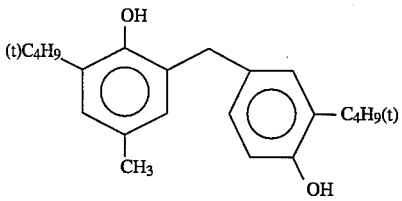

B-19

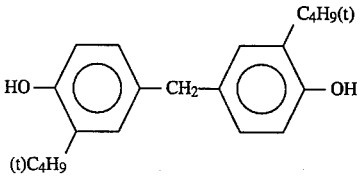

B-20

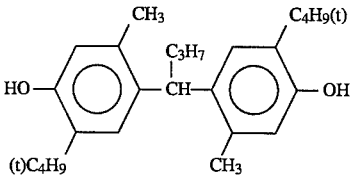

Next, the compound represented by formula (V) will be described in detail.

In formula (V), $R_9$ represents a hydrogen atom, an alkyl group, an aryl group, or an acyl group; $R_{10}$ and $R_{11}$ independently represents a substituted or unsubstituted alkyl group or an alkoxy group; and $W_2$ represents a monovalent group capable of being substituted on a benzene ring. Examples thereof include the same group as those defined for $W_1$ in formula (III).

In formula (V), $R_{10}$ and $R_{11}$ each are preferably a secondary or tertiary alkyl group, more preferably the tertiary alkyl group. A hydrogen atom is preferred as $R_9$. Preferred as $W_2$ is a substituted or unsubstituted alkoxycarbonyl group, an aryloxycarbonyl group, an alkyl group, a carbamoyl group, or a sulfamoyl group.

Concrete examples of the compound represented by formula (V) are shown below, but are not limited thereto.

H-1

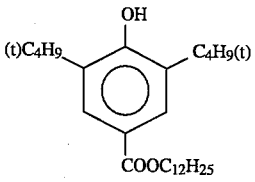

-continued

H-2

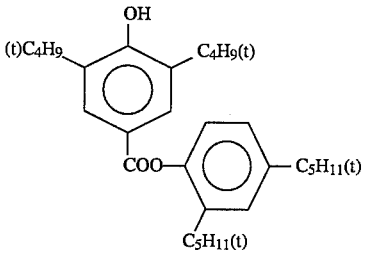

H-3

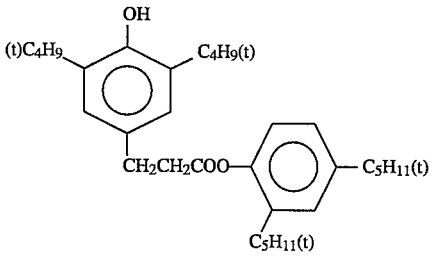

H-4

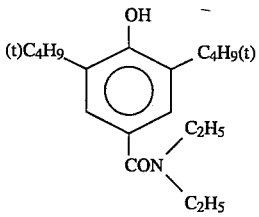

H-5

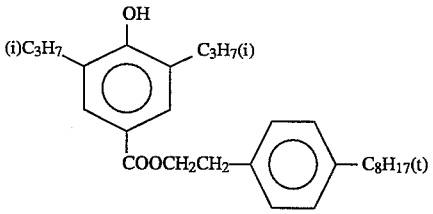

H-6

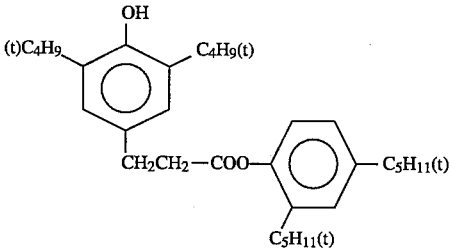

H-7

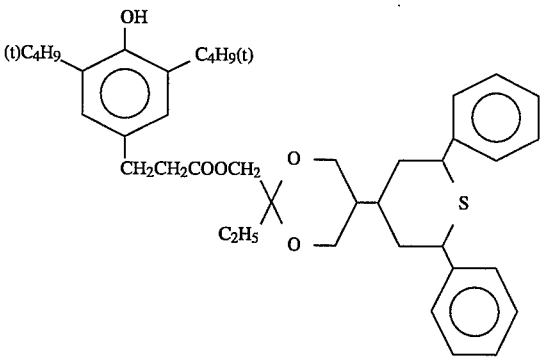

-continued

H-8

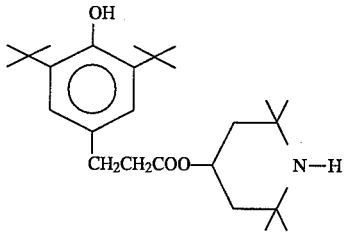

H-9

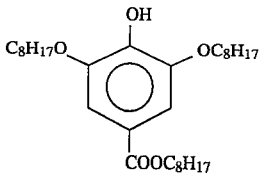

H-10

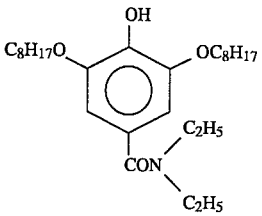

H-11

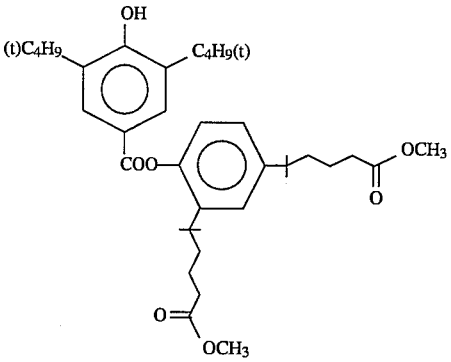

Next, the compound represented by formula (VI) will be described in further detail.

In formula (VI), $Q_2$ represents a divalent group forming a 5- to 7-membered heterocyclic ring together with a nitrogen atom and an alkylene group. In particular, it represents —$CH_2$—, —O—, —NR'—, —S—, —SO—, —$SO_2$—, —PR'—, or —PO(R')—. Preferred as $Q_2$ is —SO—, —$SO_2$—, or —PO(R')—, more preferably —$SO_2$—. R' represents an alkyl group.

$R_{12}$ represents an alkyl group having the carbon number of about 1 to 20, an alkoxy group, an aryloxy group, or an acyloxy group. These groups may have substituents.

$W_3$ represents a monovalent group capable of being substituted on a benzene ring. Examples thereof include the group shown for $W_1$ in formula (III).

Concrete examples of the compound represented by formula (VI) are shown below, but are not limited thereto.

P-1

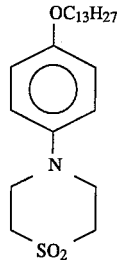

P-2

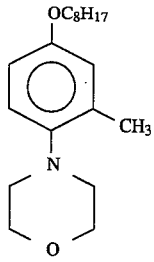

P-3

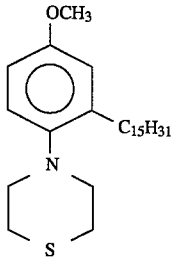

P-4

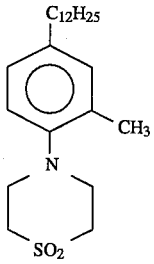

P-5

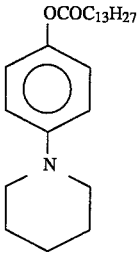

P-6

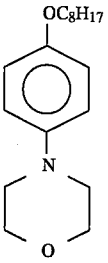

-continued

P-7

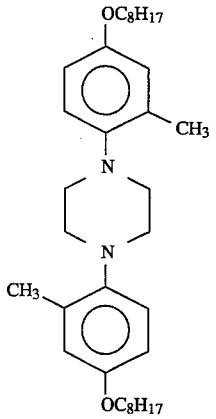

P-8

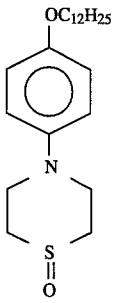

P-9

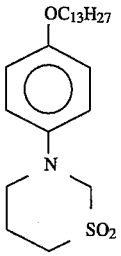

P-10

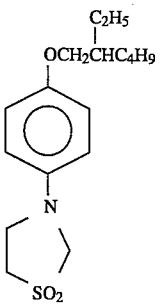

P-11

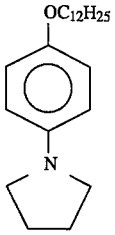

-continued

P-12

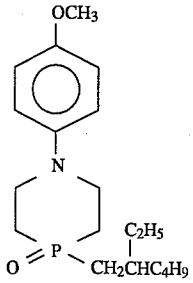

P-13

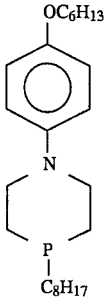

P-14

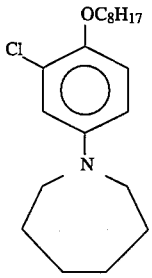

Next, the epoxy compound represented by formula (VII) according to the present invention will be explained in detail.

In formula (VII), $R_{13}$, $R_{14}$, $R_{15}$ and $R_{16}$ each represents a hydrogen atom, an aliphatic group, an aromatic group, an aliphatic oxycarbonyl group (dodecyloxy-carbonyl and allyloxycarbonyl), an aromatic oxycarbonyl group (phenoxycarbonyl), or a carbamoyl group (tetra-decylcarbamoyl and phenyl-methylcarbamoyl), provided that all of $R_{13}$, $R_{14}$, $R_{15}$ and $R_{17}$ are not hydrogen atoms at the same time. A plurality of the epoxy groups represented by formula (VII) can be contained in one molecule in the number of about 1 to 60 groups.

The aliphatic group represents a linear, branched or cyclic aliphatic hydrocarbon group and includes saturated and unsaturated groups such as an alkyl group, an alkenyl group and an alkynyl group. Representative examples thereof include methyl, ethyl, butyl, dodecyl, octadecyl, iso-propyl, tert-butyl, tert-octyl, cyclohexyl, cyclopentyl, 1-methylcyclohexyl, allyl, vinyl, 2-hexadecenyl, and propagyl.

The aromatic group represents substituted or unsubstituted phenyl and naphthyl having the carbon number of about 6 to 42.

These aliphatic groups and aromatic groups may further be substituted with the groups selected from an alkyl group, an aryl group, a heterocyclic group, an alkoxy group (for example, methoxy and 2-methoxyethoxy), an aryloxy group (for example, 2,4-di-tert-amylphenoxy, 2-chlorophenoxy and 4-cyanophenoxy), an alkenyloxy group (for example, 2-propenyloxy), an acyl group (for example, acetyl and benzoyl), an ester group (for example, butoxycarbonyl, phenoxycarbonyl, acetoxy, benzoyloxy, butoxysulfonyl, and toluenesulfonyloxy), an amide group (for example, acetylamino, ethylcarbamoyl, dimethylcarbamoyl, methanesulfonamide, and butylsulfamoyl), a sulfamide group (for example, dipropylsulfamoylamino), an imide group (for example, succinimide and hydantoinyl), a ureido group (for example, phenylureido and dimethylureido), an aliphatic or aromatic sulfonyl group (for example, methanesulfonyl and benzenesulfonyl), an aliphatic or aromatic thio group (for example, ethylthio and phenylthio), a hydroxy group, a cyano group, a carboxy group, a nitro group, a sulfo group, and a halogen atom.

Among the epoxy compounds represented by formula (VII), preferred is the epoxy compound having the group represented by the following formula (VII-A):

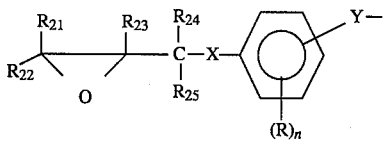

(VII-A)

wherein $R_{21}$, $R_{22}$, $R_{23}$, $R_{24}$ and $R_{25}$ may be the same or different, and each represents a hydrogen atom, an alkyl group, or an aryl group; R represents a substituent; n represents the integer of 0 to 4; —Y— represents a divalent linkage group (e.g., $—SO_2—$, phenylene- $—O—OC_2—$, etc.); —X— represents —O—, —S—, or —N(R')—; and R' represents a hydrogen atom, an acyl group, an alkylsulfonyl group, an arylsulfonyl group, an aryl group, a heterocyclic group, or $—C(R_{26})(R_{27})(R_{28})$, in which $R_{26}$, $R_{27}$ and $R_{28}$ may be the same or different, and each represents an alkyl group or the group represented by the following formula (VII-B); and $R_{26}$ and $R_{27}$ further represent a hydrgen atom:

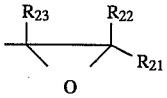

(VII-B)

When n is 2 to 4, a plurality of R may be the same or different from each other.

Any two of $R_{21}$ to $R_{25}$, R' and R, or two R's may be combined with each other to form a 5- to 7-membered ring.

Provided that when —X— is —S—, the total carbon number of the compound is 15 or more. Further, when —X— is —O— and —Y— is $—SO_2—$ or phenylene, n is the integer of 1 to 4 or at least one of $R_{21}$ to $R_{25}$ is an alkyl group or an aryl group. When —X— is —O— and —Y— is $—O—CO_2—$, the total carbon number of $R_{21}$ to $R_{25}$ and R is 10 or more.

$R_{21}$, $R_{22}$ and $R_{23}$ in formula (VII-B) each represents the same groups as those defined for $R_{21}$, $R_{22}$ and $R_{23}$ in formula (VII-A).

The group represented by formula (VII-A) may be bonded to any of a hydrogen atom, a carbon atom, a nitrogen atom, a sulfur atom, and an oxygen atom.

Of the epoxy compound having the group represented by formula (VII-A), preferred in terms of the effects of the present invention is the compound having 3 or more, more preferably 4 or more and further more preferably 5 or more groups represented by formula (VII-A).

Meanwhile, the epoxy compound having the group represented by formula (VII-A) has the total benzene ring number of preferably 2 or more, further preferably 3 or more, and more preferably 4 or more.

Of the epoxy compound having the group represented by formula (VII-A) according to the present invention, the further preferred is one represented by the following formula (VII-C):

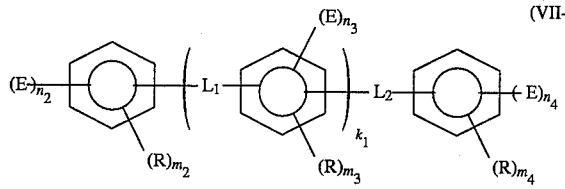

(VII-C)

wherein E is represented by the following formula (VII-D):

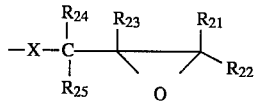

(VII-D)

wherein $R_{21}$ to $R_{25}$ and X represent the same groups as those defined for $R_{21}$ to $R_{25}$ and X in formula (VII-A).

In formula (VII-C), R represents the same group as that defined for R in formula (VII-A). $L_1$ and $L_2$ may be the same or different, and each represents a divalent linkage group.

An alkylene group which may have a substituent is preferred as $L_1$ and $L_2$ and the structures shown below can be enumerated:

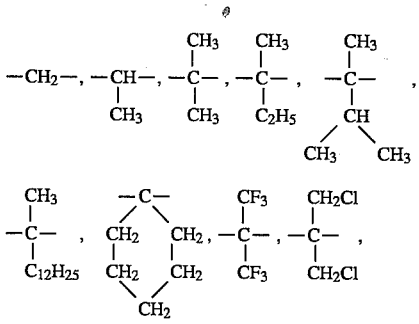

$n_2$ represents the integer of 1 to 5; $n_3$ of 1 to 4; $n_4$ of 1 to 5; $m_2$ of 0 to 4; $m_3$ of 0 to 3; and $m_4$ of 0 to 4. $k_1$ represents the integer of 0 to 20.

When a plurality of E's and R's is present, a plurality of E's may be the same or different, and a plurality of R's may be the same or different as well.

The compound represented by formula (VII-C) may be the mixture of compounds in which the number of $k_1$ is different.

Of the compounds represented by formula (VII-C), preferred is the compound in which X in formula (VII-D) is —O—; $k_1$ is preferably about 1 to 20, further preferably about 2 to 20, more preferably about 3 to 20, and most preferably about 4 to 20; $n_2$ to $n_4$ each are preferably 1 to 2; $m_2$ to $m_4$ each are preferably 0 to 3, most preferably 1 to 2; and R is preferably an alkyl group, a halogen atom. or an alkoxy group.

The compound represented by formula (VII-A) is preferably used in combination with the other compounds represented by formula (VII).

Concrete examples of the compound represented by formula (VII) according to the present invention are shown below but are not limited thereto.

E-1
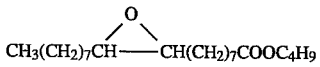
E-2
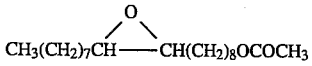
E-3
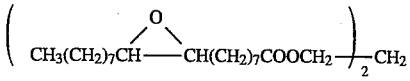
E-4
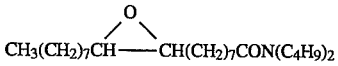
E-5
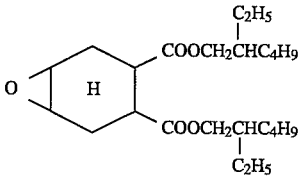
E-6
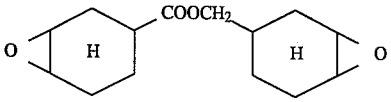
E-7
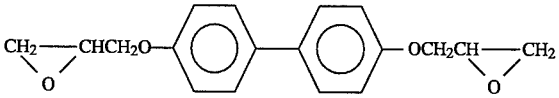
E-8
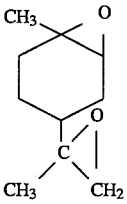
E-9
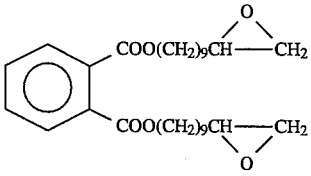
E-10
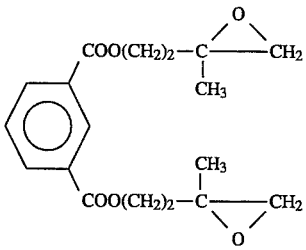
E-11
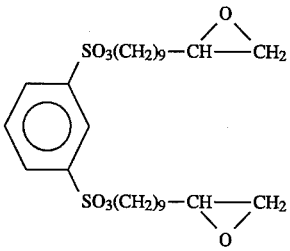

-continued
E-12
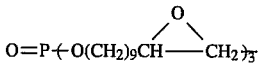
E-13
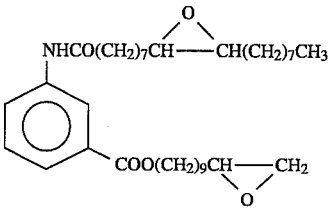
E-14
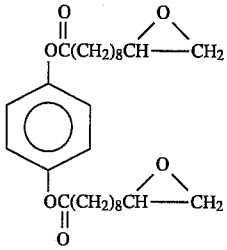
E-15
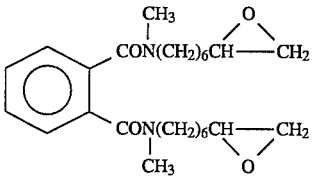
E-16
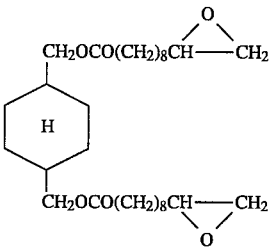
E-17
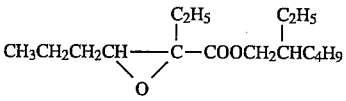
E-18
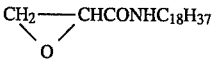
E-19
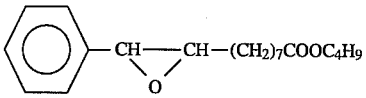
E-20
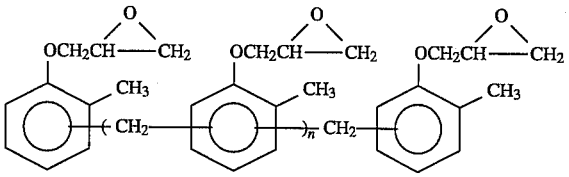
n = 0~7 mixture -continued
E-21
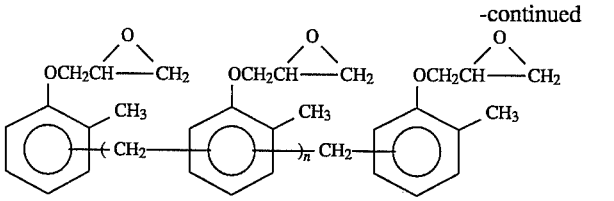
n = 3~12 mixture
E-22
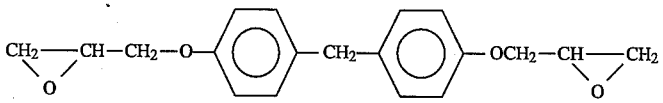
E-23
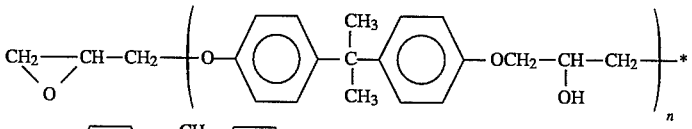
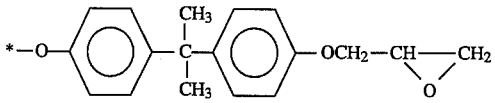
n = 0~7 mixture
E-24
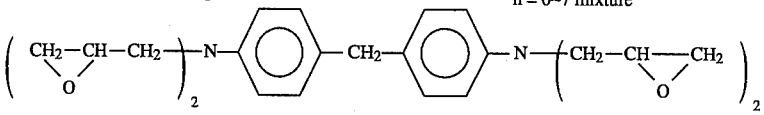
E-25
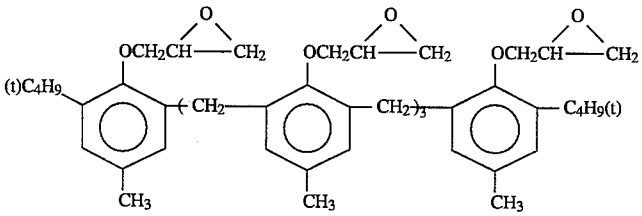
E-26
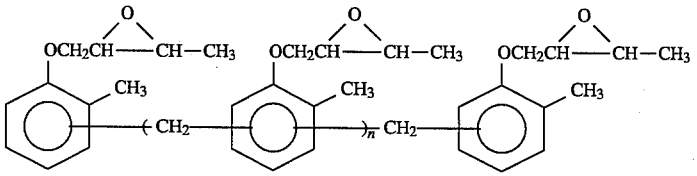
n = 0~7 mixture
E-27
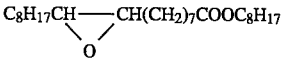
E-28
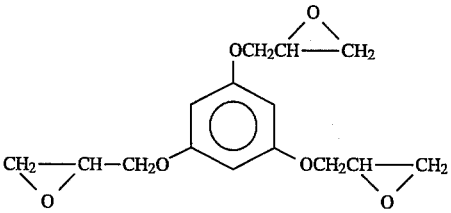

-continued
E-29
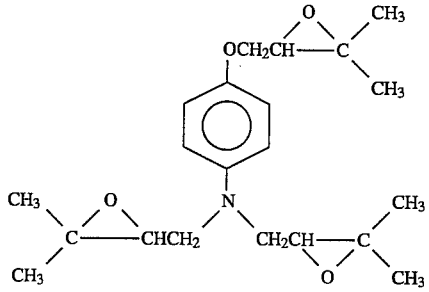
E-30
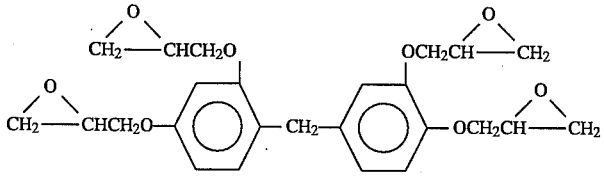
E-31
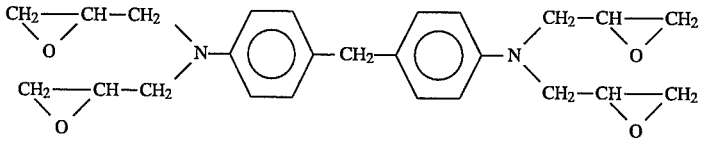
E-32
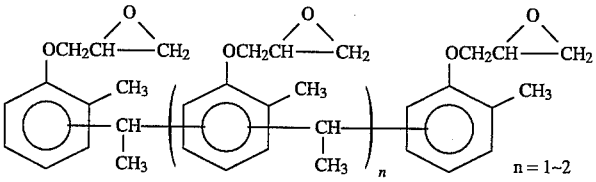
n = 1~2
E-33
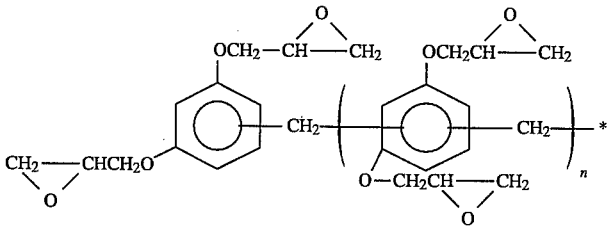
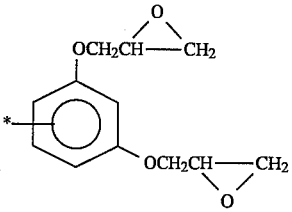
n = 0~20
E-34
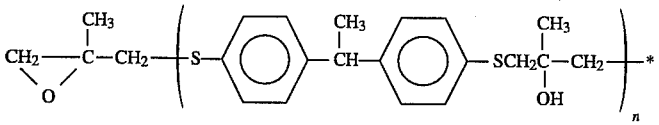
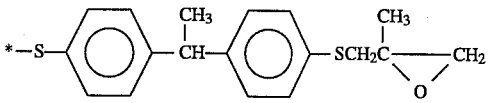
n = 3~6

-continued

E-35

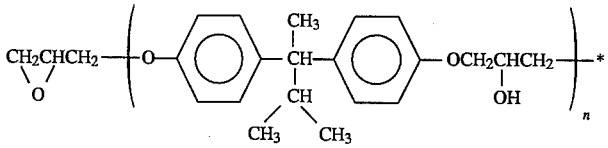

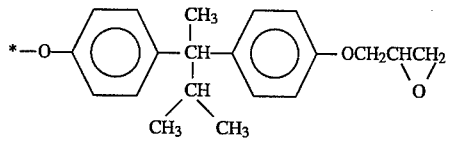

n = 1~10 mixture

Next, the amide compound represented by formula (VIII) will be explained in detail.

In formula (VIII), $R_{17}$, $R_{18}$ and $R_{19}$ each represents an alkyl group having the carbon number of about 1 to 36 or an aryl group having the carbon number of about 6 to 36, and these groups may be substituted with substituents such as a halogen atom, an alkyl group, an alkoxy group, an aryl group, an aryloxy group, an alkylsulfonyl group, an arylsulfonyl group, an alkoxycarbonyl group, and a carbamoyl group. In the case where both of $R_{18}$ and $R_{19}$ are alkyl groups, they may be combined with each other to form a 5- to 7-membered ring. One or more hetero atoms of O, S, N, and P may be present in this ring. Further, either one of $R_{18}$ and $R_{19}$ may be a hydrogen atom.

Of the compounds represented by formula (VIII), the compound represented by the following formula (VIII-A) is particularly preferred:

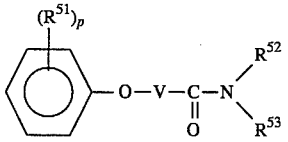

(VIII-A)

wherein $R^{51}$ represents a halogen atom (a fluorine atom, a chlorine atom, a bromine atom and an iodine atom), an alkyl group having the carbon number of about 1 to 24 (for example, methyl, ethyl, iso-propyl, tert-butyl, tert-pentyl, cyclopentyl, cyclohexyl, 1,1,3,3-tetramethyl-propyl, n-decyl, n-pentadecyl, and tert-pentadecyl), or an alkoxy group having the carbon number of about 1 to 24 (for example, methoxy, ethoxy, butoxy, octyloxy, benzyloxy, and dodecyloxy); $R^{52}$ and $R^{53}$ independently represents a hydrogen atom or an alkyl group having the carbon number of about 1 to 24 (for example, methyl, ethyl, iso-propyl, tert-butyl, methoxyethyl, benzyl, 2-ethylhexyl, n-hexyl, n-decyl, and n-dodecyl); V represents an alkylene group having the carbon number of about 1 to 24 (for example, methylene, ethylene, trimethylene, ethylidene, and propylidene); p represents the integer of 1 to 3, provided that when p is plural, $R^{51}$'s may be the same or different; $R^{52}$ and $R^{53}$ may be combined with each other to form a 5- to 7-membered ring; and one more hetero atoms of O, S, N, and P may be present in this ring.

Concrete examples of the amide compound represented by formula (VIII) will be shown below but the present invention is not be limited to these examples.

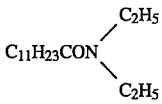

A-1

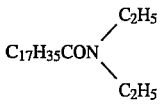

A-2

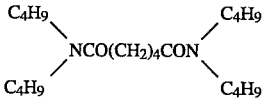

A-3

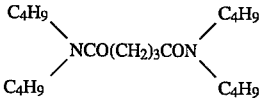

A-4

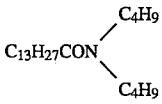

A-5

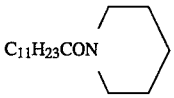

A-6

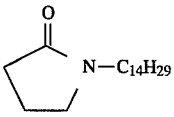

A-7

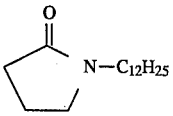

A-8

-continued
A-9
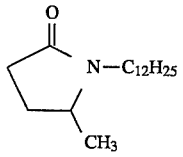
A-10
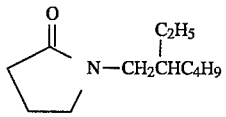
A-11
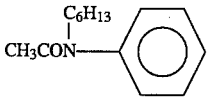
A-12
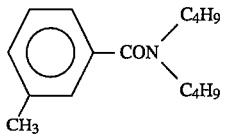
A-13
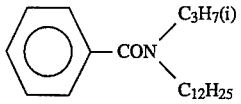
A-14
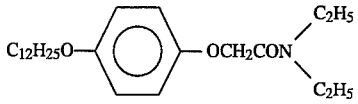
A-15
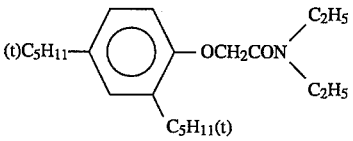
A-16
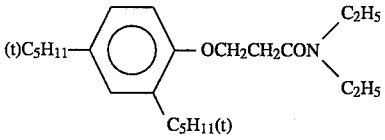
A-17
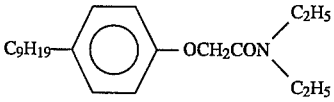
A-18
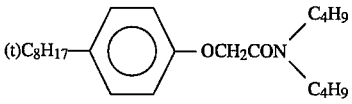
A-19
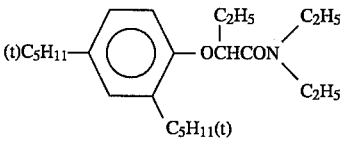
A-20
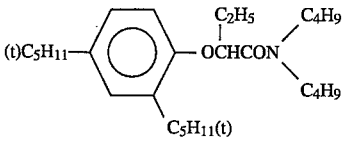
A-21
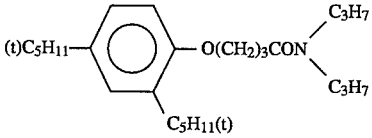
A-22
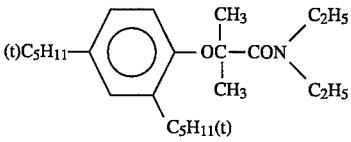
A-23
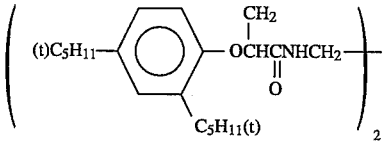
A-24
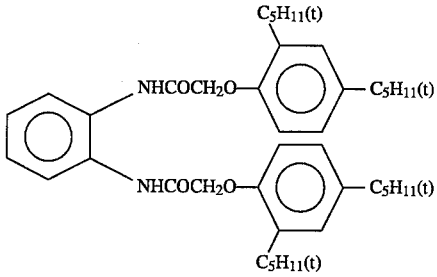
A-25
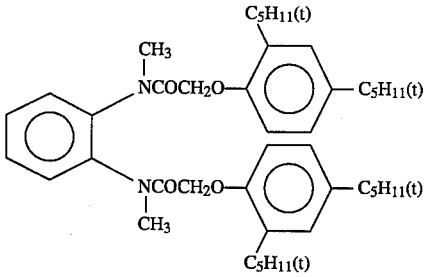
A-26
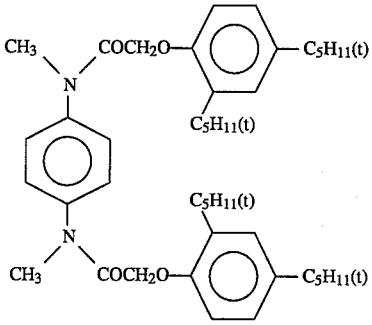

-continued

A-27

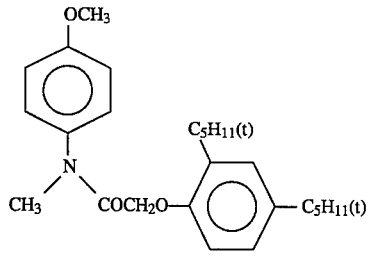

A-28

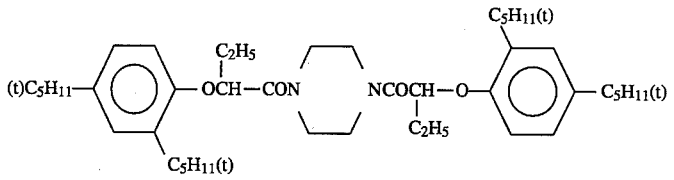

A-29

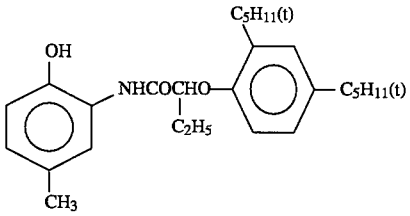

A-30

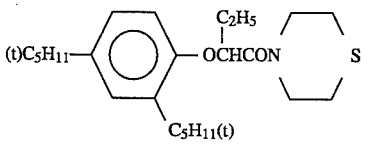

These amide compounds can be synthesized by a conventional method, for example, the condensation reaction of carboxylic anhydride or carboxylic chloride with amine. Concrete synthesis examples are described in, for example, JP-B-58-25260 (the term "JP-B" as used herein means an examined Japanese patent publication), JP-A-62-254149, and U.S. Pat. No. 4,171,975.

The compounds represented by formulas (IV) to (VIII) can be dissolved in a high boiling organic solvent and an auxiliary solvent together with a coupler and then emulsified and dispersed in gelatin. The addition rate thereof is about 1 to 200%, preferably about 5 to 100%, and more preferably about 10 to 50% by weight based on the amount of the coupler.

The support according to the present invention will be explained below in detail.

The reflective support according to the present invention is required to be a reflective support which is coated at least on the surface of the support side on which the light-sensitive hydrophilic colloid layers are coated with a composition prepared by mixing and dispersing a white pigment in a resin containing 50 weight % or more of polyester.

This polyester is polyester synthesized by a polycondensation of dicarboxylic acid with diol. Preferred dicarboxylic acids include, terephthalic acid, isophthalic acid, and naphthalene-dicarboxylic acid. Preferred diols include, ethylene glycol, butylene glycol, neopentyl glycol, triethylene glycol, butanediol, hexylene glycol, a bisphenol A/ethylene oxide adduct (2,2-bis(4-(2-hydroxyethyloxy)phenyl)propane), and 1,4-dihydroxymethylcyclohexane.

In the present invention, there can be used various polyesters obtained by subjecting the single component or mixture of these dicarboxylic acids to a polycondensation with the single component or mixture of diols. Preferably, at least one of the dicarboxylic acids is terephthalic acid. Further, preferably used as well is the dicarboxylic acid component which is the mixture of terephthalic acid and isophthalic acid (mole ratio 9:1 to 2:8) or the mixture of terephthalic acid and naphthalenedicarboxylic acid (mole ratio 9:1 to 2:8). Ethylene glycol or a mixed diol containing ethylene glycol is preferably used as the diol. These polymers preferably have a molecular weight of from about 30,000 to 50,000.

The mixture of plural kinds of polyesters each having a different composition is preferably used as well. Further, the mixture of these polyesters and the other resins is preferably used. There can be widely selected as the other mixed resins, polyolefins such as polyethylene and polypropylene, polyether such as poly-ethylene glycol, polyoxymethylene, and polyoxypropylene, polyester series polyurethane, polyether polyurethane, polycarbonate, and polystyrene, as long as they are the resins capable of being extruded at 270° to 350° C.

These blended resins may be of a single kind or two or more kinds. For example, polyethylene of 6 weight % and polypropylene of 4 weight % can be mixed with polyethylene terephthalate of 90 weight %.

The mixing ratio of polyester to the other resins is varied according to the kinds of the mixed resins. In case of polyolefins, it is suitably polyester/other resin=100/0 to 80/20 in terms of a weight ratio. The mixing ratio exceeding this range rapidly deteriorates the physical properties of the mixed resin. In case of the resins other than polyolefin, they can be mixed in the range of polyester/other resin=100/0 to 50/50 in terms of a weight ratio. In the case where polyester is less than 50 weight %, the effects of the present invention can not sufficiently be obtained.

Examples of the white pigment mixed and dispersed in polyester on the reflective support according to the present invention include an inorganic pigment such as titanium oxide, barium sulfate, lithopon, aluminium oxide, calcium carbonate, silicon oxide, antimony trioxide, titanium phosphate, zinc oxide, white lead, and zirconium oxide, and an organic fine particle of polystyrene, a styrenedivinylbenzene copolymer, etc.

Among these pigments, titanium dioxide is particularly effective. Titanium dioxide may be either of a rutile type or an anatase type and may be manufactured by either a sulfate process or a chloride process. KA-10 and KA-20 manufactured by Titan Ind. Co., Ltd. and A-220 manufactured by Ishihara Sangyo Co., Ltd. are specific examples.

The average particle size of the white pigment used is preferably about 0.1 to 0.8 μm. A particle size less than 0.1 μm makes it difficult to uniformly mix and disperse the pigment in a resin and is not preferred. A particle size exceeding 0.8 μm not only does not obtain sufficient whiteness but also generates projections on the coated face and adversely affects image quality.

The mixing ratio of the white pigment to the above polyester is about 98/2 to 30/70 (polyester/white pigment), preferably about 95/5 to 50/50, and particularly preferably about 90/10 to 60/40 in terms of weight ratio. A white pigment of less than 2 weight % provides an insufficient contribution to the whiteness, and the white pigment exceeding 70 weight % provides an insufficient smoothness on the surface of a support for a photographic printing paper and cannot provide the support for the photographic paper having an excellent glossiness.

The above polyester and white pigment are mixed and kneaded in a resin with a kneader such as a two rolls kneader, a three rolls kneader, and a banbury mixer together with a dispersing aid such as a metal salt of higher fatty acid, higher fatty acid ethyl, higher fatty acid amide, and higher fatty acid.

An anti-oxidation agent can be incorporated into a resin layer. The amount present thereof is about 50 to 1000 ppm based on the amount of the resin.

The thickness of the polyester/white pigment composition coated on the light-sensitive hydrophilic colloid layer-coated side of the substrate of the reflective support according to the present invention is about 5 to 100 μm, preferably about 5 to 80 μm, more preferably about 10 to 50 μm. A thickness larger than 100 μm increases the fragility of the resin and causes problems with the physical properties such as the generation of cracks. A thickness smaller than 5 μm not only damages water-proof performance which is an initial object for coating but also can not simultaneously satisfy whiteness and surface smoothness at the same time and is not preferred since it makes the layer physically too soft.

The thickness of the resin or resin composition coated on the substrate face on which a light-sensitive hydrophilic colloid layer is not coated is preferably about 5 to 100 μm, more preferably about 10 to 50 μm. A thickness exceeding this range increases the fragility of the resin and causes problems with the pysical prperties such as the generation of cracks. A thickness less than this range not only damages waterproof performance but also makes the layer physically too soft and is not preferred.

Polyester is preferred as the above resin. Among them, polyester comprising polyethylene terephthalate as a main component is preferred.

A melting and extruding lamination process can be enumerated as the method for coating a covering layer at the side of the support on which the light-sensitive layers are coated and a back face layer on a substrate.

The substrate used for the reflective support according to the present invention is selected from materials generally used for a photographic printing paper. That is, a base paper is used for which a natural pulp selected from a coniferous tree and a broad-leaved tree and a synthetic pulp are used as a main raw material and to which there are added according to necessity, a filler such as clay, talc, calcium carbonate and a urea resin fine particle, a sizing agent such as rosin, an alykl ketene dimer, a higher fatty acid, epoxidized fatty acid amide, paraffin wax and alkenyl succinate, a paper strengthening agent such as starch, polyamidepolyamineepichlorohydrine and polyacrylamide, and a fixing agent such as aluminum sulfate and a cationic polymer.

In the present invention, the above base paper for which a natural pulp and a synthetic pulp are used as a main raw material is preferred as the substrate used for the reflective support.

The kind and thickness of the substrate are not specifically limited. The weight thereof is preferably about 50 to 250 g/m$^2$. The substrate is preferably subjected to a surface treatment by applying heat and pressure by machine calender and supercalender for the purpose of improving smoothness and flatness.

This "smoothness" is expressed with the surface roughness of the support as a standard. With respect to the surface roughness, a center line average surface roughness is used as the standard therefor. The center line average surface roughness is defined as follows: the portion with the area SM is taken out on a center face from a rough curve face; an orthogonal coordinates axis, an X axis and a Y axis, are put on the center line of this portion taken out; the axis perpendicular to the center line is put as a Z axis; and then, the center line average surface roughness (SRa) is defined by the value obtained from the following equation and expressed in terms of a μm unit:

$$SRa = \frac{1}{SM} \int_0^{Lx} \int_0^{Ly} |f(X, Y)| dX \cdot dY$$

$$LxLy = SM$$
$$Z = f(X, Y)$$

The values of the center line average surface roughness and the height of a projection from the center line can be obtained by using, for example, a three dimension surface roughness measuring equipment (SE-30H) manufactured by Kosaka Laboratory to measure the area of 5 mm$^2$ with a diamond needle having the diameter of 4 μm at the cutoff value of 0.8 mm, the enlarging magnification of 20 in a horizontal direction, and the enlarging magnification of 2000 in a height direction. The speed of the measuring needle is preferably around 0.5 mm/second.

Preferred is the support in which the value obtained by this measurement is about 0.15 μm or less, further preferably about 0.10 μm or less. The use of the support having such a surface roughness (flatness) can provide a color print with a surface having excellent flatness.

Before coating the above mixing composition of the polyester and white pigment on a substrate, the substrate surface is preferably subjected to a pretreatment such as a corona discharge treatment, a flame treatment and a subbing.

The use of polyester such as polyethylene terephthalate weakens the adhesion to a photographic emulsion in some cases as compared with polyethylene and accordingly, after polyester is laminated on the substrate by melting and extruding, the polyester surface is preferably subjected to the corona discharge treatment before providing a hydrophilic colloid layer thereon.

The subbing solution containing the compound represented by the following formula (U) is preferably coated on the surface of a thermoplastic resin con-taining polyester as a main component:

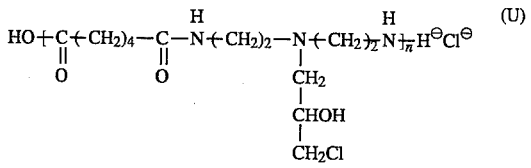

(U)

n = integer of 1 to 7

The coating amount of the compound represented by formula (U) is preferably about 0.1 mg/m$^2$ or more, more preferably about 1 mg/m$^2$ or more, and most preferably about 3 mg/m$^2$ or more. The more the coating amount, the more the adhesion power can be strengthened. However, the excessive use thereof is disadvantageous in terms of cost.

Further, alcohols such as methanol are preferably added in order to improve the coating aptitude of the subbing solution. In this case, the ratio of alcohol is preferably about 20 weight % or more, further preferably about 40 weight % or more, and most preferably about 60 weight % or more to the total amount of the subbing solution. In order to further improve the coating aptitude, various surface active agents such as anionic, cationic, amphoteric, nonionic, fluorinated carbon series, and organic silicon series ones are preferably used.

Further, a water soluble high molecule such as gelatin is preferably added in order to obtain a good subbing coated surface.

The pH value of the solution is preferably about 4 to 11, further preferably about 5 to 10 in view of the stability of the compound of formula (U).

Before coating the above subbing solution, a thermoplastic resin surface is preferably subjected to a surface treatment. A corona discharge treatment, a flame treatment and a plasma treatment can be used for the surface treatment.

In coating the subbing solution, it can be coated by well known methods, such as a gravure coater, a bar coater, a dip coating method, an air knife coating method, a curtain coating method, a roller coating method, a doctor coating method, and an extrusion coating method.

The temperature for drying the coated layer is preferably about 30° to 100° C., further preferably about 50° to 100° C., and most preferably about 70° to 100° C. The upper limit thereof is determined by the heat resistance of the resin, and the lower limit thereof is determined by a manufacturing efficiency.

Each of the at least one yellow color developing silver halide emulsion layer, magenta color developing silver halide emulsion layer and cyan color developing silver halide emulsion layer can be provided on a support having a reflection layer to thereby constitute the color light-sensitive material of the present invention. In a color photographic paper, the color coupler which forms a dye having the relationship of a complementary color with rays to which a silver halide emulsion is sensitive can be incorporated to carry out a color reproduction by a subtractive color process.

In a color photographic paper, the silver halide emulsion grains are spectrally sensitized with blue-sensitive, green-sensitive and red-sensitive spectral sensitizing dyes, respectively, in order of the above color developing layers, and the respective emulsions can be coated on the support in the above order to constitute the color photographic paper. However, the order may be different from this. That is, the light-sensitive emulsion layer containing the silver halide grains with the largest average grain size is preferably provided uppermost in some cases from the viewpoint of rapid processing, and the lowest layer is preferably a magenta color developing light-sensitive emulsion layer in some cases from the viewpoint of storage performance under the irradiation of light.

The constitution in which the light-sensitive layers and the hues of developed colors do not have the above correspondence may be used, and at least one infrared-sensitive silver halide emulsion layer can be used as well.

In the present invention, silver chloride, silver chlorobromide or silver chloroiodobromide grains each having a silver chloride content of 95 mole % or more are preferred to be used as the silver halide grains. In particular, in the present invention, silver halide comprising silver chlorobromide or silver chloride containing substantially no silver iodide can be preferably used in order to accelerate a development processing time, wherein the term "containing substantially no silver iodide" means that a silver iodide content is about 1 mol % or less, preferably about 0.2 mol % or less. The high silver chloride grains containing silver iodide of 0.01 to 3 mol % on an emulsion surface as described in JP-A-3-84545 are preferably used in some cases for the purposes of increasing a sensitivity at high illuminance, raising spectral sensitization sensitivity or improving aging stability of a light-sensitive material. The halogen composition of the emulsion may be different or the same by grain. The use of the emulsion containing the grains each having the same composition can readily homogenize the quality of each of the grains.

With respect to the halogen composition distribution in the inside of the silver halide emulsion grain, there can suitably be selected and used the grains of the so-called homogeneous type structure in which the composition is the same at any part of the silver halide grain, the grains of the so-called laminating type structure in which a core present in the inside of the silver halide grain and the shell (one layer or plural layers) surrounding it have the different halogen compositions, or the grains of the structure in which there are present the portions having the different halogen compositions in the inside or on the surface of the grain in the form of a non-layer (the structure in which the portions of the different compositions are conjugated at the edge, corner or surface of the grain in the case where they are present on the surface of the grain). The use of either of the latter two rather than the grains of the homogeneous type structure is advantageous for obtaining high sensitivity and is preferred as well from the viewpoint of pressure resistance performance.

Where the silver halide grains have the above structures, the boundary at the portions having the different halogen compositions may have a distinct boundary or an indistinct boundary in which a mixed crystal is formed according to the composition difference, or the structure in which a continuous structural change is allowed to positively be provided.

In the high silver chloride emulsion used in the present invention, an emulsion having the structure in which a silver bromide-localizing phase is present in the form of a layer or non-layer as mentioned above in the inside of a silver halide grain and/or on the surface thereof is preferred. The halogen composition in the above localized phase is preferably at least about 10 mole %, more preferably exceeding about 20 mole % in terms of silver bromide content.

The silver bromide content in the silver bromide-localized phase can be analyzed with an X-ray diffraction process (described in, for example, "New Experimental Chemistry Course 6, Structural Analysis" edited by Japan Chemistry Association, Maruzen). These localized phases can be present in a grain inside or at the edge, corner or on the plane of a grain surface. The localized phase epitaxially grown at the corner portion of the grain is a preferred example.

It is also effective to further increase the silver chloride content in a silver halide emulsion for the purpose of reducing the replenishing amount of a development processing solution. In such a case, the emulsion of almost pure silver chloride having a silver chloride content of 98 to 100 mol % can be preferably used as well.

The silver halide grain contained in the silver halide emulsion used in the present invention preferably has an average grain size (the grain size is defined by the diameter of the circle having the same area as that of the projected area of the grain and a number average is calculated therefrom) of about 0.1 to 2 μm.

In the size distribution of these grains, preferred is a so-called monodispersion in which the fluctuation coefficient (obtained by dividing the standard deviation in the grain size distribution with average grain size) is about 20% or less, preferably about 15% or less, and more preferably about 10% or less. The above monodispersed emulsions are preferably used for the same layer in a blend or simultaneously coated for the purpose of obtaining a broad latitude.

Examples of the silver halide grains contained in a photographic emulsion include grains having a regular crystal form such as cube, octahedron and tetradecahedron, grains having an irregular crystal form such as a sphere and plate, or a composite form thereof. Further, the emulsion may consist of a mixture of grains having various crystal forms. In the present invention, of these emulsions, preferred is the emulsion containing grains having the regular crystal form by about 50% or more, preferably about 70% or more, and more preferably about 90% or more.

In addition, the emulsion in which the tabular grains having an average aspect ratio (circle area-corresponding diameter/thickness) of about 5 or more, preferably about 8 or more exceed 50% of the whole grains in terms of a projected area is preferably used as well.

The emulsion used in the present invention can be synthesized by the methods described in "Chemie et Phisique Photographique" written by P. Glafkides (pub-lished by Paul Montel Co., Ltd., 1967), "Photographic Emulsion Chemistry" written by G. F. Duffin (published by Focal Press Co., Ltd., 1966), and "Making and Coating Photographic Emulsion" written by V. L. Zelikman, (published by Focal Press Co., Ltd., 1964). That is, any of an acid method, a neutral method and an ammonia method may be used.

Any of a single jet method, a double jet method and the combination thereof may be used as the method for reacting a water soluble silver salt with a water soluble halide. There can be used as well the method in which the grains are formed in the presence of excess silver ions (a so-called reverse mixing method). There can be used as one form of the double jet method, the method in which the pAg of the solution in which the silver halide grains are formed is maintained constant, that is, a so-called controlled double jet method. A silver halide emulsion having a regular crystal form and an almost uniform grain size can be obtained with this method.

A different kind of a metal ion or complex ion thereof is preferably incorporated into the localized phase or substrate of the silver halide grains according to the present invention. The preferred metal is selected from the metal ions or metal complexes belonging to the VIII group and IIb group, a lead ion, and a thallium ion. For the localized phase, mainly ions or complex ions thereof selected from iridium, rhodium and iron, and for the substrate, mainly the metal ions or complex ions thereof selected from osmium, iridium, rhodium, platinum, ruthenium, palladium, cobalt, nickel, and iron in combination thereof can be used. The metal ions, the kinds and concentrations of which are different in the localized phase and substrate, can be used. Plural kinds of these metals may be used. In particular, the iron and iridium compounds may be present preferably in the silver bromide-localized phase.

These metal ion-providing compounds are incorpo-rated into the localized phase and/or other grain portions (substrate) by means of adding to a gelatin aqueous solution which is a dispersant, a halide aqueous solution, a silver salt aqueous solution or other aqueous solutions in the formation of the silver halide grains, or adding in the form of a silver halide fine grain into which the metal ion is incorporated in advance and dissolving this fine grain.

The metal ions used in the present invention can be incorporated into the emulsion grains before a grain formation, during the grain formation or immediately after the grain formation. This can be changed according to what position of the grain the metal ion is incorporated into.

The silver halide emulsion used in the present invention is usually subjected to chemical sensitization and spectral sensitization.

There can be used singly or in combination as the chemical sensitization, a chemical sensitization in which a chalcogen sensitizer is used (for example, a sulfur sensitization represented by the addition of an unstable sulfur compound, a selenium sensitization with a selenium compound, and a tellurium sensitization with a tellurium compound), a noble metal sensitization represented by a gold sensitization, and a reduction sensitization. Those described in the right lower column at page 18 to the right upper column at page 22 of JP-A-62-215272 are preferably used as the compound for the chemical sensitization.

The effect given by the constitution of the light-sensitive material according to the present invention is more notable than that given by the light-sensitive material in which a high silver chloride emulsion subjected to gold sensitization is used.

The emulsion used in the present invention is a so-called surface latent image type emulsion in which a latent image is formed primarily on a grain surface.

Various compounds or precursors thereof can be added to the silver halide emulsion used in the present invention for the purposes of preventing fog or stabilizing the photographic performances at a production process and during storage or photographic processing. Those compounds described at pages 39 to 72 of the above JP-A-62-215272 are preferably used as examples of these compounds. Further, the 5-arylamino-1,2,3,4-thiatriazole compound (the aryl residue has at least one electron attractive group) described in European patent EP 0,447,647 is preferably used as well.

A spectral sensitization is carried out for the purpose of providing the emulsions contained in the respective layers of the light-sensitive material of the present invention with spectral sensitivities in the prescribed wavelength regions.

In the light-sensitive material of the present invention, spectral sensitizing dyes used for the spectral sensitization in the blue, green and red regions include the compounds described in, for example, "Heterocyclic Compounds—Cyanine Dyes and Related Compounds" written by F. M. Harmer (published by John Wiley & Sons, New York, London, 1964). Those described in the right upper column at page 22 to page 38 of the above JP-A-62-215272 are preferably used as examples of the compounds and the spectral sensitizing method. In particular, the spectral sensitizing dyes described in JP-A-3-123340 are greatly preferred as the red-sensitive spectral sensitizing dye for the silver halide emulsion grains having a high silver chloride content from the viewpoint of stability, the strength of adsorption and temperature dependency in an exposure.

In the case where the spectral sensitization in an infrared region is efficiently carried out in the light-sensitive material of the present invention, preferably used are the sensitizing dyes described in the left upper column at page 12 to the left lower column at page 21 of JP-A-3- 15049, in the left lower column at page 4 to the left lower column at page 15 of JP-A-3-20730, on the 21st line at page 4 to the 54th line at page 6 of European patent EP 0,420,011, on the 12th line at page 4 to the 33rd line at page 10 of European patent EP 0,420,012, and in European patent EP 0,443,466 and U.S. Pat. No. 4,975,362.

In order to incorporate these spectral sensitiz-ing dyes into a silver halide emulsion, they may be dispersed directly in the emulsion, or may be dissolved in a single solvent or mixed solvent such as water, methanol, ethanol, propanol, methyl cellosolve, and 2,2,3,3-tetrafluoropropanol to add it to the emulsion. Also, as described in JP-B-44- 23389 JP-B-44-27555 and JP-B-57-22089, they may be dissolved in water in the presence of an acid or a base, and as described in U.S. Pat. Nos. 3,822,135 and 4,006,025, an aqueous solution or colloid dispersion which is prepared in the presence of a surface active agent may be added to the emulsion. Further, after dissolving in a solvent which is substantially immiscible with water, such as phenoxyethanol, the solution may be dispersed in water or a hydrophilic colloid to add it to the emulsion. As described in JP-A-53-102733 and JP-A-58-105141, the dispersion, which is prepared by dispersing the dyes directly in a hydrophilic colloid, may be added to the emulsion.

The time of addition of the sensitizing dyes to the emulsion may be at any step in preparing the emulsion, which is known to be effective. That is, it can be before the grain formation of the silver halide emulsion, during the grain formation, from immediately after the grain formation to before proceeding to a washing step, before chemical sensitization, during the chemical sensitization, from immediately after the chemical sensitization to the solidification of the emulsion by cooling, and in the preparation of a coating solution. Usually, it is carried out at the period of from after the completion of the chemical sensitization to before coating. However, as described in U.S. Pat. Nos. 3,628,969 and 4,225,666, the dyes can be added at the same period as the chemical sensitization to carry out the spectral sensitization simultaneously with the chemical sensitization. Also, as described in JP-A-58- 113928, the spectral sensitization can be carried out prior to the chemical sensitization. The sensitizing dyes can be added before completing the preparation of the silver halide grains to start the spectral sensitization. Further, as taught in U.S. Pat. No. 4,225,666, a divided sensitizing dye can be added as well, that is, a part thereof is added prior to the chemical sensitization and the rest is added after the chemical sensitization. The addition of the spectral sensitizing dyes may be at any period during the formation of the silver halide grains as well as the method taught in U.S. Pat. No. 4,183,756. Among them, particularly preferred is the addition of the sensitizing dyes before a washing step for the emulsion or before the chemical sensitization.

The addition amount of these spectral sensitizing dyes is extended over a wide range according to need. It is preferably about $0.5\times10^{-6}$ to $1.0\times10^{-2}$ mole, more preferably about $1.0\times10^{-6}$ to $5.0\times10^{-3}$ mole per mole of silver halide.

In the present invention, in the case where the sensitizing dye having a spectral sensitization sensitivity particularly in a red region to an infrared region is used, the compounds described in the right lower column at page 13 to the right lower column at page 22 of JP-A-2-157749 are preferably used in combination. The use of these compounds can increase storage performance, stability in processing and the supersensitization effect of a light-sensitive material.

Above all, the compounds of formulas (IV), (V) and (VI) in the above patent are particularly preferably used in combination. These compounds are used in an amount of about $0.5\times10^{-5}$ to $5.0\times10^{-2}$ mole, preferably about $5.0\times10^{-5}$ to $5.0\times10^{-3}$ mole per mole of silver halide, and the advantageous amount thereof is about 0.1 to 10000 times, preferably about 0.5 to 5000 times per mole of the sensitizing dye.

The light-sensitive material according to the present invention is used not only for a print system in which a conventional negative printer is used but also preferably for a digital scanning exposure in which there is used a single color high density light such as a gas laser, a light emitting diode, a semiconductor laser, or the second higher harmonics generating light source (SHG) consisting of the combination of the semiconductor laser or a solid state laser in which the semiconductor laser is used for an excitation light source with a non-linear optical crystal. In order to make the system compact and inexpensive, a semiconductor laser, or second higher harmonics generating light source (SHG) consiting of the combination of the semiconductor laser or a solid state laser with a non-linear optical crystal is preferably used. In particular, in order to design compact and inexpensive equipment having a long life and high stability, the semiconductor laser is preferably used, and the semiconductor laser is preferably used for at least one of the exposing light sources.

In the case where such a scanning exposing light source is used, the spectral sensitivity maximum of the light-sensitive material according to the present invention can arbitrarily be set according to the wavelength of the scanning exposing light source used. In the SHG light source obtained by combining the solid state laser in which the semiconductor laser is used for an excitation light source or the semiconductor laser with the non-linear optical crystal, a blue light and a green light can be obtained, since the oscillation wavelength of the laser can be cut to a half. Accordingly, it is possible to allow the spectral sensitivity maximus of the light-sensitive material to fall within the three conventional ranges of blue, green and red.

In order to use the semiconductore laser as the light source for making the equipment inexpensive, highly stable and compact, at least two layers preferably have the spectral sensitivity maximums in the range of 670 nm or more. This is because the light emitting wavelength of the commercially available, inexpensive and stable III–V Group series semiconductor laser ranges only in a red to infrared region. However, the emitting of a II–VI Group series semiconductor laser in the green and blue regions is confirmed at a laboratory, and it can be expected well that the progress in the manufacturing technique of the semiconductor laser would enable inexpensive and stable use of these semiconductor lasers. In this case, it is less necessary that at least two layers have the spectral sensitivity maximums in 670 nm or more.

In the scanning exposure, the time when silver halide contained in a light-sensitive material is exposed is the time necessary to expose some minute area. The minimum unit for controlling quantity of light in the respective digital data is generally used as this minute area and called a picture element. Accordingly, an exposing time per picture element is varied according to the size of this picture element. The size of this picture element depends on a picture element density and the practical range thereof is 50 to 2000 dpi. The exposing time is preferably $10^{-4}$ second or less, more preferably $10^{-6}$ second or less, wherein the exposing time is defined by the time for exposing a picture lement size on the assumption that this picture element desnity is 400 dpi.

For the purpose of preventing irradiation and halation and for improving safelight safety, preferably added to a hydrophilic colloid layer are the dyes (above all, an oxonol dye and a cyanine dye) capable of being decolored by processing, described at pages 27 to 76 of European Patent EP 0337490A2.

The dyes in which the increase in the amounts used deteriorates color separation and safelight safety are included in these water soluble dyes. The water soluble dyes described in EP 0539978A1, JP-B-5-127325, and JP-B-5-127324 are preferred as the dye capable of being used without deteriorating the color separation.

In the present invention, a coloring layer capable of being decolored by processing is used in place of or in combination with water soluble dyes. The coloring layer capable of being decolored by processing used either may contact directly an emulsion layer or may be provided so that it contacts the emulsion layer via an intermediate layer containing gelatin and an anti-color mixing agent such as hydroquinone. This coloring layer is preferably provided below (a support side) the emulsion layer coloring to the same kind of an elementary color as that of the colored color thereof. It is possible either to independently provide all of the coloring layers corresponding to the respective elementary colors or to arbitrarily select only a part thereof to provide it. Further, it is possible as well to provide the coloring layer colored so that it corresponds to a plurality of the elementary color regions. In the optical reflection density in the coloring layer, the optical density value in the wavelength in which the optical density is the highest in a wavelength region used for an exposure (the visible ray region of 400 to 700 nm in case of a usual printer exposure and the wavelength of a scanning exposure light source in case of a scanning exposure) is 0.2 or more and 3.0 or less, more preferably 0.5 or more and 2.5 or less, and particularly preferably 0.8 or more and 2.0 or less.

Publicly known methods can be applied to form the coloring layer. They include, for example, the method in which the dyes are incorporated into a hydrophilic colloid layer in the form of a solid fine particle dispersion as is the case in the dyes described in a right upper column at page 3 to page 8 of JP-A-2-282244 and the dyes described in a right upper column at page 3 to a left lower column at page 11 of JP-A-3-7931, the method in which an anionic dye is mordanted to a cationic polymer, the method in which a dye is adsorbed on a fine particle of silver halide to fix it in a layer, and the method in which colloidal silver is used as described in JP-A-1-239544. There is described at pages 4 to 13 of JP-A-2-308244 as the method in which the fine powder of the-dye is dispersed in the form of a solid matter, for example, the method in which there is incorporated a fine powder dye which is substantially insoluble in water at least at pH 6 or lower but substantially soluble in water at least at pH 8 or higher. Further, the method in which the anionic dye is mordanted to the cationic polymer is described at pages 18 to 26 of JP-A-2-84637. The method for preparing colloidal silver as a photoabsorbing agent is disclosed in U.S. Pat. Nos. 2,688,601 and 3,459,563. Of these methods, preferred are the method in which the fine powder dye is incorporated and the method in which colloidal silver is used.

Gelatin is advantageously used as the binder or protective colloid which can be used for the light-sensitive material according to the present invention, and the other hydrophilic colloids can be used as well singly or together with gelatin. Low calcium gelatin having the calcium content of about 800 ppm or less, more preferably about 200 ppm or less is preferably used. Further, the anti-mold agents described in JP-A-63-271247 are preferably added in order to prevent various molds and fungi which grow in a hydrophilic colloid layer to deteriorate an image.

In subjecting the light-sensitive material according to the present invention to a printer exposure, the band stop filter described in U.S. Pat. No. 4,880,726 is preferably used, whereby a light mixture is removed to notably improve color reproduction.

An exposed light-sensitive material can be subjected to a conventional color development process-ing. In case of the color light-sensitive material of the present invention, it is preferably subjected to a bleach-fixing processing following the color development for the purpose of a rapid processing. In particular, in the case where the above high silver chloride emulsion is used, pH of the bleach-fixing solution is preferably about 6.5 or less, more preferably about 6 or less for the purpose of accelerating desilver.

Those described in the following patent publications, particularly European Patent EP 0,355,660A2 (JP-A-2-139544) are preferably used as the silver halide emulsions, other materials (the additives) and photographic constitutional layers (a layer arrangement) each applied to the light-sensitive material according to the present invention, and the processing methods and the additives for processing, which are applied for processing this light-sensitive material:

| Photographic Element | JP-A 62-215272 | JP-A 2-33144 | EP 0 355 660 A2 |
|---|---|---|---|
| Silver Halide Emulsions | From page 10, right upper column, line 6 to page 12, left lower column, line 5; and from page 12, right lower column, line 4 to page 13, left upper column, line 17 | From page 28, right upper column, line 16 to page 29, right lower column, line 11; and page 30, lines 2 to 5 | From page 45, line 53 to page 47, line 3; and page 47, lines 20 to 22 |
| Silver Halide Solvents | Page 12, left lower column, lines 6 to 14; and from page 13, left upper column, line 3 from below to page 18, left lower column, last line | — | — |
| Chemical Sensitizers | Page 12, from left lower column, line 3 from below to right lower column, line 5 | Page 29, right lower column, line 12 to last line | Page 47, lines 4 to 9 |

-continued

| Photographic Element | JP-A 62-215272 | JP-A 2-33144 | EP 0 355 660 A2 |
|---|---|---|---|
| | from below; and from page 18, right lower column, line 1 to page 22, right upper column, line 9 from below | | |
| Color Sensitizers (Color Sensitizing Methods) | From page 22, right upper column, line 8 from below to page 38, last line | Page 30, left upper column, lines 1 to 13 | Page 47, lines 10 to 15 |
| Emulsion Stabilizers | From page 39, left upper column, line 1 to page 72, right upper column, last line | Page 30, from left upper column, line 14 to right upper column, line 1 | Page 47, lines 16 to 19 |
| Development Promoters | From page 72, left lower column, line 1 to page 91, right upper column, line 3 | — | — |
| Color Couplers (Cyan, Magenta and Yellow Couplers) | From page 91, right upper column, line 4 to page 121, left upper column, line 6 | From page 3, right upper column, line 14 to page 18, left upper column, last line; and from page 30, right upper column, line 6 to page 35, right lower column, line 11 | Page 4, lines 15 to 27; from page 5, line 30 to page 28, last line; page 45, lines 29 to 31; and from page 47, line 23 to page 63, line 50 |
| Coloring Enhancers | From page 121, left lower column, line 7 to page 125, right upper column, line 1 | — | — |
| Ultraviolet Absorbents | From page 125, right upper column, line 2 to page 127, left lower column, last line | From page 37, right lower column, line 14 to page 38, left upper column, line 11 | Page 65, lines 22 to 31 |
| Anti-Fading Agents (Color Image Stabilizers) | From page 127, right lower column, line 1 to page 137, left lower column, line 8 | From page 36, right upper column, line 12 to page 37, left upper column, line 19 | From page 4, line 30 to page 5, line 23; from page 29, line 1 to page 45, line 25; page 45, lines 33 to 40; and page 65, lines 2 to 21 |
| High Boiling Point and/or Low Boiling Point Organic Solvents | From page 137, left lower column, line 9 to page 144, right upper column, last line | From page 35, right lower column, line 14 to page 36, left upper column, line 4 from below | Page 64, lines 1 to 51 |
| Dispersing Methods of Photographic Additives | From page 144, left lower column, line 1 to page 146, right upper column, line 7 | From page 27, right lower column, line 10 to page 28, left upper column, last line; and from page 35, right lower column, line 12, to page 36, right upper column, line 7 | From page 63, line 51 to page 64, line 56 |
| Hardening Agents | From page 146, right upper column, line 8 to page 155, left lower column, line 4 | — | — |
| Developing Agent Precursors | Page 155, from left lower column, line 5 to right lower column, line 2 | — | — |
| Development Inhibitor Releasing Compounds | Page 155, right lower column, lines 3 to 9 | — | — |
| Constitution of Photographic Layers | Page 156, from left upper column, line 15 to right lower column, line 14 | Page 28, right upper column, lines 1 to 15 | Page 45, lines 41 to 52 |
| Dyes | From page 156, right lower column, line 15 to page 184, right lower column, last line | Page 38, from left upper column, line 12 to right upper column, line 7 | Page 66, lines 18 to 22 |
| Color Mixing Preventing Agents | From page 185, left upper column, line 1 to page 188, right lower column, line 3 | Page 36, right upper column, lines 8 to 11 | From page 64, line 57 to page 65, line 1 |
| Gradation Adjusting Agents | Page 188, right lower column, lines 4 to 8 | — | — |
| Stain Inhibitors | From page 188, right lower column, line 9 to page 193, right lower column, line 10 | Page 37, from left upper column, last line to right lower column, line 13 | From page 65, line 32 to page 66, line 17 |
| Surfactants | From page 201, left lower column, line 1 to page 210, right upper column, last one | From page 18, right upper column, line 1 to page 24, right lower column, last line; and page 27, from left lower column, line 10 from below to right lower column, line 9 | — |
| Fluorine-Containing Compounds (as antistatic agents, coating aids, lubricants, and anti-blocking agents) | From page 210, left lower column, line 1 to page 222, left lower column, line 5 | From page 25, left upper column, line 1 to page 27, right upper column, line 9 | — |
| Binders (hydrophilic colloids) | From page 222, left lower column, line 6 to page 225, | Page 38, right upper column, lines 8 to 18 | Page 66, lines 23 to 28 |

-continued

| Photographic Element | JP-A 62-215272 | JP-A 2-33144 | EP 0 355 660 A2 |
|---|---|---|---|
| | left upper column, last line | | |
| Tackifiers | From page 225, right upper column, line 1 to page 227, right upper column, line 2 | — | — |
| Antistatic Agents | From page 227, right upper column, line 3 to page 230, left upper column, line 1 | — | — |
| Polymer Latexes | From page 230, left upper column, line 2 to page 239, last line | — | — |
| Mat Agents | Page 240, from left upper column, line 1 to right upper column, last line | — | — |
| Photographic Processing Methods (Processing steps and additives) | From page 3, right upper column, line 7 to page 10, right upper column, line 5 | From page 39, left upper column, line 4 to page 42, left upper column, last line | From page 67, line 14 to page 69, line 28 |

The citation to JP-A-62-215272 includes the letter of amendment filed on March 16, 1987.

The cyan, magenta and yellow couplers are preferably impregnated in a loadable latex polymer (for example, U.S. Pat. No. 4,203,716) or dissolved together with a water insoluble and organic solvent soluble polymer under the presence (or absence) of the organic high boiling solvent described in the above tables to emulsify and disperse them in a hydrophilic colloid aqueous solution.

There can be enumerated as the water insoluble and organic solvent soluble polymer which can be preferably used, the homopolymers or copolymers described in the 7th to 15th columns of U.S. Pat. No. 4,857,449 and at pages 12 to 30 of International Patent Publication WO88/00723. A methacrylate series or acrylamide series polymer, particularly the acrylamide series polymer is preferably used in order to stabilize the dye image.

The color image preservability-improving compounds described in European Patent EP 0,277,589A2 are preferably used for the light-sensitive material according to the present invention together with a coupler. In particular, they are used preferably in combination with a pyrazoloazole coupler, a pyrrolotriazole coupler and the yellow coupler according to the present invention.

That is, further preferably used simultaneously or singly for preventing side effects of, for example, the generation of stain due to the reaction of a color developing agent or the oxidation product thereof remained in a layer during a storage after processing with a coupler are the compounds which are chemically combined with an aromatic amine series developing agent remained after a color development processing to form a chemically inactive and substantially colorless com-pound, and/or the compounds which are chemically combined with the oxidation product of an aromatic amine series developing agent remained after the color development processing to form a chemically inactive and substantially colorless compound.

Preferably used as a cyan coupler in addition to the diphenylimidazole series cyan couplers described in JP-A-2-33144 are the 3-hydroxypyridine series cyan couplers described in European Patent EP 0,333,185A2 (of them, particularly preferred are the coupler prepared by providing the tetra-equivalent coupler (42) exemplified as the concrete example with a chlorine splitting group to convert it to a divalent coupler, and the couplers (6) and (9)), and the cyclic active methylene series cyan couplers described in JP-A-64-32260 (of them, particularly preferred are the couplers 3, 8 and 34 which are exemplified as the concrete example), the pyrrolopyrazole type cyan couplers described in European Patent EP 0,456,226A1, the pyrroloimidazole type cyan couplers described in European Patent EP 0,484,909, and the pyrrolotriazole type cyan couplers described in European Patents EP 0,488,248 and EP 0,491,197A1. Of them, the pyrrolotriazole type cyan couplers are particularly preferably used.

There can be used as the magenta coupler used in the present invention, the 5-pyrazolone series magenta couplers and pyrazoloazole series magenta couplers described in the publicly known literatures shown in the above tables. Of them, preferably used in terms of a hue, an image stability and a color development are the pyrazolotriazole couplers in which a secondary or tertiary alkyl group is connected directly to the 2-, 3- or 6-position in a pyrazolotriazole ring, described in JP-A-61-65245, the pyrazoloazole couplers containing a sulfonamide group in the molecule, described in JP-A-61-65246, the pyrazoloazole couplers having an alkoxyphenylsulfonamide ballast group, described in JP-A-61-147254, and the pyrazoloazole couplers having an alkoxy group or aryloxy group at a 6-position, described in European Patents 226,849A and 294,785A.

The 5-pyrazolone series magenta couplers in which arylythio is splitted off, described in International Patent Publications WO92/18901, WO92/18902 and WO92/18903 are preferred as a 5-pyrazolone series magenta coupler in terms of an image preservablity and less fluctuation in an image quality.

The publicly known pivaloyl couplers which are not included in the present invention can be enumerated as the coupler which can be used in combination with the yellow coupler of the present invention. In this case, the amount of the pivaloyl coupler used in combination is preferably 50 mole % or less based on the whole amount of the yellow couplers from the viewpoint of a color reproduction performance.

In addition to the methods described in the above tables, preferred as the processing method for the color light-sensitive material of the present invention are the processing materials and processing methods described on the 1st line of a right lower column at page 26 to the 9th line of a right upper column at page 34 of JP-A-2-207250, and on the 17th line of a left upper column at page 5 to the 20th line of a right lower column at page 18 of JP-A-4-97355.

EXAMPLES

The present invention will be explained below with reference to the examples, but the invention is not limited thereto. Unless otherwise indicated, amounts are by weight.

EXAMPLE 1

A paper support laminated on the both sides thereof with polyethylene, which was subjected to a corona discharge treatment, was provided with a gelatin subbing layer containing sodium dodecylbenzenesulfonate (Support 6) and further was coated with the various photographic constitutional layers, whereby the multi-layered color photographic paper (Sample 101) having the following layer constitution was prepared. The coating solutions were prepared in the following manner.

Preparation of the First Layer Coating Solution 130.0 g of the yellow coupler (ExY), 32.0 g of the dye image stabilizer (Cpd-1), 64.0 g of the dye image stabilizer (Cpd-2), and 8.0 g of the dye image stabilizer (Cpd-3) were dissolved in 30 g of the solvent (Solv-1), 30 g of the solvent (Solv-2) and 180 ml of ethyl acetate, and this solution was emulsified and dispersed in 1000 g of a 10% gelatin aqueous solution containing 60 ml of a 10% sodium dodecylbenzenesulfonate aqueous solution and 10 g of citric acid, to thereby prepare the emulsified dispersion A. Meanwhile, a silver chlorobromide emulsion A (cube, 3:7 mixture (Ag mole ratio) of a large size emulsion A with an average grain size of 0.88 μm and a small size emulsion A with an average grain size of 0.70 μm, wherein the fluctuation coefficients in the grain size distributions were 0.08 and 0.10, respectively, and both size emulsions comprised grains in which 0.3 mol % silver bromide was localized on a part of the grain surface and the rest was silver chloride) was prepared. The blue-sensitive sensitizing dyes A and B shown below were added to this emulsion in the amounts of $2.0\times10^{-4}$ mole per mole of silver to the large size emulsion A and $2.5\times10^{-4}$ mole per mole of silver to the small size emulsion A, respectively. Then, this emulsion was subjected to chemical sensitization by adding a sulfur sensitizer and a gold sensitizer. The foregoing emulsified dispersion A and this silver chlorobromide emulsion A were mixed and dissolved, whereby the first layer coating solution was prepared so that it was of the following composition as shown in the layer constitution below.

Preparation of the Second to Seventh Layer Coating Solutions

The coating solutions for the second layer to seventh layer were prepared in the same manner as that used for the first layer coating solution. Sodium 1-oxy-3,5-dichloro-s-triazine was used as a gelatin hardener for the respective layers.

Further, Cpd-14 and Cpd-15 were added to the respective layers so that the amounts thereof became 25.0 mg/m$^2$ and 50.0 mg/m$^2$, respectively.

The following spectral sensitizing dyes were used for the silver chlorobromide emulsions contained in the respective light-sensitive emulsion layers:

Blue-Sensitive Emulsion Layer

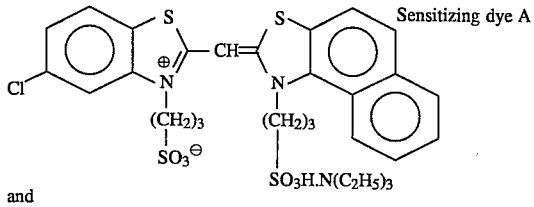

and

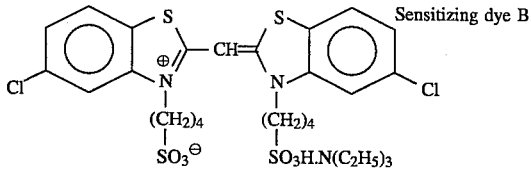

($2.0\times10^{-4}$ mole of each per mole of silver halide was added to the large size emulsion, and $2.5\times10^{-4}$ mole of each per mole of silver halide was added to the small size emulsion).

Green-Sensitive Emulsion Layer

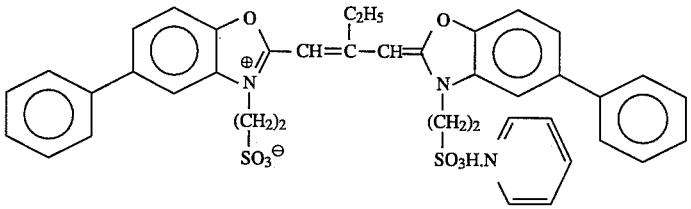

Sensitizing dye C ($4.0\times10^{-4}$ mole per mole of silver halide was added to the large size emulsion, and $5.6\times10^{-4}$ mole per mole of silver halide was added to the small size emulsion)

Sensitizing dye D

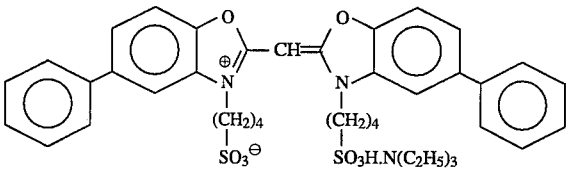

($7.0\times10^{-5}$ mole per mole of silver halide was added to the large size emulsion, and $1.0\times10^{-4}$ mole per mole of silver halide was added to the small size emulsion).

Red-Sensitive Emulsion Layer

Sensitizing dye E

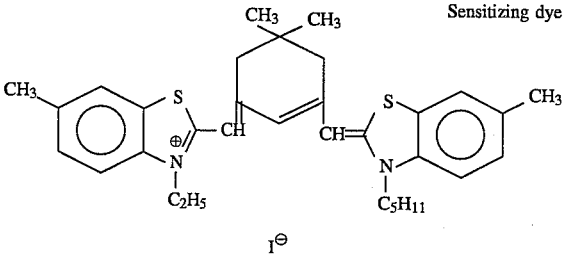

($1.0\times10^{-4}$ mole per mole of silver halide was added to the large size emulsion, and $1.2\times10^{-4}$ mole per mole of silver halide was added to the small size emulsion)

Further, the following compound was added in the amount of $2.6\times10^{-3}$ mole per mole of silver halide:

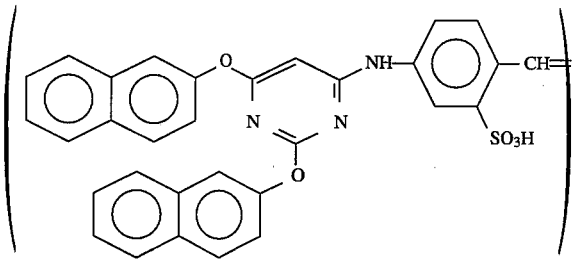

Further, 1-(5-methylureidophenyl)-5-mercaptotetrazole was added to the blue-sensitive emulsion layer, the green-sensitive emulsion layer and the red-sensitive emulsion layer in the amounts of $8.5\times10^{-3}$ mole, $7.7\times10^{-4}$ mole and $2.5\times10^{-4}$ mole per mole of silver halide, respectively.

Further, 4-hydroxy-6-methyl-1,3,3a,7-tetrazaindene was added to the blue-sensitive emulsion layer and the green-sensitive emulsion layer in the amounts of $1\times10^{-4}$ mole and $2\times10^{-4}$ mole per mole of silver halide, respectively.

Layer Constitution

The compositions of the respective layers are shown below. The numerals represent the coated amounts ($g/m^2$). The coated amounts of the silver halide emulsions are expressed in terms of the amounts converted to silver.

| | |
|---|---|
| Support: | |
| Polyethylene-laminated paper [polyethylene coated on the 1st layer side contained 14 weight % of 1 white pigment (titanium oxide) and a blue dye (ultramarine)]. | |
| First layer (a blue-sensitive emulsion layer): | |
| Above silver chlorobromide emulsion | 0.30 |
| Gelatin | 1.46 |
| Yellow coupler (ExY) | 0.65 |
| Dye image stabilizer (Cpd-1) | 0.16 |
| Dye image stabilizer (Cpd-2) | 0.32 |
| Dye image stabilizer (Cpd-3) | 0.04 |
| Solvent (Solv-1) | 0.15 |
| Solvent (Solv-2) | 0.15 |
| Second layer (an anti-color mixing layer): | |
| Gelatin | 1.10 |
| Anti-color mixing agent (Cpd-4) | 0.10 |
| Solvent (Solv-7) | 0.05 |
| Solvent (Solv-2) | 0.25 |
| Solvent (Solv-3) | 0.25 |
| Third layer (a green-sensitive emulsion layer): | |
| Silver chlorobromide emulsion (cube, 1:3 mixture (Ag mole ratio) of a large size emulsion B having an average grain size of 0.55 μm and a small size emulsion B having an average grain size of 0.39 μm, wherein the fluctuation coefficients in the grain size distributions were 0.10 and 0.08, respectively, and both size emulsions comprised grains in which 0.8 mol % silver bromide was localized on a part of the grain surface and the rest was silver chloride) | 0.13 |
| Gelatin | 1.45 |
| Magenta coupler (ExM) | 0.18 |
| Dye image stabilizer (Cpd-5) | 0.15 |
| Dye image stabilizer (Cpd-2) | 0.03 |
| Dye image stabilizer (Cpd-6) | 0.01 |
| Dye image stabilizer (Cpd-7) | 0.01 |
| Dye image stabilizer (Cpd-8) | 0.08 |
| Solvent (Solv-3) | 0.50 |
| Solvent (Solv-4) | 0.15 |
| Solvent (Solv-5) | 0.15 |
| Fourth layer (an anti-color mixing layer): | |
| Gelatin | 0.80 |
| Anti-color mixing agent (Cpd-4) | 0.08 |
| Solvent (Solv-7) | 0.03 |
| Solvent (Solv-2) | 0.20 |
| Solvent (Solv-3) | 0.20 |
| Fifth layer (a red-sensitive emulsion layer): | |
| Silver chlorobromide emulsion (cube, 1:4 mixture (Ag mole ratio) of a large size emulsion C having an average grain size of 0.50 μm and a small size emulsion C having an average grain size of 0.41 μm, wherein the fluctuation coefficients in the grain size distributions were 0.09 and 0.11, respectively, and both size emulsions comprised grains in which 0.8 mol % silver bromide was localized on a part of the grain surface and the rest was silver chloride) | 0.20 |
| Gelatin | 0.85 |
| Cyan coupler (ExC) | 0.31 |
| UV absorber (UV-2) | 0.18 |
| Dye image stabilizer (Cpd-9) | 0.01 |
| Additive (Cpd-10) | 0.01 |
| Additive (Cpd-11) | 0.01 |
| Solvent (Solv-6) | 0.22 |
| Dye image stabilizer (Cpd-8) | 0.01 |
| Dye image stabilizer (Cpd-6) | 0.01 |
| Solvent (Solv-1) | 0.01 |
| Dye image stabilizer (Cpd-1) | 0.31 |
| Sixth layer (a UV absorbing layer): | |
| Gelatin | 0.55 |
| UV absorber (UV-1) | 0.38 |

-continued

| | |
|---|---|
| Dye image stabilizer (Cpd-12) | 0.15 |
| Dye image stabilizer (Cpd-5) | 0.02 |
| Seventh layer (a protective layer): | |
| Gelatin | 1.13 |
| Acryl-modified copolymer of polyvinyl alcohol (modification degree: 17%) | 0.05 |
| Liquid paraffin | 0.02 |
| Dye image stabilizer (Cpd-13) | 0.01 |

(ExY) Yellow coupler

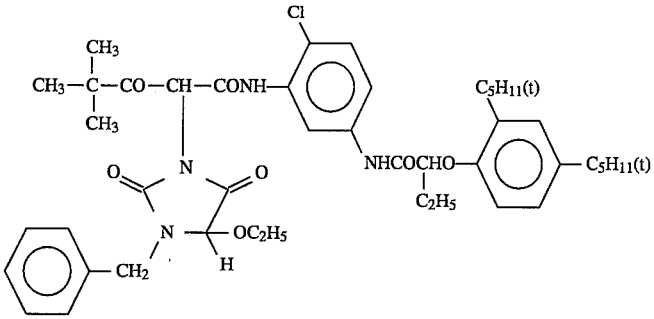

(ExM) Magenta coupler

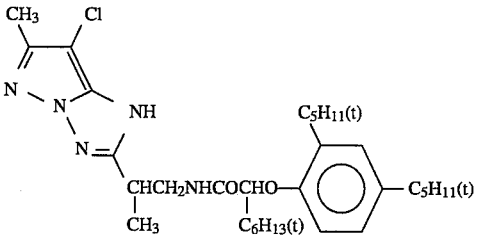

(ExC) Cyan coupler
3:7 mixture (mole ratio) of

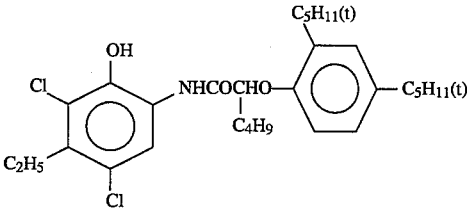

and

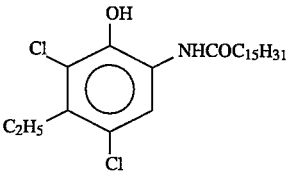

(Cpd-1) Dye image stabilizer $$\left(CH_2-\underset{\underset{CONHC_4H_9(t)}{|}}{CH}\right)_n$$

Average molecular weight: 60,000

(Cpd-2) Dye image stabilizer

-continued
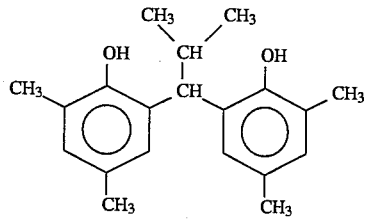
(Cpd-3) Dye image stabilizer
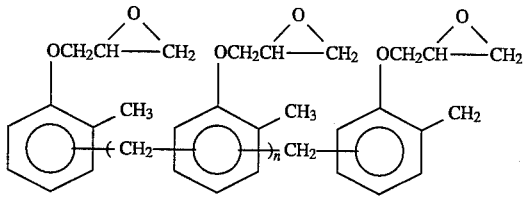
n = 7 to 8 (average value)
(Cpd-4) Anti-color mixing agent
1:1 mixture (weight ratio) of
(1)
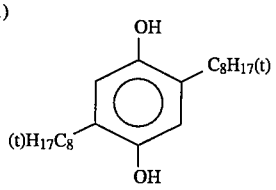
(2)
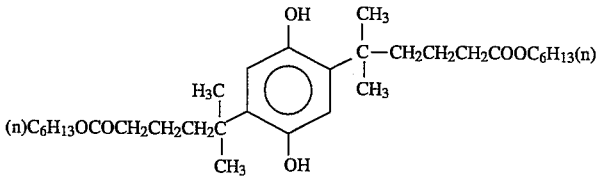
(Cpd-5) Dye image stabilizer
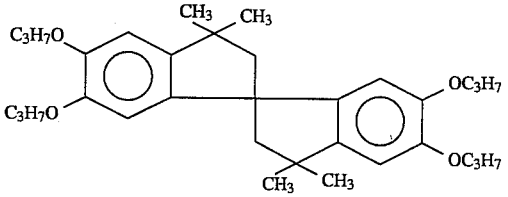
(Cpd-6) Dye image stabilizer
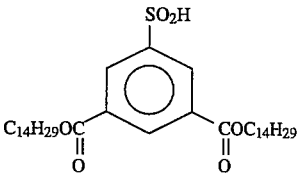
(Cpd-7) Dye image stabilizer
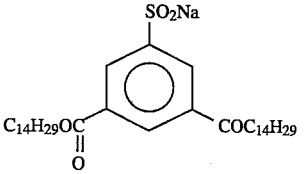
(Cpd-8) Dye image stabilizer -continued
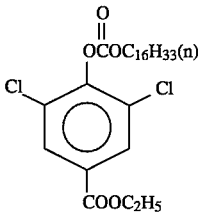
(Cpd-9) Dye image stabilizer
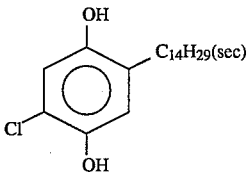
(Cpd-10) Additive
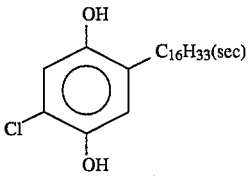
(Cpd-11) Additive
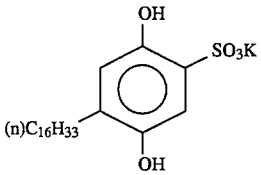
(Cpd-12) Dye image stabilizer
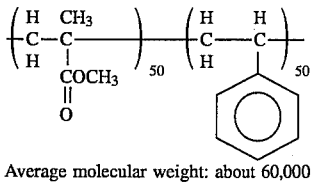
Average molecular weight: about 60,000
(Cpd-13) Dye image stabilizer
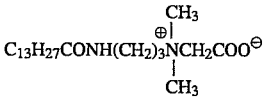
(Cpd-14) Preservative
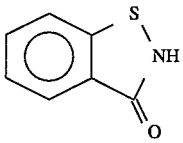
(Cpd-15) Preservative
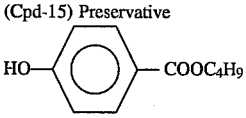
(UV-1) UV absorber
(1)
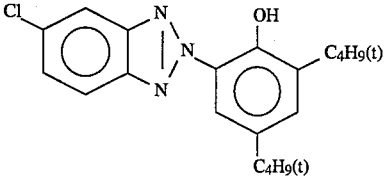
(2)
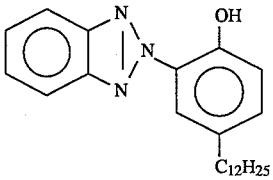
(3)
(4)

-continued

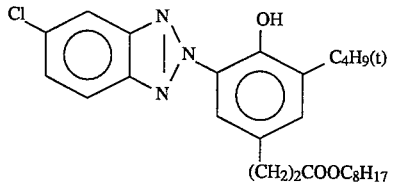

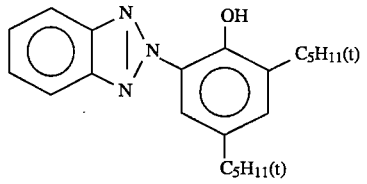

1:5:10:5 mixture (weight ratio) of (1), (2), (3) and (4)

(UV-2) UV absorber (1)

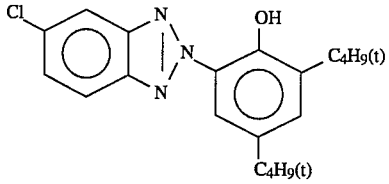

(2)

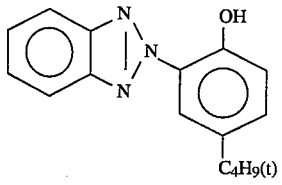

(3)

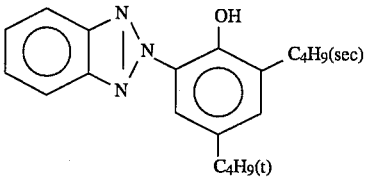

1:2:2 mixture (weight ratio) of (1), (2) and (3)

Solvent (Solv-1)

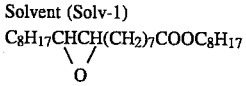

Solvent (Solv-2)

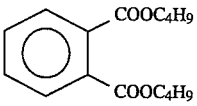

Solvent (Solv-3)

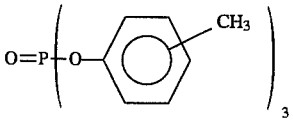

Solvent (Solv-4)

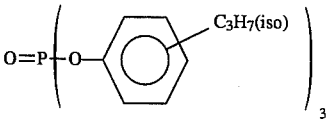

Solvent (Solv-5)

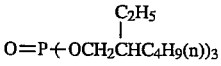

Solvent (Solv-6)

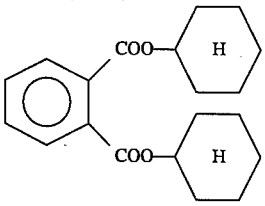

Solvent (Solv-7)

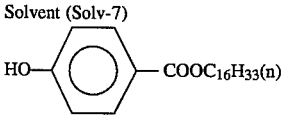

Samples 102 to 103 were prepared in the same manner as that used for Sample 101 thus prepared except that the yellow coupler contained in the first layer (the blue-sensitive layer) was replaced with the couplers shown in following Table A-1 in the same mole amount.

Next, Samples 104 to 114 were prepared in the same manner as that used for Sample 101, except that the support was replaced with Supports 1 to 5 and the yellow coupler was replaced with the couplers shown in Table-A in the same mole amount.

Supports 1 to 5 were prepared in the following manner.

Preparation of Base Paper

A mixture of wood pulp (LBKP/NBSP=2/1) was beaten to prepare a pulp slurry having a Canadian freeness of 250 ml.

Next, this pulp slurry was diluted with water, and then 1.0% anionic polyacrylamide (Polystron 195 having the molecular weight of about 1.10 million, manufactured by Arakawa Rinsan Co., Ltd.), 1.0% aluminium sulfate, and 0.15 polyamidepolyamineepichlorohydrin (Kaimen 557, manufactured by DIC Hercules Co., Ltd.) based on the amount of the pulp were added thereto. Further, after adding 0.4 weight % each of epoxidized behenic amide and an alkylketene dimer (a compound in which the alkyl group was $C_{20}H_{41}$) based on the weight of the pulp, 0.5% each of sodium hydroxide and cationic polyacrylamide and 0.1% of a defoaming agent were added so that pH became 7. The pulp slurry thus prepared was subjected to paper making to 180 g/m$^2$.

The base paper thus prepared was adjusted to a water content of about 2% in an oven and then was subjected to a size press with an aqueous solution having the following composition as a surface sizing solution to thereby coat the solution so that the coated amount thereof became 20 g/m$^2$ on the surface (photographic emulsion-coated side) of the base paper.

| | |
|---|---|
| Polyvinyl alcohol | 4.0% |
| calcium chloride | 4.0% |
| Fluorescent whitening agent | 0.5% |
| Defoaming agent | 0.005% |

The thickness of the sizing solution-coated paper thus obtained was adjusted to 180 μm with a machine calender to thereby prepare the base paper.

Preparation of Support

A mixed composition of polyester (limiting viscosity: 6.5, average molecular weight: about 40,000) synthesized by the polycondensation of the dicarboxylic acid composition shown in Table 33 and ethylene glycol or polyethylene, and titanium oxide (KA-10 manufactured by Titan Kogyo Co., Ltd.) was melted and mixed with a double-shaft mixing extruder at 300° C., followed by melting and extruding the mixture from a T die on the surface of the base paper with the thickness of 180 μm to thereby form a laminate layer with a thickness of 30 μm. A calcium carbonate-containing resin composition was melted and extruded on the other side at 300° C. to thereby form a laminate layer with a thickness of 30 μm. The resin surface on the side of the support on which an emulsion was to be coated was subjected to a corona discharge treatment, and then a subbing solution having the following composition was coated thereon to 5 ml/m$^2$, followed by drying at 80° C. for 2 minutes, whereby the photographic supports 1 to 5 were obtained.

| Composition of subbing solution: | |
|---|---|
| Compound ExU1 | 0.2 g |
| Compound ExU2 | 0.001 g |
| $H_2O$ | 35 ml |
| Methanol | 65 ml |
| Gelatin | 2 g |
| pH | 9.5 |

TABLE 33

| Support | Resin (dicarboxylic acid composition of polyester: mole ratio) | $TiO_2$ (wt %) |
|---|---|---|
| 1 (Inv.) | Polyester (terephthalic acid: 100) | 20 |
| 2 (Inv.) | Polyester (terephthalic acid/isophthalic acid: 90/10) | 20 |
| 3 (Inv.) | Polyester (terephthalic acid/isophthalic acid: 50/50) | 20 |
| 4 (Inv.) | Polyester (terephthalic acid/naphthalene-dicarboxylic acid: 90/10) | 20 |
| 5 (Inv.) | Polyester (terephthalic acid/naphthalene-dicarboxylic acid: 50/50) | 20 |
| 6 (Comp.) | Polyethylene | 15 |

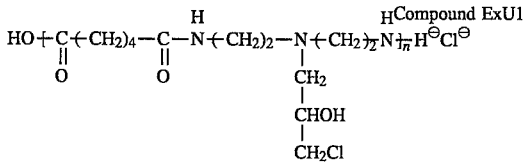

Compound ExU1

Compound ExU2

First, Samples 101 to 103 were subjected to exposure with a sensitometer (Model FWH, color temperature of light source: 3200° K., manufactured by Fuji Photo Film Co., Ltd.) so that about 30% of the coated silver amount was developed and gray was given.

The above samples were subjected to 250 m$^2$ continuous processing with a paper processing machine using the following processing steps in processing solutions of the following compositions.

| Processing step | Temperature | Time | Replenishing amount* | Tank capacity |
|---|---|---|---|---|
| Color developing | 38.5° C. | 45 seconds | 161 ml | 10 1 |
| Bleach/fixing | 35° C. | 45 seconds | 218 ml | 10 1 |
| Rinsing (1) | 35° C. | 30 seconds | — | 5 1 |
| Rinsing (2) | 35° C. | 30 seconds | — | 5 1 |
| Rinsing (3) | 35° C. | 30 seconds | 360 ml | 5 1 |
| Drying | 80° C. | 60 seconds | | |

*Replenishing amount per m$^2$ of the light sensitive material.
(Rinsing was with a three tank countercurrent system from Rinsing (3) to Rinsing (1))

The compositions of the respective processing solutions were as follows:

| Color developing solution | Tank solution | Replenishing solution |
|---|---|---|
| Water | 800 ml | 800 ml |
| Ethylenediaminetetraacetic acid | 3.0 g | 3.0 g |
| Disodium 4,5-dihydroxybenzene-1,3-disulfonate | 0.5 g | 0.5 g |
| Triethanolamine | 12.0 g | 12.0 g |
| Potassium chloride | 2.5 g | — |
| Potassium bromide | 0.01 g | — |
| Potassium carbonate | 27.0 g | 27.0 g |
| Fluorescent whitening agent | 1.0 g | 2.5 g |

-continued

| | | |
|---|---|---|
| (Whitex 4 manufactured by Sumitomo Chem. Ind. Co., Ltd.)) | | |
| Sodium sulfite | 0.1 g | 0.2 g |
| Disodium N,N-bis(sulfonatoethyl) hydroxylamine | 5.0 g | 8.0 g |
| N-ethyl-N-(β-methanesulfon-amidoethyl)-3-methyl-4-aminoaniline 3/2 sulfate monohydrate | 5.0 g | 7.1 g |
| Water was added to | 1000 ml | 1000 ml |
| pH (25° C.) | 10.05 | 10.45 |
| (adjusted with potassium hydroxide and sulfuric acid) | | |

| Bleach/fixing solution | (Common to the tank solution and replenishing solution) |
|---|---|
| Water | 600 ml |
| Ammonium thiosulfate (700 g/liter) | 100 ml |
| Ammonium sulfite | 40 g |
| Iron (III) ammonium ethylene-diaminetetracetate | 55 g |
| Iron ethylenediaminetetraacetate | 5 g |
| Ammonium bromide | 40 g |
| Sulfuric acid (67%) | 30 g |
| Water was added to | 1000 ml |
| pH (25° C.) | 5.8 |
| (adjusted with acetic acid and aqueous ammonia) | |

| Rinsing solution | (Common to the tank solution and replenishing solution) |
|---|---|
| Sodium chloroisocyanurate | 0.02 g |
| Deionized water (dielectric constant: 5 μS/cm or less) | 1000 ml |
| pH | 6.5 |

First, in order to measure the sharpness of the respective samples, they were exposed to green light via an optical wedge for measuring CTF and then processed.

CTF described herein represents the attenuation behavior of the contrast of an image obtained in carry-ing out the exposure of a square wave form while varying a spatial frequency. The images obtained by giving the contrast of 0.2 in the exposure of the square wave form at the spatial frequency of 2.5 cycle/mm with a visually sharpest green light were used herein to compare the relative values of the contrasts of the respective samples.

It was confirmed that the samples in which the supports according to the present invention were used had a high sharpness.

Next, the respective samples were subjected to a gradational exposure with a light source passed through a blue filter and then to processing in the above processing solutions. The samples obtained after processing were visually observed to confirm that the samples in which the couplers according to the present invention were used had less redish color and provided a brilliant yellow color. The optical density of each sample was measured through a blue filter and then stored under the conditions of 80° C. and a relative humudity of 70% for 3 weeks. The optical density was measured once again to obtain a dye image residual rate at an initial density of 1.5. The results thereof are shown in Table-A.

TABLE A

| Sample No. | Support | Yellow coupler | Dye image* residual rate | Color reproduction |
|---|---|---|---|---|
| 101 (Comp.) | 6 | ExY | 70% | C |
| 102 (Comp.) | 6 | YO-1 | 62% | A |
| 103 (Comp.) | 6 | YO-4 | 57% | A |
| 104 (Comp.) | 1 | ExY | 77% | C |
| 105 (Comp.) | 2 | ExY | 76% | C |
| 106 (Inv.) | 1 | YO-1 | 77% | A |
| 107 (Inv.) | 2 | YO-1 | 78% | A |
| 108 (Inv.) | 3 | YO-1 | 76% | A |
| 109 (Inv.) | 4 | YO-1 | 78% | A |
| 110 (Inv.) | 5 | YO-1 | 77% | A |
| 111 (Inv.) | 1 | YO-4 | 74% | A |
| 112 (Inv.) | 2 | YO-4 | 75% | A |
| 113 (Inv.) | 3 | YO-7 | 82% | A |
| 114 (Inv.) | 5 | YO-10 | 78% | A |

*at 80° C., 70% and 3 weeks.
A: Excellent
C: Inferior

As shown in Table-A, in the case where Couplers YO-1 and YO-4 according to formula (III) of the present invention were used for conventional Support 6 (Samples 102 and 103), the stability of the formed image was inferior to the sample in which the comparative coupler ExY was used, while color reproduction performance was excellent with the invention couplers and inferior with the comparative coupler.

Meanwhile, in the case where Couplers YO-1 and YO-4 according to the present invention were used for Support 1 according to the present invention (Samples 106 and 111), the image stability was markedly improved.

Also, in the case where the couplers of the present invention were combined with Supports 2 to 5 according to the present invention, almost the same results were obtained.

Thus, the objects of the present invention could be achieved by using the coupler of Formula (III) of the present invention in combination with the support according to the present invention.

It was unexpected that the image stability under the conditions of high temperature and high humidity could be improved according to the kind of the resin for laminating as described above, and it was quite unexpected that a particularly large effect was shown with the coupler of the present invention.

EXAMPLE 2

Sample 201 was prepared in the same manner as that used in Example 1, except that the compositions in the first layer to seventh layer of Sample 101 in Example 1 were changed as follows:

Support:

Polyethylene-laminated paper
[polyethylene coated on the 1st layer side contained 14 weight % of a white pigment (titanium oxide) and a blue dye (ultramarine)].

First layer (a blue-sensitive emulsion layer):

| | |
|---|---|
| Above silver chlorobromide emulsion | 0.27 |
| Gelatin | 1.65 |
| Yellow coupler (ExY-2) | 0.65 |
| Dye image stabilizer (Cpd-6) | 0.06 |
| Dye image stabilizer (Cpd-2) | 0.48 |
| Dye image stabilizer (Cpd-8) | 0.06 |

-continued

| | |
|---|---|
| Solvent (Solv-5) | 0.30 |
| Solvent (Solv-2) | 0.10 |
| Second layer (an anti-color mixing layer): | |
| Gelatin | 1.00 |
| Anti-color mixing agent (Cpd-A) | 0.05 |
| Anti-color mixing agent (Cpd-B) | 0.05 |
| Solvent (Solv-7) | 0.04 |
| Solvent (Solv-2) | 0.16 |
| Solvent (Solv-3) | 0.08 |
| Third layer (a green-sensitive emulsion layer): | |
| Silver chlorobromide emulsion (cube, 1:3 mixture (Ag mole ratio) of a large size emulsion B having an average grain size of 0.55 μm and a small size emulsion B having an average grain size of 0.39 μm, wherein the fluctuation coefficients in the grain size distributions were 0.10 and 0.08, respectively, and both size emulsions comprised the grains in which 0.8 mol % silver bromide was localized on a part of the grain surface and the rest was silver chloride) | 0.12 |
| Gelatin | 1.45 |
| Magenta coupler (M-A) | 0.26 |
| Dye image stabilizer (Cpd-8) | 0.03 |
| Dye image stabilizer (Cpd-5) | 0.04 |
| Dye image stabilizer (Cpd-C) | 0.02 |
| Dye image stabilizer (Cpd-2) | 0.02 |
| Solvent (Solv-8) | 0.30 |
| Solvent (Solv-9) | 0.15 |
| Fourth layer (an anti-color mixing layer): | |
| Gelatin | 0.80 |
| Anti-color mixing agent (Cpd-A) | 0.04 |
| Anti-color mixing agent (Cpd-B) | 0.04 |
| Solvent (Solv-7) | 0.03 |
| Solvent (Solv-2) | 0.13 |
| Solvent (Solv-3) | 0.06 |

-continued

| | |
|---|---|
| Fifth layer (a red-sensitive emulsion layer): | |
| Silver chlorobromide emulsion (cube, 1:4 mixture (Ag mole ratio) of a large size emulsion C having an average grain size of 0.50 μm and a small size emulsion C having an average grain size of 0.41 μm, wherein the fluctuation coefficients in the grain size distributions were 0.09 and 0.11, respectively, and both size emulsions comprised grains in which 0.8 mol % silver bromide was localized on a part of the grain surface and the rest was silver chloride) | 0.20 |
| Gelatin | 0.85 |
| Cyan coupler (C-A) | 0.33 |
| UV absorber (UV-2) | 0.18 |
| Dye image stabilizer (Cpd-9) | 0.01 |
| Dye image stabilizer (Cpd-10) | 0.01 |
| Dye image stabilizer (Cpd-11) | 0.01 |
| Solvent (Solv-6) | 0.22 |
| Dye image stabilizer (Cpd-8) | 0.01 |
| Dye image stabilizer (Cpd-6) | 0.01 |
| Solvent (Solv-1) | 0.01 |
| Dye image stabilizer (Cpd-1) | 0.31 |
| Sixth layer (a UV absorbing layer): | |
| Gelatin | 0.55 |
| UV absorber (UV-1) | 0.38 |
| Dye image stabilizer (Cpd-12) | 0.15 |
| Dye image stabilizer (Cpd-5) | 0.02 |
| Seventh layer (a protective layer): | |
| Gelatin | 1.13 |
| Acryl-modified copolymer of polyvinyl alcohol (modification degree: 17%) | 0.05 |
| Liquid paraffin | 0.02 |
| Dye image stabilizer (Cpd-13) | 0.01 |

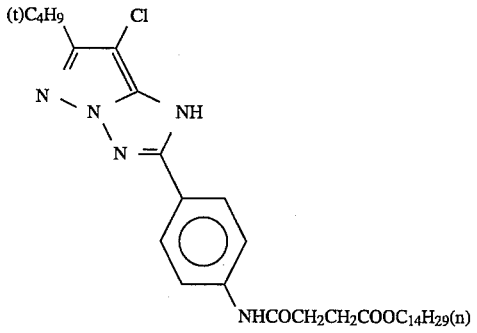

M-A

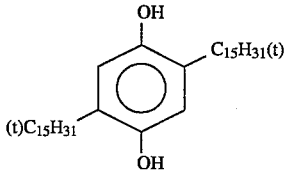

Cpd-A

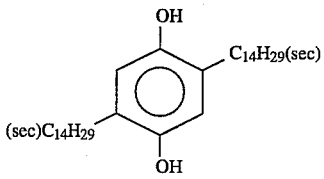

Cpd-B $O{=}P{-}[OC_6H_{13}(n)]_3$

Solv-8

-continued

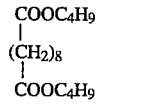

Solv-9

1:1 mixture (mole ratio) of

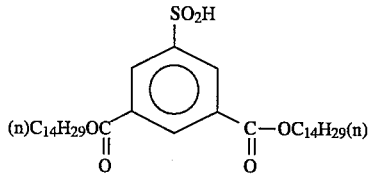

Cpd-C and

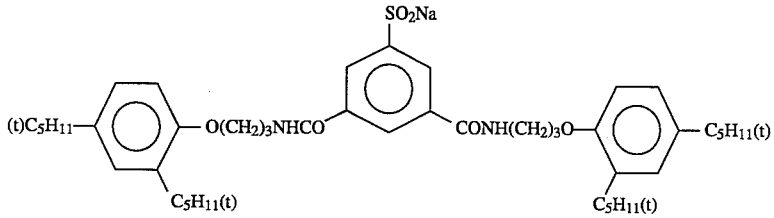

4:6 mixture (mole ratio) of

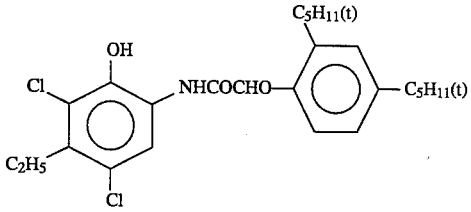

C-A (cyan coupler)

and

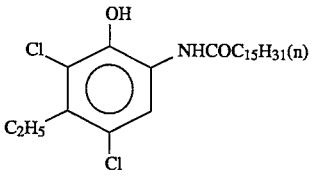

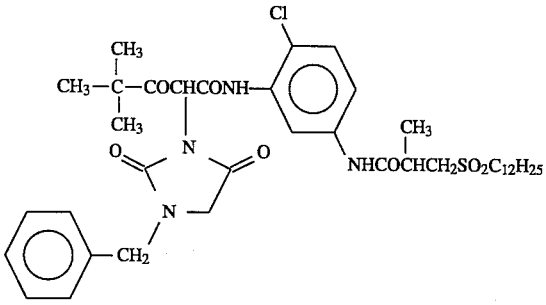

Exy-2

Next, Samples 202 to 228 were prepared in the same manner as that used for Sample 201, except that the coupler and support used in Sample 201 were changed as shown in Table-B.

In the case where a coupler represented by formula (I) or (II) was used, the coated amounts of the coupler and silver were set at 80 mol % based on those of Sample 201.

The above samples were subjected to exposure and processing in the same manners as described in Example 1 to evaluate color reproduction performance and sharpness. The results thereof are shown in Table-B.

TABLE B

| Sample No. | Support | Coupler | Color reproduction | Sharpness |
|---|---|---|---|---|
| 201 (Comp.) | 6 | ExY | C | C |
| 202 (Comp.) | 6 | ExY-2 | C | C |
| 203 (Comp.) | 6 | Y-3 | B | C |
| 204 (Comp.) | 6 | Y-19 | B | C |
| 205 (Comp.) | 6 | Y-4 | A | C |
| 206 (Comp.) | 1 | ExY | C | C |
| 207 (Comp.) | 2 | ExY | C | B |

TABLE B-continued

| Sample No. | Support | Coupler | Color reproduction | Sharpness |
|---|---|---|---|---|
| 208 (Comp.) | 5 | ExY | C | B |
| 209 (Comp.) | 1 | ExY-2 | C | B |
| 210 (Inv.) | 1 | Y-3 | B | B |
| 211 (Inv.) | 1 | Y-19 | B | B |
| 212 (Inv.) | 1 | Y-4 | A | B |
| 213 (Inv.) | 2 | Y-3 | B | B |
| 214 (Inv.) | 3 | Y-3 | B | B |
| 215 (Inv.) | 4 | Y-3 | B | B |
| 216 (Inv.) | 5 | Y-3 | B | B |
| 217 (Inv.) | 3 | Y-18 | B | B |
| 218 (Inv.) | 5 | Y-20 | A | B |
| 219 (Comp.) | 6 | 2 | A | C |
| 220 (Comp.) | 6 | 18 | B | C |
| 221 (Comp.) | 6 | 59 | B | C |
| 222 (Inv.) | 1 | 2 | A | B |
| 223 (Inv.) | 1 | 18 | B | B |
| 224 (Inv.) | 1 | 59 | B | B |
| 225 (Inv.) | 2 | 2 | A | B |
| 226 (Inv.) | 3 | 2 | A | B |
| 227 (Inv.) | 4 | 2 | A | B |
| 228 (Inv.) | 5 | 2 | A | B |

A: Very excellent
B: Excellent
C: Inferior

As is apparent from the results summarized in Table-B, the combination of the coupler of the present inven-tion with the support of the present invention provides excellent color reproduction performance and high sharpness at the same time.

Next, 4 sheets each of the samples subjected to gradational exposure were prepared and image stability was evaluated under the following conditions A to D:

Condition A: storing for 2 months at 70° C. and 65% RH.

Condition B: storing for 4 weeks under an intermittent xenon light source (bright for 5 hours/dark for 1 hour) at 80,000 lux.

Condition C: storing for 1 week at 60° C. and 70% RH.

Condition D: storing at Condition B after storing at Condition C.

The image stability was evaluated by the image residual rate at the initial yellow density of 1.5. The results thereof are shown in Table-C.

TABLE C

| Sample No. | Dye image residual rate (%) Condition A | B | C | D |
|---|---|---|---|---|
| 201 (Comp.) | 70 | 77 | 99 | 71 |
| 202 (Comp.) | 68 | 75 | 98 | 69 |
| 203 (Comp.) | 84 | 66 | 100 | 59 |
| 204 (Comp.) | 85 | 68 | 99 | 61 |
| 205 (Comp.) | 90 | 69 | 100 | 60 |
| 206 (Comp.) | 79 | 75 | 99 | 50 |
| 207 (Comp.) | 78 | 72 | 99 | 49 |
| 208 (Comp.) | 78 | 73 | 99 | 51 |
| 209 (Comp.) | 74 | 71 | 98 | 45 |
| 210 (Inv.) | 85 | 75 | 100 | 73 |
| 211 (Inv.) | 86 | 74 | 100 | 72 |
| 212 (Inv.) | 91 | 70 | 100 | 69 |
| 213 (Inv.) | 85 | 74 | 100 | 70 |
| 214 (Inv.) | 84 | 75 | 100 | 71 |
| 215 (Inv.) | 86 | 73 | 99 | 70 |
| 216 (Inv.) | 86 | 75 | 100 | 71 |
| 217 (Inv.) | 87 | 72 | 99 | 68 |
| 218 (Inv.) | 92 | 69 | 100 | 67 |

TABLE C-continued

| Sample No. | Dye image residual rate (%) Condition A | B | C | D |
|---|---|---|---|---|
| 219 (Comp.) | 96 | 75 | 100 | 70 |
| 220 (Comp.) | 94 | 72 | 99 | 68 |
| 221 (Comp.) | 92 | 70 | 97 | 64 |
| 222 (Inv.) | 96 | 81 | 100 | 77 |
| 223 (Inv.) | 93 | 79 | 100 | 75 |
| 224 (Inv.) | 91 | 78 | 99 | 72 |
| 225 (Inv.) | 95 | 79 | 100 | 76 |
| 226 (Inv.) | 96 | 80 | 100 | 77 |
| 227 (Inv.) | 96 | 78 | 100 | 76 |
| 228 (Inv.) | 95 | 81 | 100 | 78 |

As can be seen from the results summarized in Table-C, the comparative couplers which were combined with the supports of the present invention markedly deteriorated with fading at Condition D and could not be applied to a practical use. Meanwhile, it can be seen that the couplers represented by formula (I) or (II) according to the present invention which were combined with the supports of the present invention did not deteriorate with fading at Condition D but rather improved it.

Accordingly, the combined use of the couplers of the present invention represented by formula (I) or (II) with the supports of the present invention makes it possible to improve image stability under various conditions to a satisfactory level as well as to provide excellent color reproduction performance and high sharpness. Also, it is confirmed that the use of the couplers represented by formula (II) together with the supports of the present invention further provides an excellent whiteness degree to a background.

EXAMPLE 3

Samples were prepared in which the compounds shown in Table-D were added to the first layer (the blue-sensitive emulsion layer) in Sample 201 of Example 2. The compounds shown in the table were dissolved together with the couplers in emulsifying in the range of 10 to 100 mole % based on the amount of the coupler and dispersed in gelatin.

The respective samples were subjected to gradational exposure and processing in the same manner as described in Example 1. The samples obtained after the processing were continuously irradi-ated by a fluorescent lamp light source at 55,000 lux for 1 month, and then the dye image residual rates at the initial densities of 1.5 and 0.5 were measured. The results thereof are shown in Table-D.

TABLE D

| Sample No. | Support | Coupler | Additive Kind | Additive Amount* | Dye image residual rate D = 1.5 | D = 0.5 |
|---|---|---|---|---|---|---|
| 301 (Comp.) | 6 | ExY | — | — | 78 | 70 |
| 302 (Comp.) | 6 | YO-1 | — | — | 75 | 52 |
| 303 (Comp.) | 6 | Y-3 | — | — | 70 | 45 |
| 304 (Comp.) | 6 | 2 | — | — | 74 | 59 |
| 305 (Comp.) | 6 | ExY | B-2 | 20 | 85 | 76 |
| 306 (Comp.) | 6 | ExY | P-1 | 20 | 83 | 73 |
| 307 (Comp.) | 6 | YO-1 | P-1 | 20 | 78 | 57 |
| 308 (Comp.) | 6 | Y-3 | B-2 | 20 | 77 | 56 |

TABLE D-continued

| Sample No. | Support | Coupler | Additive Kind | Additive Amount* | Dye image residual rate D = 1.5 | Dye image residual rate D = 0.5 |
|---|---|---|---|---|---|---|
| 309 (Comp.) | 1 | ExY | B-2 | 20 | 87 | 79 |
| 310 (Comp.) | 1 | ExY | P-1 | 20 | 85 | 77 |
| 311 (Inv.) | 1 | Y-3 | B-2 | 10 | 82 | 75 |
| 312 (Inv.) | 1 | Y-3 | B-2 | 20 | 85 | 81 |
| 313 (Inv.) | 1 | Y-3 | B-2 | 50 | 89 | 86 |
| 314 (Inv.) | 1 | Y-3 | B-20 | 20 | 83 | 79 |
| 315 (Inv.) | 1 | Y-3 | P-1 | 20 | 81 | 75 |
| 316 (Inv.) | 1 | Y-3 | H-2 | 20 | 84 | 76 |
| 317 (Inv.) | 1 | Y-3 | E-21 | 10** | 82 | 75 |
| 318 (Inv.) | 1 | Y-3 | A-19 | 25** | 84 | 77 |
| 319 (Inv.) | 1 | Y-4 | E-1 | 30** | 80 | 76 |
| 320 (Inv.) | 1 | Y-4 | B-4 | 20 | 80 | 74 |
| 321 (Inv.) | 1 | Y-4 | P-1 | 20 | 81 | 75 |
| 322 (Inv.) | 1 | YO-1 | B-12 | 20 | 87 | 81 |
| 323 (Inv.) | 1 | YO-4 | B-20 | 20 | 83 | 79 |
| 324 (Inv.) | 1 | YO-4 | H-2 | 20 | 86 | 82 |
| 325 (Inv.) | 1 | YO-4 | H-7 | 20 | 83 | 78 |
| 326 (Inv.) | 1 | YO-4 | P-1 | 20 | 81 | 75 |
| 327 (Inv.) | 1 | YO-4 | P-1 | 50 | 84 | 80 |
| 328 (Inv.) | 1 | YO-4 | P-1 | 100 | 86 | 84 |
| 329 (Inv.) | 3 | YO-4 | P-1 | 20 | 82 | 76 |
| 330 (Inv.) | 3 | YO-4 | A-28 | 20 | 80 | 74 |
| 331 (Inv.) | 1 | 2 | B-2 | 20 | 83 | 76 |
| 332 (Inv.) | 1 | 2 | P-1 | 20 | 87 | 82 |
| 333 (Inv.) | 1 | 2 | A-27 | 20 | 81 | 74 |
| 334 (Inv.) | 1 | 2 | A-29 | 20 | 80 | 74 |

*mole %
**weight %

It can be seen from the results summarized in Table-D that in the case where Support 6 was used, the image preserving performance at a low density portion under the irradiation of a fluorescent lamp was inferior with the couplers of the present invention as compared with the comparative couplers. The addition of additives did not improve this result to a large extent. Meanwhile, it can be seen that the changing to the support of the present invention combined with any of the compounds represented by formulas (IV) to (VIII) surprisingly improved the fading at a low density portion to a large extent.

EXAMPLE 4

The samples shown in Table-E were prepared in the same manner as described in Example 3, and the blue light densities thereof at an unexposed portion (a background portion) were measured after processing. These samples were stored at the condition of 80° C. for 10 days to check the density change at the background portion. The results thereof are shown in Table-E.

TABLE E

| Sample No. | Support | Coupler | Additive Kind | Additive Amount* | Density increase on background |
|---|---|---|---|---|---|
| 401 (Comp.) | 6 | ExY | — | — | 0.08 |
| 402 (Comp.) | 6 | YO-1 | — | — | 0.10 |
| 403 (Comp.) | 6 | Y-3 | — | — | 0.11 |
| 404 (Comp.) | 6 | ExY | B-2 | 20 | 0.07 |
| | | | E-21 | 20 | |
| 405 (Comp.) | 6 | Y-3 | B-2 | 20 | 0.08 |

TABLE E-continued

| Sample No. | Support | Coupler | Additive Kind | Additive Amount* | Density increase on background |
|---|---|---|---|---|---|
| | | | E-21 | 20 | |
| 406 (Comp.) | 6 | YO-4 | P-1 | 20 | 0.09 |
| | | | H-2 | 20 | |
| 407 (Comp.) | 1 | ExY | B-2 | 20 | 0.05 |
| | | | E-21 | 20 | |
| 408 (Inv.) | 1 | Y-3 | B-2 | 20 | 0.02 |
| | | | E-21 | 20 | |
| 409 (Inv.) | 1 | Y-4 | P-1 | 20 | 0.03 |
| | | | H-2 | 20 | |
| 410 (Inv.) | 1 | YO-4 | P-1 | 20 | 0.03 |
| | | | H-2 | 20 | |
| 411 (Inv.) | 1 | YO-1 | B-2 | 20 | 0.02 |
| | | | E-21 | 20 | |
| 412 (Comp.) | 1 | ExY | B-2 | 20 | 0.08 |
| 413 (Comp.) | 1 | ExY | E-21 | 20 | 0.07 |
| 414 (Comp.)* | 1 | Y-3 | B-2 | 20 | 0.06 |
| 415 (Comp.)* | 1 | Y-3 | E-21 | 20 | 0.05 |
| 416 (Comp.)* | 1 | YO-4 | P-1 | 20 | 0.06 |
| 417 (Comp.)* | 1 | YO-4 | H-2 | 20 | 0.05 |

*Comparative embodiments for purposes of claims 8 and 9.

It can be seen from the results summarized in Table-E that the combination described in claim 8 or 9 can reduce the coloring of the background which can occur with dark storage.

EXAMPLE 5

Samples were prepared in which the magenta coupler ExM contained in the third layer (the green-sensitive emulsion layer) in Example 1 and Example 2 was replaced with the magenta couplers C-3, 1-15, 1-23, 1-25, 1-26 and 1-28 described in International Patent Publication WO92/18902 at 50 mole % and 100 mole %. They were evaluated in the same manner as described in Example 1 and Example 2. Also in this case, the same results as those in Example 1 and Example 2 were obtained.

Further, a sample was prepared in which the magenta coupler was replaced with M-1 described in International Patent Publication WO92/18903, and it was evaluated in the same manner as that described above. Also in this case, almost the same effects were observed.

EXAMPLE 6

Scanning Exposure

Samples were prepared and evaluated in the same manner as described in Examples 1 to 4, except that the samples were exposed in the following manner. The results obtained were the same as those in Examples 1 to 4.

Exposure:

A 473 nm light source obtained by subjecting a YAG solid state laser (oscillation wavelength: 946 nm) in which a GaAlAs semiconductor laser (oscillation wavelength: 808.5 nm) was used as an exciting light source to a wavelength modulation with an SHG crystal of $KNbO_3$, a 532 nm light source obtained by subjecting a $YVO_4$ solid state laser (oscillation wavelength: 1064 nm) in which a GaAlAs semiconductor laser (oscillation wavelength: 808.7 nm) was used as an exciting light source to a wavelength modulation with an SHG crystal of KTP, and an AlGaInP semiconductor laser (oscillation wavelength: about 670 nm; Type No. TOLD 9211 manufactured by Toshiba Co., Ltd.) were used.

Also, equipment was used in which a laser ray could be scanned and exposed in order on a color photographic paper moving to the direction vertical to the scanning direction with a rotary polyhedron. The relationship of the density (D) of the light-sensitive material with the quantity of light, D-log E, was obtained with this equipment while changing the quantity of light, wherein the laser rays of the three wavelengths were subjected to the modulation of the quantity of light by means of an external modulator to thereby control the exposure. This scanning exposure was carried out at 400 dpi, wherein an average exposing time per picture element was about $5\times10^{-8}$ second. A Peltier element was used to maintain a constant temperature in order to control the change in the quantity of light due to the change in the temperature.

While the invention has been described in detail and with reference to specific embodiments thereof, it will be apparent to one skilled in the art that various changes and modifications can be made therein without departing from the spirit and scope thereof.

What is claimed is:

1. A silver halide color photographic light-sensitive material comprising a reflective support having provided thereon (a) at least three light-sensitive hydrophilic colloid layers on one side of the reflective support, with at least one light-sensitive layer containing a yellow color-developing coupler and silver halide emulsion grains, at least one light-sensitive layer containing a magenta color-developing coupler and silver halide emulsion grains, and at least one light-sensitive layer containing a cyan color-developing coupler and silver halide emulsion grains, with each light-sensitive layer having a different color sensitivity from the other light-sensitive layers, and (b) a light-insensitive hydrophilic colloid layer, wherein on at least the side of the support on which the light-sensitive layers are coated, the surface of the support is coated with a composition prepared by mixing and dispersing a white pigment in a resin comprising mainly polyester synthesized by the polycondensation of a dicarboxylic acid and a diol, and a yellow coupler-containing layer contains at least one of the dye-forming couplers represented by formula (I) or (II):

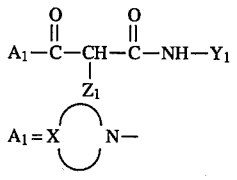

(I)

wherein X represents an organic group necessary to form a nitrogen-containing heterocyclic group together with a nitrogen atom; $Y_1$ represents an aromatic group or a heterocyclic group; and $Z_1$ represents a group that splits off when the coupler represented by formula (I) reacts with an oxidation product of a developing agent;

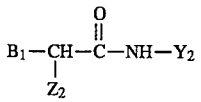

(II)

-continued

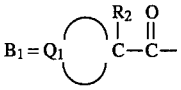

wherein $R_2$ represents a monovalent substituent other than a hydrogen atom, wherein said monovalent substituent is selected from the group consisting of a halogen atom, an alkyl group, an alkoxy group, an alkylthio group, an aryl group, an aryloxy group, and an arylthio group; $Q_1$ represents a group of non-metal atoms necessary to form a 3- to 5-membered hydrocarbon ring or a 3- to 6-membered heterocyclic group having at least one hetero atom selected from the group consisting of N, O, S and P together with at least one carbon atom; provided that $R_2$ may be combined with $Q_1$ to form a polycyclic ring having two or more rings; $Z_2$ represents a hydrogen atom or a group capable of splitting off upon a coupling reaction with the oxidation product of an aromatic primary amine developing agent; and $Y_2$ represents an aromatic group or a heterocyclic group.

2. A silver halide color photographic light-sensitive material as in claim 1, wherein polyester coated on the reflection support comprises polyethylene terephthalate in an amount more than 50 wt %.

3. A silver halide color photographic light-sensitive material as in claim 1, wherein the resin coated on the reflective support is polyester synthesized by the polycondensation of a dicarboxylic acid and a diol; on the side of the support on which the light-sensitive layers are coated, the surface of the support is coated with a composition prepared by mixing and dispersing a white pigment in the polyester, in which the dicarboxylic acid is a mixture of terephthalic acid and isophthalic acid in a mole ratio of 9:1 to 2:8; and on the other side of the support, the surface of the support is coated with a resin or a composition comprising a resin in an amount more than 50 wt %.

4. A silver halide color photographic light-sensitive material as in claim 1, wherein the resin coated on the reflective support is polyester synthesized by the polycondensation of a dicarboxylic acid and a diol; on the side of the support on which the light-sensitive layers are coated, the surface of the support is coated with a composition prepared by mixing and dispersing a white pigment in the polyester, in which the dicarboxylic acid is a mixture of terephthalic acid and naphthalenedicarboxylic acid in a mole ratio of 9:1 to 2:8; and on the other side of the support, the surface of the support is coated with a resin or a composition comprising a resin an amount more than 50 wt %.

5. A silver halide color photographic light-sensitive material as in claim 3 or 4, wherein the diol is ethylene glycol.

6. A silver halide color photographic light-sensitive material as in any of claims 1 to 4, wherein the white pigment contained in the reflective support is titanium oxide, and the titanium oxide and the resin are present in a titanium oxide/resin ratio of from 5/95 to 50/50.

7. A silver halide color photographic light-sensitive material as in any of claims 1 to 4, wherein a yellow coupler-containing layer contains at least one of the compounds represented by formula (IV), (V), (VI), (VII), or (VIII):

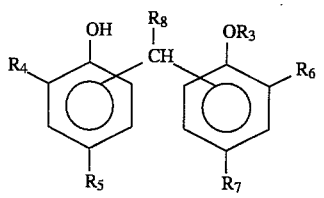

(IV)

wherein $R_3$ represents a hydrogen atom, an alkyl group, an acyl group, an aryl group, or an alkenyl group; $R_4$, $R_5$, $R_6$ and $R_7$ independently represent an alkyl group; $R_8$ represents a hydrogen atom or an alkyl group; a methine group connects the two benzene rings and is bonded at an ortho position, a meta position or a para position to the oxygen atom bonded to each ring; and in the case where the methine group is bonded at a para position, $R_5$ or $R_7$ represents the methine group itself and in this case, the benzene ring having the methine group for $R_5$ or $R_7$ may further have an alkyl group;

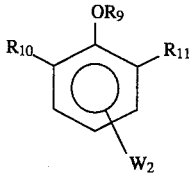

(V)

wherein $R_9$ represents a hydrogen atom, an alkyl group, an aryl group, or an acyl group; $R_{10}$ and $R_{11}$ independently represent a alkyl group or an alkoxy group; and $W_2$ represents a monovalent group capable of being substituted on a benzene ring, wherein $W_2$ is a halogen atom, an alkyl group having a carbon number of about 1 to 30, an aryl group having a carbon number of about 6 to 30, an alkoxy group having a carbon number of about 1 to 30, an alkoxycarbonyl group having a carbon number of about 2 to 30, an aryloxycarbonyl group having a carbon number of about 7 to 30, a carbonamide group having a carbon number of about 1 to 30, a sulfonamide group having a carbon number of about 1 to 30, a carbamoyl group having a carbon number of about 1 to 30, a sulfamoyl group having a carbon number of about 0 to 30, an alkylsulfonyl group having a carbon number of about 1 to 30, an arylsulfonyl group having a carbon number of about 6 to 30, a ureido group having a carbon number of about 1 to 30, a sulfamoylamino group having a carbon number of about 0 to 30, an alkoxycarbonylamino group having a carbon number of about 2 to 30, a heterocyclic group having a carbon number of about 1 to 30, an acyl group having a carbon number of about 1 to 30, an alkylsulfonyloxy group having a carbon number of about 1 to 30, or an arylsulfonyloxy group having a carbon number of about 6 to 30;

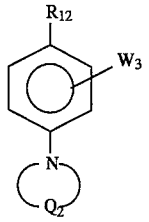

(VI)

wherein $Q_2$ represents a divalent group forming a 5- to 7-membered heterocyclic ring together with a nitrogen atom and an alkylene group; $R_{12}$ represents an alkyl group, an alkoxy group, a aryloxy group, or an acyloxy group; and $W_3$ represents a monovalent group capable of being substituted on a benzene ring, wherein $W_3$ is a halogen atom, an alkyl group having a carbon number of about 1 to 30, an aryl group having a carbon number of about 6 to 30, an alkoxy group having a carbon number of about 1 to 30, an alkoxycarbonyl group having a carbon number of about 2 to 30, an aryloxycarbonyl group having a carbon number of about 7 to 30, a carbonamide group having a carbon number of about 1 to 30, a sulfonamide group having a carbon number of about 1 to 30, a carbamoyl group having a carbon number of about 1 to 30 a sulfamoyl group having a carbon number of about 0 to 30, an alkylsulfonyl group having a carbon number of about 1 to 30, an arylsulfonyl group having a carbon number of about 6 to 30, a ureido group having a carbon number of about 1 to 30, a sulfamoylamino group having a carbon number of about 0 to 30, an alkoxycarbonylamino group having a carbon number of about 2 to 30, a heterocyclic group having a carbon number of about 1 to 30, an acyl group having a carbon number of about 1 to 30, an alkylsulfonyloxy group having a carbon number of about 1 to 30, or an arylsulfonyloxy group having a carbon number of about 6 to 30;

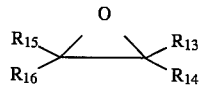

(VII)

wherein $R_{23}$, $R_{14}$, $R_{15}$ and $R_{16}$ each represent a hydrogen atom, an aliphatic group, an aromatic group, an aliphatic oxycarbonyl group, an aromatic oxycarbonyl group, or a carbamoyl group, provided that all of $R_{13}$, $R_{14}$, $R_{15}$ and $R_{16}$ are not hydrogen atoms at the same time; and 1 to 60 epoxy groups can be contained in one molecule of the compound represented by formula (VII);

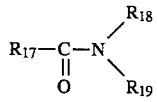

(VIII)

wherein $R_{17}$, $R_{18}$ and $R_{19}$ independently represents an alkyl group or an aryl group; in the case where both of $R_{18}$ and $R_{19}$ are alkyl groups, they may be combined with each other to form a 5- to 7-membered ring; and further, either one of $R_{18}$ and $R_{19}$ may be a hydrogen atom.

8. A silver halide color photographic light-sensitive material as in claim 7, wherein a yellow coupler-containing layer contains the compound represented by formula (IV) and the compound represented by formula (VII).

9. A silver halide color photographic light-sensitive material as in claim 7, wherein a yellow coupler-containing layer contains at least one of the compounds represented by formula (IV) or (V) and at least one of the compounds represented by formula (VI) or (VII).

10. A silver halide color photographic light-sensitive material as in claim 7, wherein a yellow coupler-containing layer contains the compound represented by formula (IV).

11. A silver halide color photographic light-sensitive material as in claim 7, wherein a yellow coupler-containing layer contains the compound represented by formula (V).

12. A silver halide color photographic light-sensitive material as in claim 7, wherein a yellow coupler-containing layer contains the compound represented by formula (VI).

13. A silver halide color photographic light-sensitive material as in claim 7, wherein a yellow coupler-containing layer contains the compound represented by formula (VII).

14. A silver halide color photographic light-sensitive material as in claim 7, wherein a yellow coupler-containing layer contains the compound represented by formula (VIII).

15. A silver halide color photographic light-sensitive material as in claim 7, wherein a yellow coupler-containing layer contains the compound represented by formula (IV) and the compound represented by formula (VIII).

16. A silver halide color photographic light-sensitive material as in claim 7, wherein a yellow coupler-containing layer contains the compound represented by formula (V) and the compound represented by formula (VI).

17. A silver halide color photographic light-sensitive material comprising a reflective support having provided thereon (a) at least three light-sensitive hydrophilic colloid layers on one side of the reflective support, with at least one light-sensitive layer containing a yellow color-developing coupler and silver halide emulsion grains, at least one light-sensitive layer containing a magenta color-developing coupler and silver halide emulsion grains, and at least one light-sensitive layer containing a cyan color-developing coupler and silver halide emulsion grains, with each light-sensitive layer having a different color sensitivity from the other light-sensitive layers, and (b) a light-insensitive hydrophilic colloid layer, wherein on at least the side of the support on which the light-sensitive layers are coated, the surface of the support is coated with a composition prepared by mixing and dispersing a white pigment in a resin comprising mainly polyester synthesized by the polycondensation of a dicarboxylic acid and a diol, and a yellow coupler-containing layer contains at least one of the dye-forming couplers represented by formula (III):

(III)

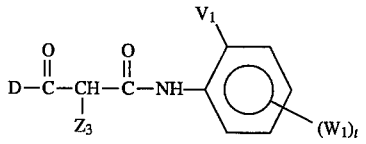

wherein D represents a tertiary alkyl group; $V_1$ represents a fluorine atom, an alkoxy group, an aryloxy group, a dialkylamino group, an alkylthio group, an arylthio group, or an alkyl group; $Z_3$ represents a group that splits off when the coupler represented by formula (III) reacts with an oxidation product of a developing agent; $W_1$ represents a group capable of being substituted on a benzene ring, wherein $W_1$ is a halogen atom, an alkyl group having a carbon number of about 1 to 30, an aryl group having a carbon number of about 6 to 30, an alkoxy group having a carbon number of about 1 to 30, an alkoxycarbonyl group having a carbon number of about 2 to 30, an aryloxycarbonyl group having a carbon number of about 7 to 30, a carbonamide group having a carbon number of about 1 to 30, a sulfonamide group having a carbon number of about 1 to 30, a carbamoyl group having a carbon number of about 1 to 30, a sulfamoyl group having a carbon number of about 0 to 30, an alkylsulfonyl group having a carbon number of about 1 to 30, an arylsulfonyl group having a carbon number of about 6 to 30, a ureido group having a carbon number of about 1 to 30, a sulfamoylamino group having a carbon number of about 0 to 30, an alkoxycarbonylamino group having a carbon number of about 2 to 30, a heterocyclic group having a carbon number of about 1 to 30, an acyl group having a carbon number of about 1 to 30, an alkylsulfonyloxy group having a carbon number of about 1 to 30, or an arylsulfonyloxy group having a carbon number of about 6 to 30; and t represents an integer of 0 to 4.

* * * * *